US007003236B2

(12) United States Patent
Fujita et al.

(10) Patent No.: US 7,003,236 B2
(45) Date of Patent: Feb. 21, 2006

(54) LIQUID DEVELOPMENT APPARATUS, LIQUID DEVELOPMENT METHOD, AND IMAGE FORMING APPARATUS AND IMAGE FORMING METHOD USING LIQUID DEVELOPMENT

(75) Inventors: Toru Fujita, Nagano-ken (JP); Yoshiro Koga, Nagano-ken (JP); Atsunori Kitazawa, Nagano-ken (JP); Masahide Nakamura, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 111 days.

(21) Appl. No.: 10/669,632

(22) Filed: Sep. 25, 2003

(65) Prior Publication Data

US 2004/0131372 A1 Jul. 8, 2004

(30) Foreign Application Priority Data

| | | |
|---|---|---|
| Sep. 27, 2002 | (JP) | 2002-284299 |
| Oct. 11, 2002 | (JP) | 2002-299625 |
| Oct. 11, 2002 | (JP) | 2002-299626 |
| Oct. 11, 2002 | (JP) | 2002-299627 |
| Oct. 28, 2002 | (JP) | 2002-312390 |

(51) Int. Cl.
*G03G 15/10* (2006.01)

(52) U.S. Cl. ..... 399/57; 399/58

(58) Field of Classification Search ..... 399/38, 399/57, 58, 59, 60, 61, 62, 64, 39, 53
See application file for complete search history.

(56) References Cited

U.S. PATENT DOCUMENTS

| | | | | |
|---|---|---|---|---|
| 5,596,396 | A | 1/1997 | Landa et al. | |
| 5,787,320 | A * | 7/1998 | Eun et al. | 399/59 |
| 6,072,972 | A | 6/2000 | Obu et al. | |
| 6,819,888 | B1 * | 6/2000 | Teraoka et al. | 399/57 |
| RE37,859 | E | 9/2002 | Lior et al. | |
| 6,600,884 | B1 * | 7/2003 | Shimmura | 399/57 |

FOREIGN PATENT DOCUMENTS

| | | |
|---|---|---|
| JP | 10-339990 A | 12/1998 |
| JP | 11-65300 A | 3/1999 |
| JP | 2000-250319 A | 9/2000 |

* cited by examiner

*Primary Examiner*—Hoan Tran
(74) *Attorney, Agent, or Firm*—Sughrue Mion, PLLC

(57) ABSTRACT

A liquid development apparatus utilizes wet development as a development method and an image forming technique. The apparatus uses squeegee rollers, disposed facing a developer roller, and moved to adjacent positions at which the squeegee rollers contact a liquid developer which is on the developer roller. Density adjustment bias generators are connected between the developer roller and the squeegee rollers. The density adjustment bias generators include, among other things, positive bias power source parts, negative bias power source parts, short-circuit line parts, and switches which switch connections of the respective parts through in accordance with a control signal received from a CPU. A method that the apparatus performs is also provided.

70 Claims, 57 Drawing Sheets

LIQUID DEVELOPMENT APPARATUS, LIQUID DEVELOPMENT METHOD, AND IMAGE FORMING APPARATUS AND IMAGE FORMING METHOD USING LIQUID DEVELOPMENT

BACKGROUND OF THE INVENTION

1. Field of the Invention

The present invention relates to an electrophotographic image forming technique such as a printer, a copier machine and a facsimile machine, and more particularly, to a liquid development technique which utilizes wet development as a development method and an image forming technique including such a liquid development technique.

2. Description of the Related Art

Such an electrophotographic image forming apparatus has been already commercialized in which exposure means exposes a charged photosensitive member (image carrier) to thereby form an electrostatic latent image on the photosensitive member, developing means makes toner adhere to the photosensitive member, visualizes the electrostatic latent image and accordingly forms a toner image, and the toner image is then transferred onto a transfer medium such as a transfer paper so that a predetermined image is obtained. As a development type used by the developing means, the liquid development is known which uses a liquid developer which is obtained by dispersing charged toner in a carrier liquid. Noting advantages of the liquid development such as that it is possible to obtain a high-resolution image since an average particle diameter of toner is 0.1 through 2 $\mu$m, that it is possible to obtain uniform images owing to high liquidity of the solution and other advantages, various types of image forming apparatuses have been proposed.

In an image forming apparatus of the liquid development, when the toner density in a liquid developer changes, the density of a toner image as it is upon visualization of an electrostatic latent image changes. In other words, a change in toner density in the liquid developer is one of major causes of image quality deterioration such as an insufficient optical density and an uneven image. Hence, in order to obtain a stable image, it is necessary to manage the toner density in the liquid developer. In this connection, Japanese Patent Application Laid-Open Gazette No. H11-065300 of 1999 describes an apparatus which detects the viscosity of a liquid developer within a tank which holds the liquid developer which has been collected from developing means, and which adjusts the toner density in the liquid developer which is within the tank in accordance with a result of the detection. This apparatus comprises a liquid developer reservoir which holds the liquid developer which has been collected from a developing belt, separately from a liquid developer storage tank which holds the liquid developer which is to be supplied to the developing belt. A viscometer detects the viscosity of the liquid developer which is within the tank. The viscosity inside the tank is always kept within a tolerable range, as the liquid developer having a high or low density is supplied to the tank when a result of the detection goes outside the tolerable range and thus density-adjusted liquid developer is supplied to the liquid developer reservoir mentioned above from the tank.

U.S. Pat. No. 5,596,396 describes an apparatus which increases the toner density in a liquid developer which is to be supplied to a liquid developer carrier. For simplification of the structure of the apparatus, this apparatus requires to increase the toner density as much as possible in preparation for supplying of the liquid developer to the liquid developer carrier. Further, Japanese Patent Application Laid-Open Gazette No. H10-339990 of 1998 describes an apparatus which turns a liquid developer layer having a high toner density into a thin layer on a liquid developer carrier. In an attempt to improve an image quality, this apparatus requires to create on a developing belt a liquid developer layer which comprises a highly solid area having a high toner density and a surface layer portion having a thin toner density, thereafter remove the surface layer portion and accordingly leave the high-density liquid developer layer as a thin layer.

The apparatus described in Japanese Patent Application Laid-Open Gazette No. 2000-250319 uses a high-viscosity and high-density liquid developer, and requires to remove a carrier liquid from the liquid developer on a photosensitive member after development to thereby improve an image quality.

By the way, when such images are formed continuously having a high image occupation ratio which is a ratio of an image portion to an electrostatic latent image for instance, a large amount of toner adheres on a photosensitive member and a large amount of toner is consumed, while only a small amount of a carrier liquid moves to the photosensitive member from a container which stores a liquid developer. Conversely, when images having a low image occupation ratio are formed successively, since only a small amount of toner adheres on the photosensitive member, more carrier liquid moves to the photosensitive member from the container than during formation of images which have a high image occupation ratio, and much carrier liquid is consequently consumed.

Hence, on those occasions, the necessity of toner density management is particularly high. Yet, in the case of the apparatus described in Japanese Patent Application Laid-Open Gazette No. H11-065300 of 1999, owing to the liquid developer storage tank for collection which is provided separately from liquid developer reservoir which holds the liquid developer which is to be supplied to the developing belt, the apparatus has a big size. Further, since the toner density within the liquid developer storage tank for collection is adjusted and thus density-adjusted liquid developer is supplied to the liquid developer reservoir mentioned above from the tank, the response of thus realized density adjustment to image formation is not good.

Meanwhile, the conventional apparatus described in U.S. Pat. No. 5,596,396 increases the toner density in the liquid developer which is to be supplied to the liquid developer carrier as much as possible for the purpose of simplifying the structure of the apparatus. The conventional apparatus described in Japanese Patent Application Laid-Open Gazette No. H10-339990 of 1998 makes a high-density liquid developer layer thin so as to attain a high image quality. As such, none of these publications is relevant to a technical concept of managing the toner density in a liquid developer.

Further, as described above, the amount of a carrier liquid contained in a liquid developer which moves to a photosensitive member from a container largely changes depending on an image occupation ratio, and this change in turn leads to a change of the toner density in the liquid developer which remains within the container. Despite this, the conventional apparatus described in Japanese Patent Application Laid-Open Gazette No. 2000-250319 merely comprises a structure which removes a constant amount of the carrier liquid off from a photosensitive member, and does not demand to adjust the amount of the carrier liquid to be removed from the photosensitive member in accordance with the amount of the carrier liquid which is on the photosensitive member. Hence, even when thus removed carrier liquid is returned back to the container, it is not possible to suppress a change in toner density in the liquid developer which is within the container.

Further, as described above, the amount of a carrier liquid which moves to a photosensitive member changes greatly depending on the state of a toner image. However, the conventional apparatus described in Japanese Patent Application Laid-Open Gazette No. 2000-250319 merely comprises a structure which removes a constant amount of a carrier liquid off from a photosensitive member, and therefore, cannot respond to a change of the amount of the carrier liquid on the photosensitive member. When the amount of the carrier liquid on the photosensitive member increases for instance therefore, the carrier liquid could be wasted. In addition, a change of the amount of the carrier liquid on the photosensitive member could change a condition of transfer onto a transfer medium and make it difficult to transfer favorably. Hence, one of important control factors for attaining an excellent image quality is to adjust the amount of a carrier liquid contained in a liquid developer on a photosensitive member, namely, the amount of the carrier liquid which is used at the time formation of a toner image.

As another example of a conventional image forming apparatus of the liquid development, Japanese Patent Application Laid-Open Gazette No. H7-209922 of 1995 proposes an apparatus which requires to supply a high-viscosity and high-density liquid developer onto a developer roller and make the liquid developer contact with a photosensitive member to thereby supply the liquid developer onto a latent image surface of the photosensitive member. In this apparatus, as such a bias is applied which will cause migration of charged toner toward the developer roller at the time of contacting of the liquid developer on the developer roller with the photosensitive member for instance, it is possible to prevent the charged toner from moving toward the photosensitive member. However, since a carrier liquid will inevitably adhere to a photosensitive member after contacting the photosensitive member, it is not possible to prevent the carrier liquid from moving toward the photosensitive member. In the conventional apparatus described in Japanese Patent Application Laid-Open Gazette No. H7-209922, too, since a liquid developer on a developer roller is always in contact with a photosensitive member, a carrier liquid always moves from the developer roller toward the photosensitive member. As a result, when the liquid developer is not in demand because of the state of toner image formation, the carrier liquid is wasted.

SUMMARY OF THE INVENTION

Accordingly, a first object of the present invention is to provide a liquid development apparatus and a liquid development method which need only an apparatus whose structure has a compact size, allow adjustment of a toner density and attain an excellent response to formation of an image, and an image forming apparatus of the liquid development.

A second object of the present invention is to provide an image forming apparatus and an image forming method which make it possible to suppress a change in toner density in a liquid developer which is within a container.

A third object of the present invention is to provide an image forming apparatus and an image forming method which make it possible to form an excellent toner image while preventing a wasteful consumption of a carrier liquid.

A fourth object of the present invention is to provide an image forming apparatus and an image forming method which make it possible to prevent a wasteful consumption of a carrier liquid.

According to a first aspect of the present invention, there is provided a liquid development apparatus in which an electrostatic latent image formed on an image carrier is developed by means of a liquid developer including charged toner dispersed in a carrier liquid, comprising: a liquid developer carrier which transports the liquid developer toward a predetermined developing position while carrying the liquid developer on its surface; and density adjusting means which performs adjustment of a toner density in the liquid developer on the liquid developer carrier.

According to a second aspect of the present invention, there is provided an image forming apparatus comprising: exposure means which forms an electrostatic latent image on a surface of an image carrier; developing means which develops the electrostatic latent image by means of a liquid developer including charged toner dispersed in a carrier liquid and accordingly forms a toner image; and transfer means which transfers the toner image thus formed onto a transfer medium, wherein the developing means comprises a liquid developer carrier which transports the liquid developer toward a predetermined developing position while carrying the liquid developer on its surface, and density adjusting means which performs adjustment of a toner density in the liquid developer on the liquid developer carrier.

According to a third aspect of the present invention, there is provided an image forming apparatus comprising: an image carrier structured to carry an electrostatic latent image on its surface; a container which holds a liquid developer including charged toner dispersed in a carrier liquid; a liquid developer carrier which transports the liquid developer toward a predetermined developing position while carrying the liquid developer on its surface, brings the liquid developer into contact with the image carrier at the developing position, and accordingly supplies the liquid developer to the image carrier; image forming means which makes toner contained in the liquid developer supplied to the image carrier from the liquid developer carrier adhere to the image carrier, visualizes the electrostatic latent image and accordingly forms a toner image; and collecting means which collects the carrier liquid contained in the liquid developer supplied from the liquid developer carrier at the developing position and adhering to the image carrier, and returns the carrier liquid back into the container, wherein a returning amount of the carrier liquid returned by the collecting means back into the container is adjustable.

According to a fourth aspect of the present invention, there is provided an image forming apparatus, comprising: an image carrier structured to carry an electrostatic latent image on its surface; a liquid developer carrier which transports a liquid developer including charged toner dispersed in a carrier liquid toward a predetermined developing position while carrying the liquid developer on its surface, brings the liquid developer into contact with the image carrier at the developing position, and accordingly supplies the liquid developer to the image carrier; and image forming means which makes toner contained in the liquid developer supplied to the image carrier from the liquid developer carrier adhere to the image carrier, visualizes the electrostatic latent image and accordingly forms a toner image, wherein a consumption amount of the carrier liquid which is consumed for formation of the toner image is adjusted.

According to a fifth aspect of the present invention, there is provided an image forming apparatus, comprising: an image carrier structured to carry an electrostatic latent image on its surface; a liquid developer carrier which transports a liquid developer including charged toner dispersed in a carrier liquid toward a predetermined developing position while carrying the liquid developer on its surface, brings the liquid developer into contact with the image carrier at the developing position, and accordingly supplies the liquid developer to the image carrier; image forming means which makes toner contained in the liquid developer supplied to the image carrier from the liquid developer carrier adhere to the image carrier, visualizes the electrostatic latent image and accordingly forms a toner image; transfer means which transfers the toner image on the image carrier onto a transfer medium at a predetermined transfer position; and stripping means which strips off the carrier liquid from the liquid developer on the image carrier in a developed image carrying area which extends from the developing position to the transfer position, wherein a stripping amount of the carrier liquid which is stripped off by the stripping means is adjustable.

According to a sixth aspect of the present invention, there is provided an image forming apparatus in which developing means is positioned to a predetermined development-permitting position relative to a latent image carrier which moves in a predetermined travel direction while carrying an electrostatic latent image on its surface, a liquid developer including charged toner dispersed in a carrier liquid is accordingly supplied from the developing means to the latent image carrier, the electrostatic latent image is visualized and a toner image is formed, the apparatus comprising: an image carrier structured to carry N toner images (where N is an integer equal to or larger than 2) in a direction which corresponds to the travel direction; and transfer means which transfers the toner image on the latent image carrier onto the image carrier, wherein the developing means is structured to move between the development-permitting position and a clear-off position which is off the latent image carrier and at which therefore the liquid developer does not contact the latent image carrier, and when the image carrier is to carry (N−1) or fewer toner images, the developing means is positioned to the clear-off position so as to be responsive to a non-carrying area which does not carry a toner image.

According to a seventh aspect of the present invention, there is provided an image forming apparatus, comprising: a latent image carrier structured to carry an electrostatic latent image on its surface; a liquid developer carrier which transports a liquid developer including charged toner dispersed in a carrier liquid toward a predetermined developing position while carrying the liquid developer on its surface, brings the liquid developer into contact with the latent image carrier at the developing position, and accordingly supplies the liquid developer to the latent image carrier; image forming means which makes toner contained in the liquid developer supplied to the latent image carrier from the liquid developer carrier adhere to the latent image carrier, visualizes the electrostatic latent image and accordingly forms a toner image; an image carrier structured to carry on its surface the toner image formed on the latent image carrier; and transfer means which transfers the toner image on the latent image carrier onto the surface of the image carrier at a predetermined transfer position, wherein the liquid developer carrier is structured to move between a development-permitting position, at which the liquid developer on the liquid developer carrier is brought into contact with the latent image carrier at the developing position, and a clear-off position at which the liquid developer on the liquid developer carrier does not contact the latent image carrier, the image carrier is formed by a rotating member whose surface moves passed the transfer position when the rotating member rotates, and the circumference of the image carrier is capable of carrying N toner images (where N is an integer equal to or larger than 2) in the rotation direction, and at the time of transfer of (N−1) or fewer toner images by the transfer means onto the circumference of the image carrier, during a period which corresponds to a non-transfer area on the image carrier, the liquid developer carrier retracts to the clear-off position from the development-permitting position.

The above and further objects and novel features of the invention will more fully appear from the following detailed description when the same is read in connection with the accompanying drawings. It is to be expressly understood, however, that the drawings are for purpose of illustration only and are not intended as a definition of the limits of the invention.

DETAILED DESCRIPTION OF THE PREFERRED EMBODIMENTS

<First Preferred Embodiment>

Figure 1:
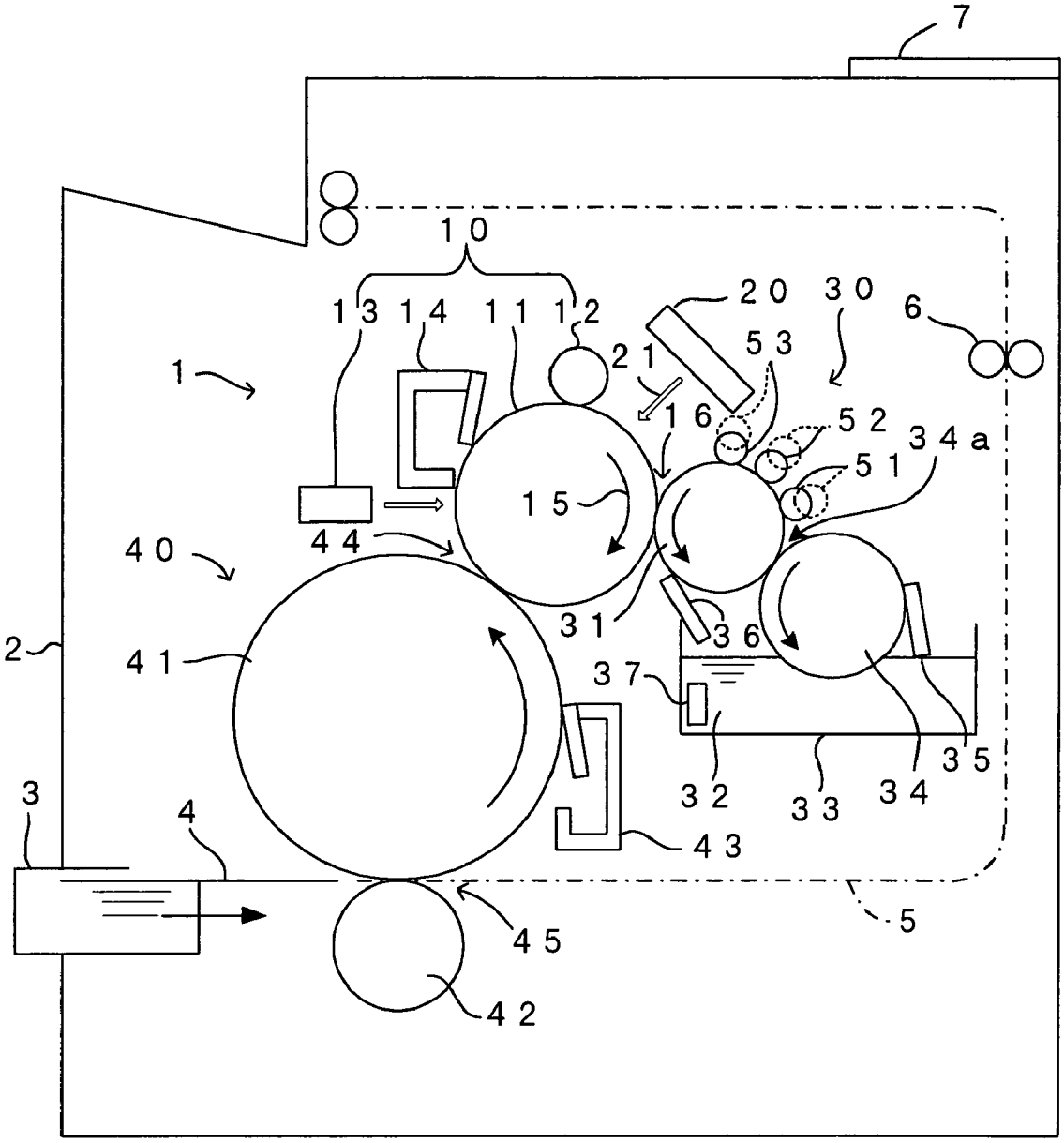
FIG. 1 is a drawing which shows an internal structure of a printer which is a first preferred embodiment of the present invention.
Figure 2:
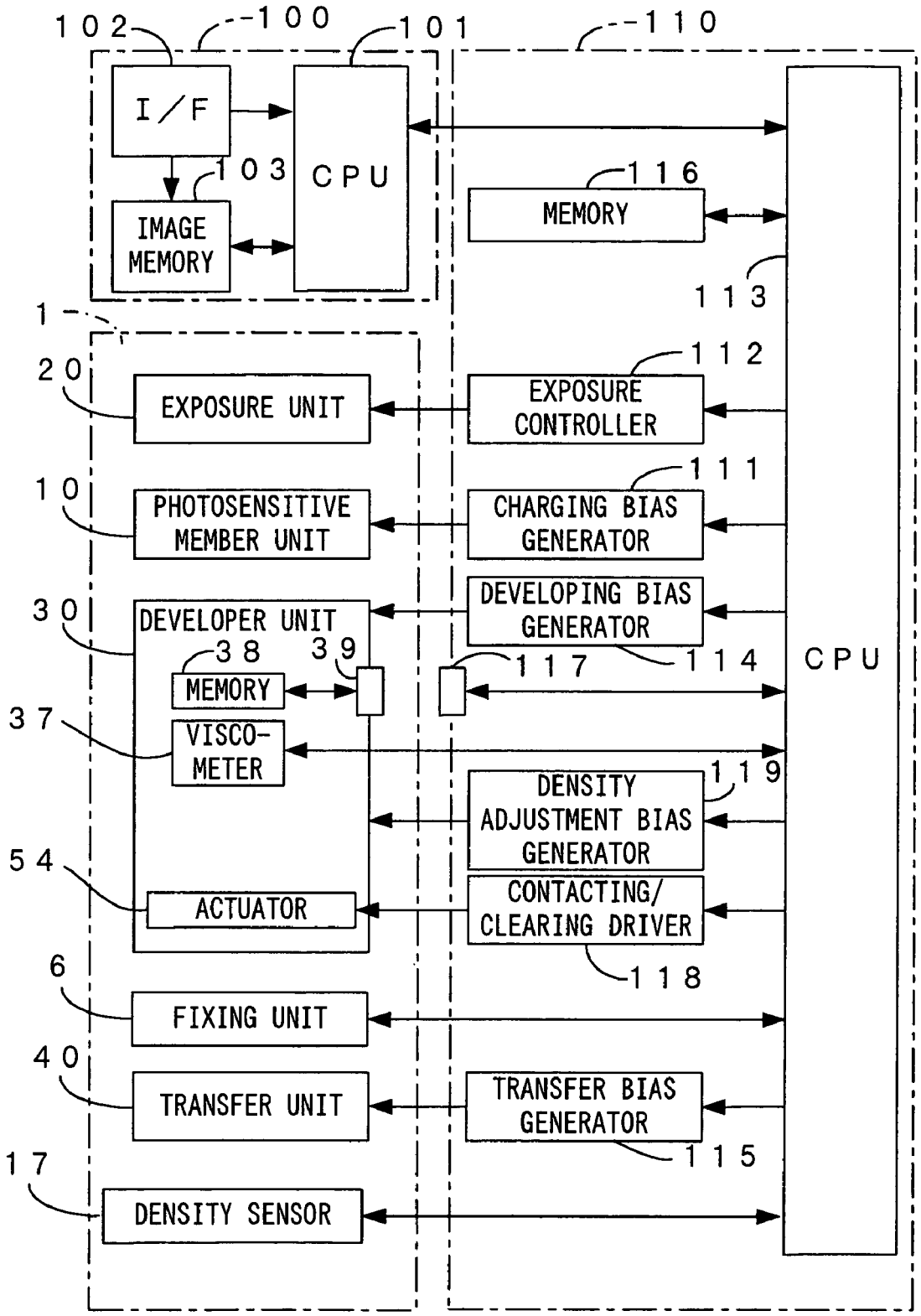
FIG. 2 is a block diagram which shows an electric structure of this printer.

FIG. 1 is a drawing which shows an internal structure of a printer which is a first preferred embodiment of an image forming apparatus according to the present invention, and FIG. 2 is a block diagram which shows an electric structure of this printer. This printer is an image forming apparatus using the liquid development process which forms a monochrome image using a liquid developer of black (K). As a print instruction signal containing an image signal is fed to a main controller 100 from an external apparatus such as a host computer, an engine controller 110 controls respective portions of an engine part 1 in accordance with a control signal received from the main controller 100, and images which correspond to the image signal mentioned above are printed on a transfer paper, a copy paper and other general paper (hereinafter referred to as a "transfer paper") 4 conveyed from a paper cassette 3 which is disposed in a lower portion of an apparatus body 2.

The engine part 1 mentioned above comprises a photosensitive member unit 10, an exposure unit 20, a developer unit 30, a transfer unit 40, etc. Of these units, the photosensitive member unit 10 comprises a photosensitive member 11, a charger 12, a static eliminator 13 and a cleaner 14. The developer unit 30 comprises a developer roller 31 and the like. Further, the transfer unit 40 comprises an intermediate transfer roller 41 and the like.

In the photosensitive member unit 10, the photosensitive member 11 is disposed for free rotations in the arrow direction 15 shown in FIG. 1 (i.e., in the clockwise direction in FIG. 1). Disposed around the photosensitive member 11 are the charger 12, the developer roller 31, the intermediate transfer roller 41, the static eliminator 13 and the cleaner 14 along the rotation direction 15 of the photosensitive member 11. A surface area between the charger 12 and the developer roller 31 serves as an irradiation area of a light beam 21 from the exposure unit 20. The charger 12 is formed by a charger roller in this embodiment. Applied with a charging bias from a charging bias generator 111, the charger 12 uniformly charges an outer circumferential surface of the photosensitive member 11 to a predetermined surface potential Vd (e.g., Vd=DC+600 V), thus functioning as charging means.

The exposure unit 20 emits the light beam 21, which is laser for instance, toward the outer circumferential surface of the photosensitive member 11 which is uniformly charged by the charger 12. The exposure unit 20 exposes the photosensitive member 11 with the light beam 21 in accordance with a control instruction which is fed from an exposure controller 112, so as to form an electrostatic latent image which corresponds to an image signal on the photosensitive member 11. For instance, when a print instruction signal containing an image signal is fed to a CPU 101 of the main controller 100 via an interface 102 from an external apparatus such as a host computer, in response to an instruction from the CPU 101 of the main controller 100, a CPU 113 outputs a control signal which corresponds to the image signal to the exposure controller 112 at predetermined timing. The exposure unit 20 then irradiates the light beam 21 upon the photosensitive member 11 in accordance with the control instruction received from the exposure controller 112, and an electrostatic latent image which corresponds to the image signal is formed on the photosensitive member 11. In this embodiment, the exposure unit 20 corresponds to "exposure means" of the present invention and the photosensitive member 11 corresponds to an "image carrier" of the present invention.

Thus formed electrostatic latent image is visualized with toner which is supplied by means of the developer roller 31 of the developer unit 30. The developer unit 30 comprises, in addition to the developer roller 31, a tank 33 which holds a liquid developer 32, a coating roller 34 which scoops up the liquid developer 32 stored in the tank 33 and supplies the liquid developer 32 to the developer roller 31, a restricting blade 35 which restricts the thickness of a layer of the liquid developer on the coating roller 34 into uniform thickness, and a cleaning blade 36 which removes the liquid developer which remains on the developer roller 31 after the toner has been supplied to the photosensitive member 11, a viscometer 37, and a memory 38 (FIG. 2) which will be described later. The developer roller 31 rotates approximately at the same circumferential speed as the photosensitive member 11 in a direction which follows the photosensitive member 11 (the anti-clockwise direction in FIG. 1). On the other hand, the coating roller 34 rotates approximately at double the circumferential speed in the same direction as the developer roller 31 (i.e., in the anti-clockwise direction in FIG. 1).

The liquid developer 32 is obtained by dispersing, within a carrier liquid, toner which is formed by a color pigment, an adhesive agent such as an epoxy resin which bonds the color pigment, an electric charge control agent which gives a predetermined charge to the toner, a dispersing agent which uniformly disperses the color pigment, etc. In this embodiment, silicon oil such as polydimethylsiloxane oil is used as the carrier liquid, and a toner density is 5 through 40 wt % which is a higher density than that of a low-density liquid developer which is often used in the liquid development process (and whose toner density is 1 through 2 wt %). The type of the carrier liquid is not limited to silicon oil, and the viscosity of the liquid developer 32 is determined by materials of the carrier liquid which are used and the toner, a toner density, etc. In this embodiment, the viscosity is 50 through 6000 mPa·s for example.

A gap between the photosensitive member 11 and the developer roller 31 (i.e., a development gap=the thickness of the liquid developer layer) is set to 5 through 40 $\mu$m for instance in this embodiment. A development nip distance (which is a distance along a circumferential direction over which the liquid developer layer contacts both the photosensitive member 11 and the developer roller 31) is set to 5 mm for instance in this embodiment. As compared with where the low-density liquid developer mentioned above is used and therefore a development gap of 100 through 200 $\mu$m is demanded so as to attain a toner amount, this embodiment which uses a high-density liquid developer allows to shorten the development gap. Since this in turn shortens a travel of toner which moves within the liquid developer because of electrophoresis and permits to develop a higher electric field even at the same developing bias, it is possible to improve the efficiency of development and develop at a high speed.

The viscometer 37 is disposed within the tank 33. The CPU 113 calculates a toner density based on the viscosity of the liquid developer 32 which is detected by the viscometer 37. The viscometer 37 may be replaced with a density sensor which is formed by a transmission-type optical sensor for example, to thereby detect the toner density in the liquid developer 32 which is within the tank 33.

The developer unit 30 further comprises squeegee rollers 51, 52 and 53 which are faced against the developer roller 31 between a coating position 34*a* and a developing position 16 which are on the developer roller 31. The squeegee rollers 51, 52 and 53 are supported in such a manner that the squeegee rollers 51, 52 and 53 can move in a direction closer to and away from the developer roller 31. In other words, when a contacting/clearing driver 118 (FIG. 2) drives an actuator 54 (FIG. 2) which is formed by a solenoid, a motor or the like for instance, the squeegee rollers reciprocally move between adjacent positions on the developer roller 31 (denoted at the solid lines in FIG. 1) and clear-off positions off the developer roller 31 (denoted at the broken lines in FIG. 1). The adjacent positions are such positions at which the squeegee rollers 51, 52 and 53 contact the liquid developer which is carried on the developer roller 31. The clear-off positions are such positions at which the squeegee rollers 51, 52 and 53 are off from the adjacent positions and remain not in contact with the liquid developer. The squeegee rollers 51, 52 and 53 rotate approximately at the same circumferential speed as the developer roller 31 in a direction which follows the developer roller 31 (the clockwise direction in FIG. 1). The squeegee rollers 51, 52 and 53 are for adjustment of the toner density in the liquid developer 32 which is carried on the developer roller 31. Operations of the squeegee rollers 51, 52 and 53 will be described in detail later.

In the developer unit 30 having such a structure, the coating roller 34 scoops up the liquid developer 32 stored in the tank 33 and the restricting blade 35 restricts the thickness of the liquid developer layer on the coating roller 34 into uniform thickness. The uniform liquid developer 32 adheres to a surface of the developer roller 31, and as the developer roller 31 rotates, the liquid developer 32 is transported to the developing position 16 which is faced with the photosensitive member 11.

Toner is charged positively for example, owing to a function of the electric charge control agent and the like. At the developing position 16 therefore, toner moves toward the photosensitive member 11 from the developer roller 31 because of a developing bias Vb (e.g., Vb=DC+400 V) which is applied upon the developer roller 31 by a developing bias generator 114, and an electrostatic latent image is accordingly visualized. In this embodiment, the developer roller 31 thus corresponds to a "liquid developer carrier" of the present invention, the coating position 34*a* thus corresponds to a "carrying start position" of the present invention, the tank 33 thus corresponds to a "container" of the present invention, the developer unit 30 thus corresponds to "liquid development means" of the present invention, and the viscometer 37 thus corresponds to "toner density detecting means" of the present invention.

Atoner image which is formed on the photosensitive member 11 in this fashion is transported to a primary transfer position 44 which faces the intermediate transfer roller 41, as the photosensitive member 11 rotates. The intermediate transfer roller 41 rotates approximately at the same circumferential speed as the photosensitive member 11 in a direction which follows the photosensitive member 11 (the anticlockwise direction in FIG. 1). When a transfer bias generator 115 applies a primary transfer bias (which may be DC−400 V for instance), the toner image on the photosensitive member 11 is primarily transferred onto the intermediate transfer roller 41. The static eliminator 13 formed by an LED or the like removes an electric charge remaining on the photosensitive member 11 after the primary transfer, and the cleaner 14 removes the liquid developer which remains.

A secondary transfer roller 42 is disposed to face with an appropriate portion of the intermediate transfer roller 41 (right below the intermediate transfer roller 41 in FIG. 1). The primarily transferred toner image which has been primarily transferred onto the intermediate transfer roller 41 is transported to a secondary transfer position 45 facing the secondary transfer roller 42, as the intermediate transfer roller 41 rotates. Meanwhile, the transfer paper 4 housed in the paper cassette 3 is transported to the secondary transfer position 45 by a transportation driver (not shown), in synchronization to the transportation of the primarily transferred toner image. The secondary transfer roller 42 rotates approximately at the same circumferential speed as the intermediate transfer roller 41 in a direction which follows the intermediate transfer roller 41 (the clockwise direction in FIG. 1). As the transfer bias generator 115 applies a secondary transfer bias (which may be −100 $\mu$A for example under constant current control) upon the secondary transfer roller 42, the toner image on the intermediate transfer roller 41 is secondarily transferred onto the transfer paper 4. A cleaner 43 removes the liquid developer which remains on the intermediate transfer roller 41 after the secondary transfer. The transfer paper 4 to which the toner image has been secondarily transferred in this manner is transported along a predetermined transfer paper transportation path 5 (denoted at the dashed line in FIG. 1), subjected to fixing of the toner image by a fixing unit 6, and discharged into a discharge tray which is disposed in an upper portion of the apparatus body 2. An operation display panel 7 comprising a liquid crystal display and a touch panel is disposed in a top surface of the apparatus body 2. The operation display panel 7 accepts an operation instruction from a user, and shows predetermined information to inform the user of the information. In this embodiment, the intermediate transfer roller 41, the secondary transfer roller 42 and the transfer bias generator 115 thus correspond to "transfer means" of the present invention, and the transfer paper 4 corresponds to a "transfer medium" of the present invention.

In FIG. 2, the main controller 100 comprises an image memory 103 which stores an image signal fed from an external apparatus via the interface 102. The CPU 101, when receiving via the interface 102 a print instruction signal which contains an image signal from an external apparatus, converts the signal into job data which are in an appropriate format to instruct the engine part 1 to operate, and sends the data to the engine controller 110.

A memory 116 of the engine controller 110 is formed by a ROM which stores a control program for the CPU 113 containing preset fixed data, a RAM which temporarily stores control data for the engine part 1, the result of a calculation performed by the CPU 113 and the like, etc. The CPU 113 stores within the memory 116 data regarding an image signal fed from an external apparatus via the CPU 101.

A memory 38 of the developer unit 30 is for storing data regarding a production lot of the developer unit 30, a history of use, characteristics of toner inside, a remaining amount of the liquid developer 32, a toner density, etc. The memory 38 is electrically connected with a communications part 39 which is attached to the tank 33 for example. The communications part 39 has such a structure that the communications part 39 comes faced with a communications part 17 of the engine controller 110 over a predetermined distance, which may be 10 mm for instance, or a shorter distance when the developer unit 30 is mounted to the apparatus body 2 and, is capable of sending data to and receiving data from the communications part 17 by a wireless communication such as one which uses an infrared ray while remaining not in contact with the communications part 17. The CPU 113 thus manages various types of information such as management of consumables related to the developer unit 30.

This embodiment requires to electromagnetic means such as a wireless communication for the purpose of attaining non-contact data transmission. An alternative however is to dispose one connector to each of the apparatus body 2 and the developer unit 30 and to mechanically engage the two connectors with each other by mounting the developer unit 30 to the apparatus body 2, whereby data transmission is realized between the apparatus body 2 and the developer unit 30. In addition, it is desirable that the memory 38 is a non-volatile memory which can save data even when a power source is off or the developer unit 30 is off the apparatus body 2. An EEPROM, such as a flash memory, a ferroelectric memory, or the like may be used as such a non-volatile memory.

Figure 3:
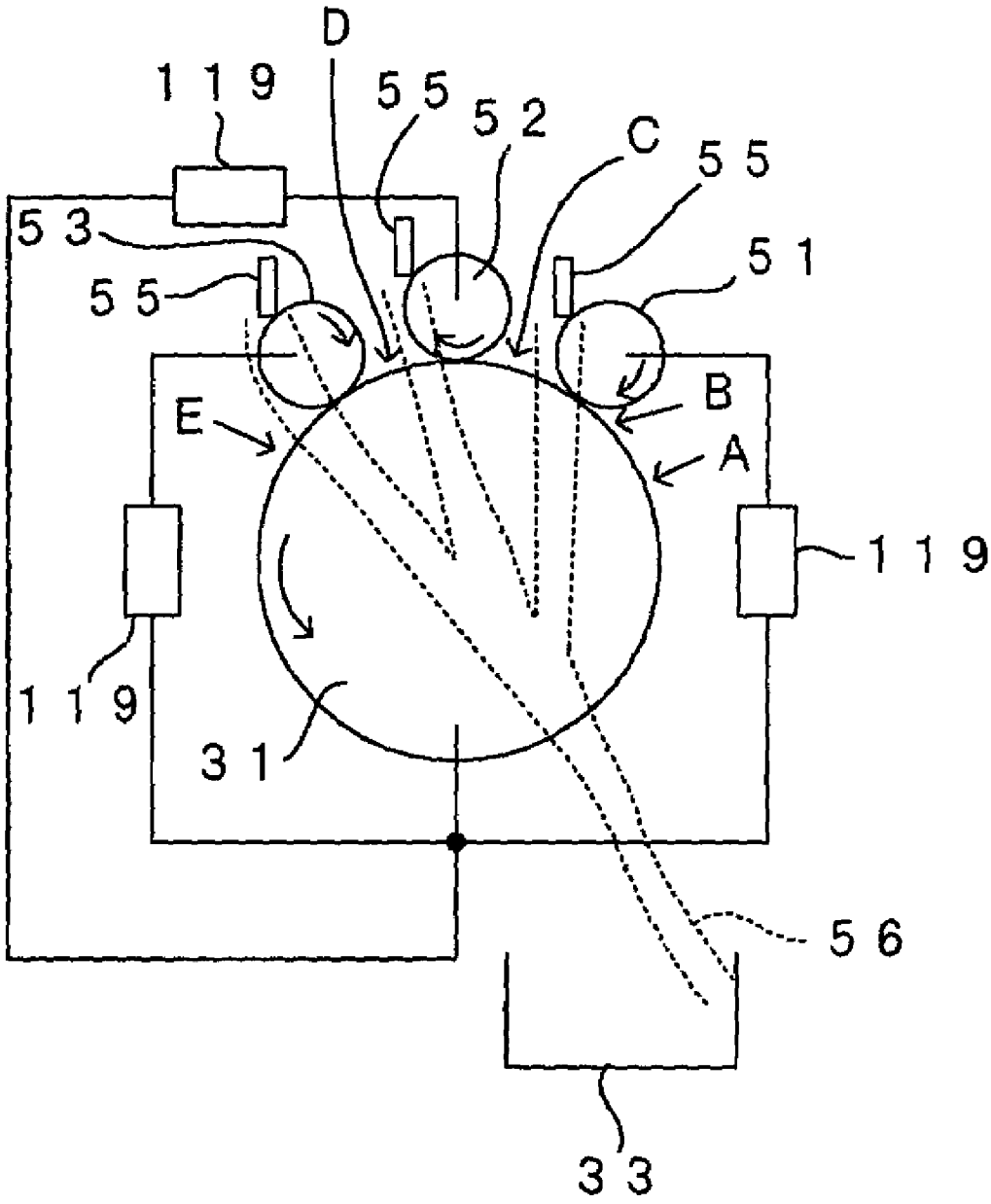
FIG. 3 is a drawing which schematically shows structures of squeegee rollers and a developer roller.
Figure 4:
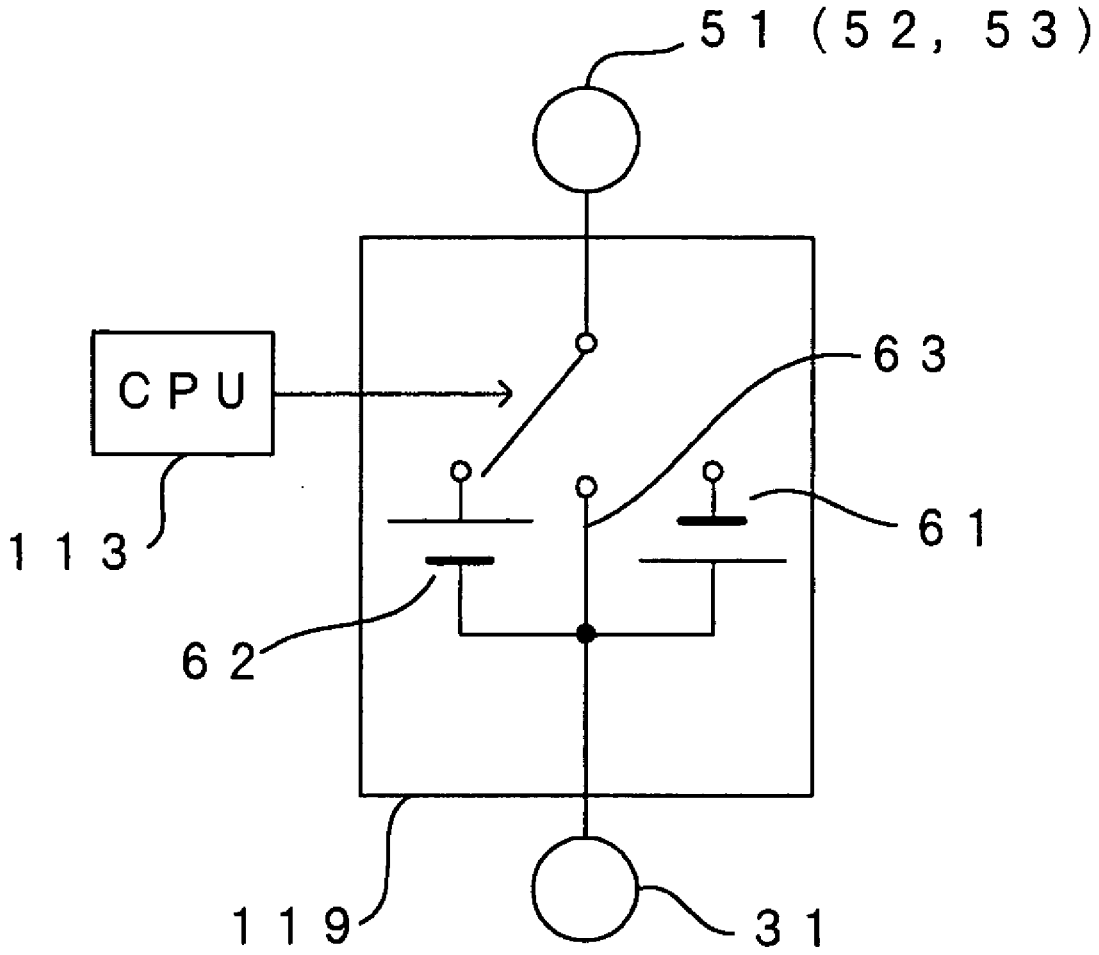
FIG. 4 is a circuitry diagram of a density adjustment bias generator.

FIG. 3 is a drawing which schematically shows structures of the squeegee rollers and the developer roller, while FIG. 4 is a circuitry diagram of a density adjustment bias generator. As shown in FIG. 3, density adjustment bias generators 119 are connected between the developer roller 31 and the squeegee rollers 51, 52 and 53. The density adjustment bias generators 119, as shown in FIG. 4, comprise positive bias power source parts 61, negative bias power source parts 62, short-circuit line parts 63, and switches 64 which switch the connections of the respective parts 61 through 63 in response to a control signal received from the CPU 113.

As herein referred to, a positive bias means a bias which solicits movement of positively charged toner from a lower roller (the developer roller 31 in the illustrated structure) toward an upper roller (the squeegee rollers 51, 52 and 53 in the illustrated structure) which are connected with the density adjustment bias generators 119 in FIG. 4. On the contrary, a negative bias means a bias which solicits movement of positively charged toner from the upper roller toward the lower roller. A toner density adjustment function realized by the squeegee rollers 51, 52 and 53 will now be described with reference to FIGS. 5 and 6A through 8D.

Figure 5:
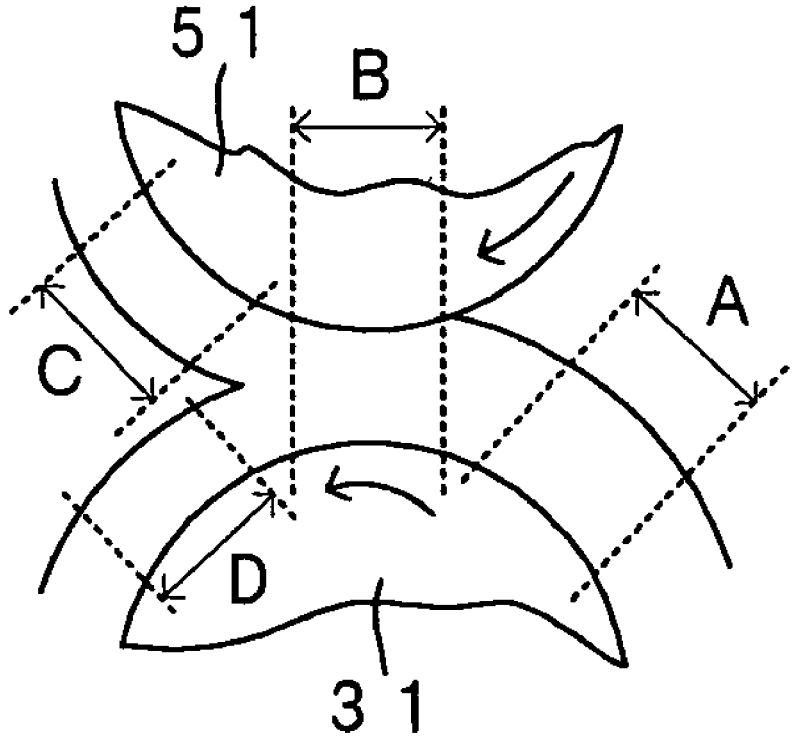
FIG. 5 is a drawing for describing movement of a liquid developer between two rollers.
Figure 6A:
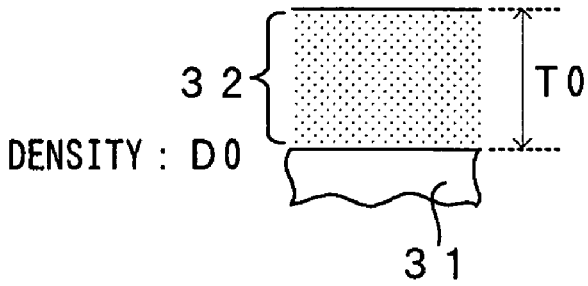
FIGS. 6A through 6D are drawings which show a liquid developer layer as it is in each area in FIG. 5, owing to a positive bias power source part.
Figure 6B:
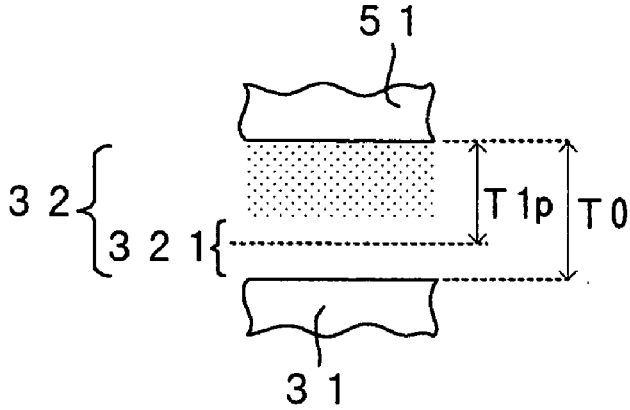
Figure 6C:
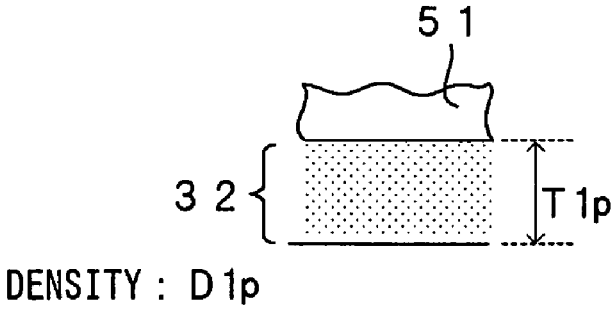
Figure 6D:
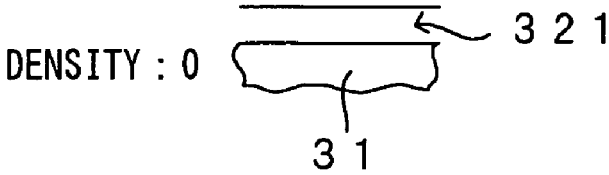
Figure 7A:
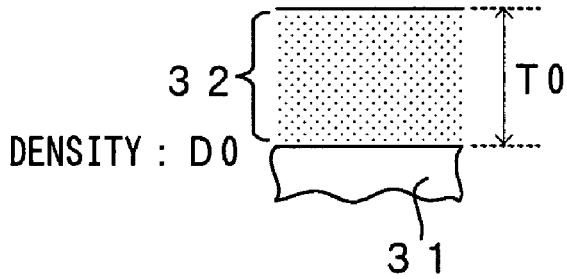
FIGS. 7A through 7D are drawings which show a liquid developer layer as it is in each area in FIG. 5, owing to a negative bias power source part.
Figure 7B:
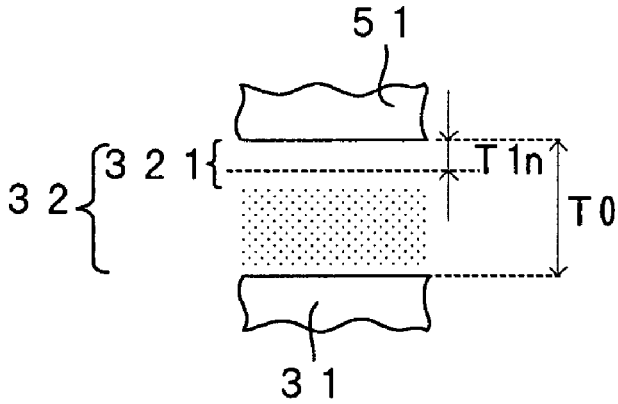
Figure 7C:
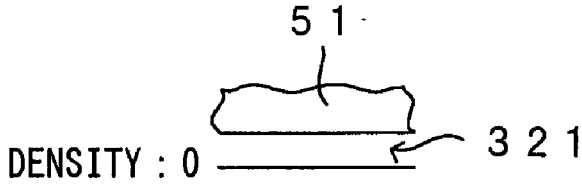
Figure 7D:
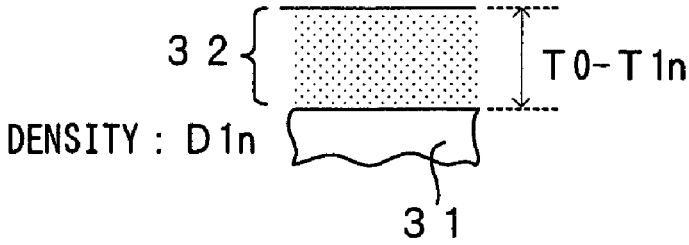
Figure 8A:
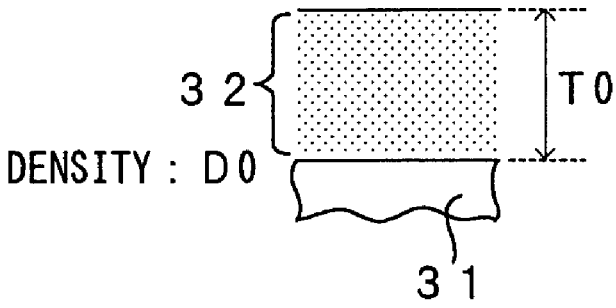
FIGS. 8A through 8D are drawings which show a liquid developer layer as it is in each area in FIG. 5, owing to a short-circuit line part.

FIG. 5 is a drawing for describing movement of a liquid developer between two rollers (which are the squeegee roller 51 and the developer roller 31 in the illustrated structure). FIGS. 6A through 6D are drawings which show a liquid developer layer as it is in each area in FIG. 5, with the positive bias power source parts 61 connected by means of the switches 64. FIGS. 7A through 7D are drawings which show a liquid developer layer as it is in each area in FIG. 5, with the negative bias power source parts 62 connected by means of the switches 64. FIGS. 8A through 8D are drawings which show a liquid developer layer as it is in each area in FIG. 5, with the short-circuit line parts 63 connected by means of the switches 64. FIGS. 6A, 7A and 8A each correspond to an area A in FIG. 5, FIGS. 6B, 7B and 8B each correspond to an area B in FIG. 5, FIGS. 6C, 7C and 8C each correspond to an area C in FIG. 5, and FIGS. 6D, 7D and 8D each correspond to an area D in FIG. 5.

In FIG. 5, the liquid developer layer within the area A is in a state that the coating roller 34 has supplied the liquid developer 32 upon the developer roller 31. In other words, there is the liquid developer 32 whose thickness is T0 and toner density is D0 for instance within the area A as shown in FIGS. 6A, 7A and 8A. The liquid developer layer within the area B is in a state that the liquid developer on the developer roller 31 is in contact with the squeegee roller 51 and accordingly nipped between the rollers 31 and 51. The liquid developer layer nipped between the rollers 31 and 51 within the area B gets separated as the rollers 31 and 51 rotate, whereby the liquid developer layer within the area C on the roller 51 side and the liquid developer layer within the area D on the roller 31 side are created.

A situation that the positive bias power source part 61 of the density adjustment bias generator 119 is connected will now be described with reference to FIGS. 5 and 6A through 6D. The area B receives a bias voltage which makes positively charged toner move from the developer roller 31 toward the squeegee roller 51. Hence, as shown in FIG. 6B, the toner density in a portion contacting the squeegee roller 51 is the highest, the toner density gradually decreases with a distance away from the squeegee roller 51, and a carrier liquid layer 321 which does not contain toner is created in a portion which is in contact with the developer roller 31.

It is believed that since the carrier liquid layer 321 which does not contain toner has the lowest viscosity, the liquid developer 32 gets separated in such a carrier liquid layer 321. Assuming that the separation has occurred at a position denoted at the broken line in FIG. 6B, the thickness of the liquid developer 32 is T1*p* and the toner density in the liquid developer 32 is D1*p*=D0·T0/T1*p* and hence D1*p*>D0 holds truth within the area C as shown in FIG. 6C, and therefore, the high-density liquid developer 32 moves toward the squeegee roller 51. Meanwhile, the carrier liquid layer 321 within the area D has thickness of (T0−T1*p*) and toner density of zero as shown in FIG. 6D, and therefore, the toner density in the liquid developer 32 carried on the developer roller 31 is zero.

A situation that the negative bias power source part 62 of the density adjustment bias generator 119 is connected will now be described with reference to FIGS. 5 and 7A through 7D. The area B receives a bias voltage which makes positively charged toner move from the squeegee roller 51 toward the developer roller 31, which is opposite to where the positive bias power source part 61 is connected. Hence, as shown in FIG. 7B, the toner density in a portion contacting the developer roller 31 is the highest, the toner density gradually decreases with a distance away from the developer roller 31, and the carrier liquid layer 321 which does not contain toner is created in a portion contacting the squeegee roller 51. As described above, it is considered that the liquid developer 32 gets separated in the carrier liquid layer 321 whose viscosity is the lowest. Assuming that the separation has occurred at a position denoted at the broken line in FIG. 7B therefore, the liquid developer 32 whose thickness is T1 and toner density is zero moves toward the squeegee roller 51 within the area C as shown in FIG. 7C. Meanwhile, within the area D, as shown in FIG. 7D, the thickness of the liquid developer 32 is (T0−T1*n*) and the toner density in the liquid developer 32 is D1*n*=D0·T0/(T0−T1*n*) and hence D1*n*>D0 holds truth, whereby the liquid developer 32 whose toner density is higher than the density at the time of coating is carried by the developer roller 31.

Figure 8B:
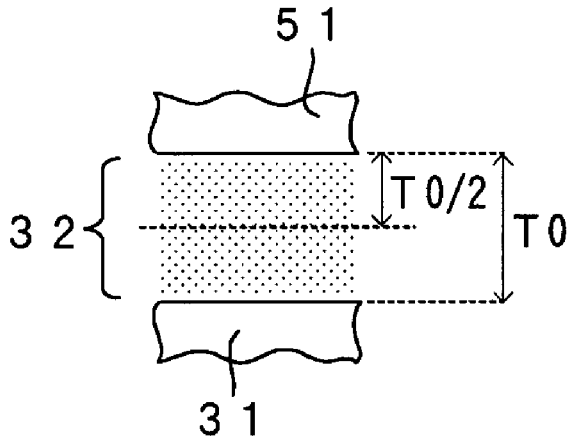
Figure 8C:
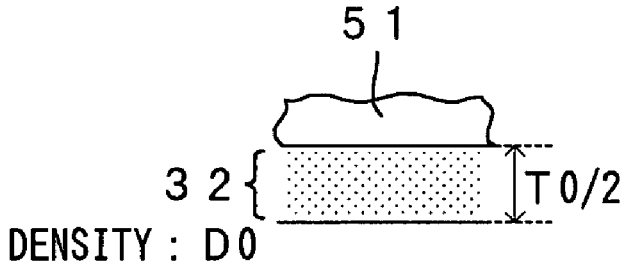
Figure 8D:
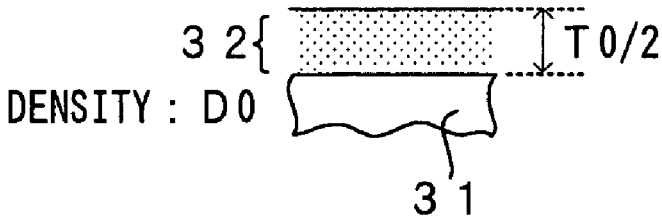

A situation that the short-circuit line part 63 of the density adjustment bias generator 119 is connected will now be described with reference to FIGS. 5 and 8A through 8D. In this case, the developer roller 31 and the squeegee roller 51 are held at the same bias. Hence, within the area B, as shown in FIG. 8B, positively charged toner does not move and a state of the liquid developer 32 continues as it is supplied by the coating roller 34. Since this realizes an approximately uniform viscosity distribution, it is believed that separation occurs approximately at the center of the liquid developer 32. Within the area C, due to this, the squeegee roller 51 seats a layer of the liquid developer 32 whose toner density remains D0 which is the same as the original density but whose thickness has reduced to T0/2 which is half the original thickness, as shown in FIG. 8C. Meanwhile, within the area D, the developer roller 31 seats a layer of the liquid developer 32 whose toner density remains D0 which is the same as the original density but whose thickness has reduced to T0/2 which is half the original thickness, as shown in FIG. 8D.

In this manner, after nipped between two rollers temporarily, the liquid developer gets separated and a portion of the liquid developer moves to the squeegee roller 51 from the developer roller 31. In other words, the squeegee roller 51 strips off a portion of the liquid developer which is carried by the developer roller 31. As the density adjustment bias generator 119 controls the amount of toner which is contained in thus stripped portion of the liquid developer, the toner density in the liquid developer 32 which is carried on the developer roller 31 is adjusted.

While the foregoing has described the squeegee roller 51 with reference to FIGS. 5 and 6A through 8D, exactly the same description applies to the squeegee rollers 52 and 53. For instance, when the negative bias power source parts 62 of all density adjustment bias generators 119 which are connected with the squeegee rollers 51, 52 and 53 get connected, a layer of the liquid developer 32 carried on the developer roller 31 becomes as shown in FIGS. 9A, 9B, 9C, 9D and 9E respectively within areas A, B, C, D and E shown in FIG. 3.

Figure 9A:
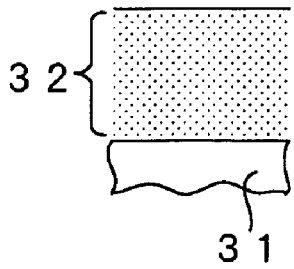
FIGS. 9A through 9E are drawings which show a change of a liquid developer layer on a developer roller owing to a density adjustment function.
Figure 9B:
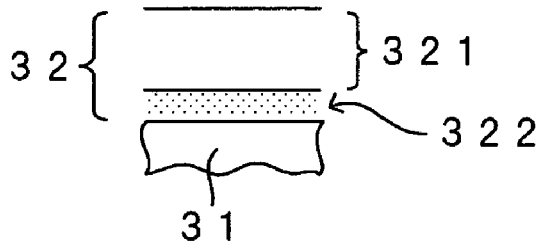

FIGS. 9A through 9E are drawings which show a change of a liquid developer layer on the developer roller 31 owing to the density adjustment function realized by the squeegee rollers 51, 52 and 53. A state within the area A in FIG. 3 is that the coating roller 34 has supplied the liquid developer 32 to the developer roller 31, and as shown in FIG. 9A, toner is dispersed within the carrier liquid. Next, the area B is applied with a bias voltage which makes positively charged toner move from the squeegee roller 51 toward the developer roller 31, and as shown in FIG. 9B, a toner layer 322 is formed on the developer roller 31 side and the carrier liquid layer 321 is formed in a surface layer portion.

Figure 9C:
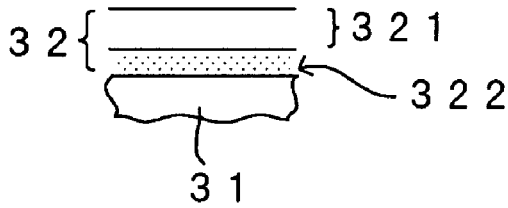
Figure 9D:
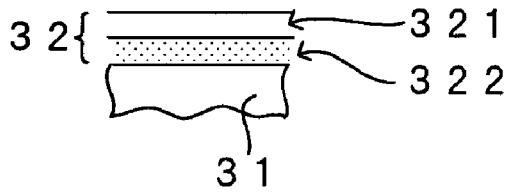
Figure 9E:
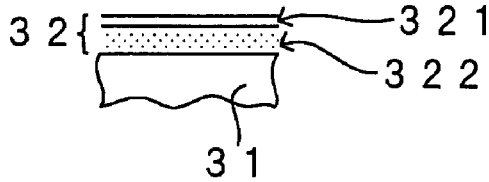

Since it is considered that separation occurs approximately at the center of the carrier liquid layer 321 when the squeegee roller 51 takes away a portion of the carrier liquid layer 321, within the area C in FIG. 3, as shown in FIG. 9C, the thickness of the carrier liquid layer 321 is about the half of the thickness shown in FIG. 9B. Next, owing to application of a negative bias, the squeegee roller 52 further takes away a portion of the carrier liquid layer 321 in a similar manner. Hence, within the area D in FIG. 3, as shown in FIG. 9D, the thickness of the carrier liquid layer 321 is about the half of the thickness shown in FIG. 9C. Next, owing to application of a negative bias, the squeegee roller 53 still further takes away a portion of the carrier liquid layer 321 in a similar manner. Hence, within the area E in FIG. 3, as shown in FIG. 9E, the thickness of the carrier liquid layer 321 is about the half of the thickness shown in FIG. 9D.

The squeegee rollers 51, 52 and 53 thus each take away a portion of the carrier liquid layer 321 which is in the surface layer portion. Therefore, the liquid developer 32 carried on the developer roller 31, for every movement passed the squeegee rollers 51, 52 and 53, has a progressively higher toner density. As the positions of the squeegee rollers 51 through 53 are thus controlled or the polarity of the applied bias voltage is thus controlled, the amount of the carrier liquid which is stripped off for example is controlled and the toner density in the liquid developer 32 which is on the developer roller 31 is consequently changed. Hence, it is possible to adjust the toner density in the liquid developer 32 on the developer roller 31 which is transported to the developing position 16 by controlling the positions of the squeegee rollers 51 through 53 or the polarity of the applied bias voltage. In the first preferred embodiment, the squeegee rollers 51 through 53 thus correspond to a "stripping member" of the present invention and the density adjustment bias generators 119 thus correspond to "voltage applying means" of the present invention.

The liquid developer taken away from the developer roller 31 by the squeegee rollers 51, 52 and 53 is removed from the squeegee rollers 51, 52 and 53 by cleaning blades 55 respectively as shown in FIG. 3. The removed liquid developer returns to the tank 33 through a collection pipe 56 (denoted at the broken lines in FIG. 3). In this embodiment, the removed liquid developer mentioned above returns to the tank 33 by its own weight. Alternatively, a pump may be disposed in the collection pipe 56 and driven to force the removed liquid developer back into the tank 33.

The fact that it is possible to adjust the toner density in the liquid developer 32 on the developer roller 31 by controlling the positions of the squeegee rollers 51 through 53 or the polarity of the applied bias voltage means that it is possible to adjust the toner density in the liquid developer which moves onto the squeegee rollers 51 through 53. Since the liquid developer on the squeegee rollers 51 through 53 is returned back to the tank 33, by adjusting the toner density in the liquid developer 32 on the developer roller 31, the toner density inside the tank 33 can be controlled as described below with reference to FIG. 10.

Figure 10:
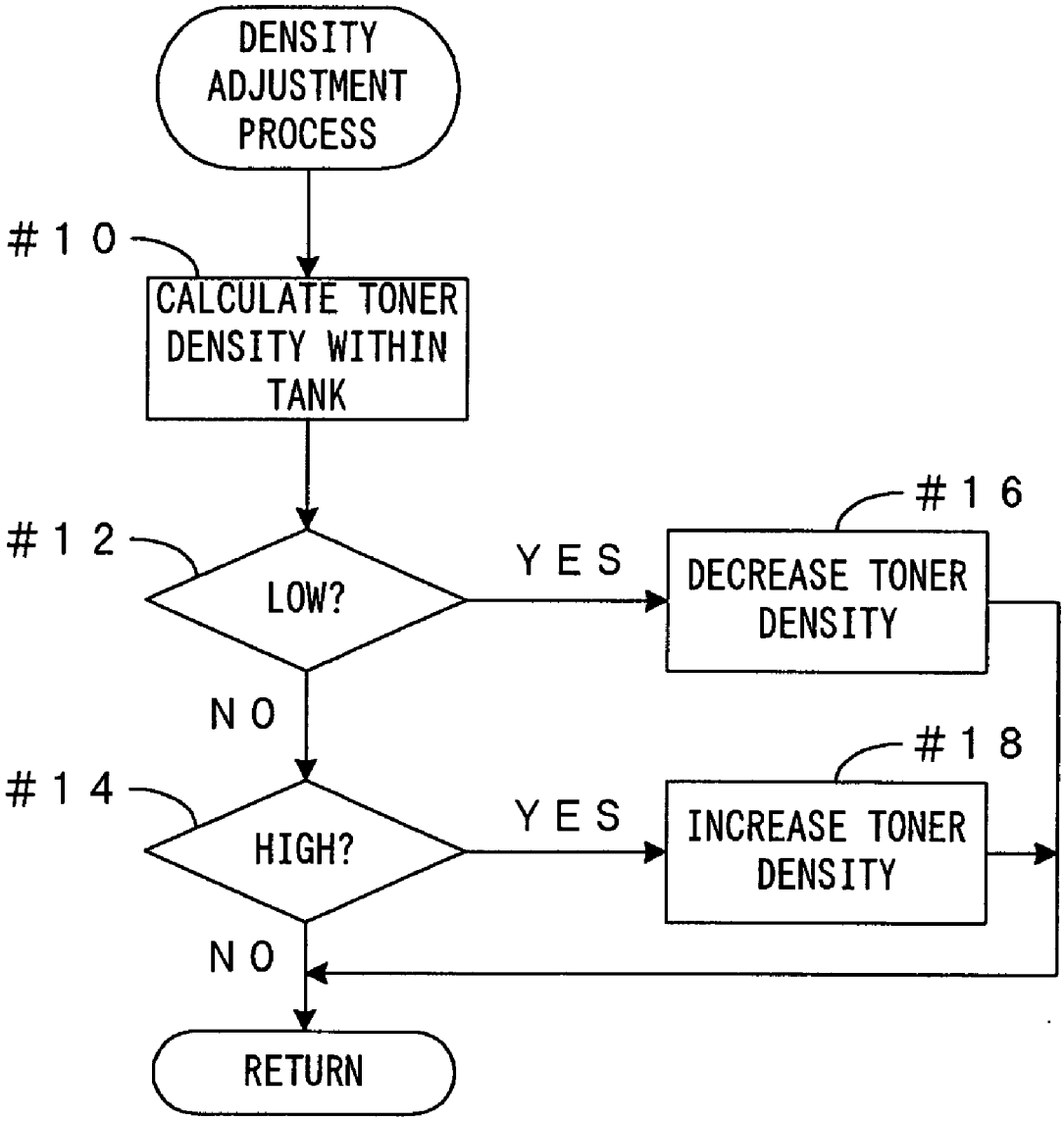
FIG. 10 is a flow chart which shows an example of a density adjustment process routine.

FIG. 10 is a flow chart which shows an example of a density adjustment process routine. A density adjustment process program is stored in advance within the memory 116 of the engine controller 110. As the CPU 113 controls the respective portions of the apparatus in accordance with the program, the following density adjustment process is performed.

First, the toner density in the liquid developer 32 which is inside the tank 33 is calculated based on a detection signal from the viscometer 37 (#10). Whether the calculated toner density is lower than an initial value is determined (#12). When the toner density is not lower (NO at #12), whether the toner density is higher than the initial value is determined (#14).

A relationship between the viscosity of the liquid developer 32 detected by the viscometer 37 and the toner density in the liquid developer 32 is identified in advance as an arithmetic expression or table data. The program stored in the memory 116 contains this relationship and the initial value of the toner density in the liquid developer 32. The process of calculating the toner density at #10 based on the relationship mentioned above is executed and thus calculated toner density is compared with the initial value, whereby the judgments at #12 and #14 are made.

When the calculated toner density is lower than the initial value (YES at #12), the toner density on the developer roller 31 is reduced (#16). In short, the squeegee rollers 51 through 53 are moved to the adjacent positions and the positive bias power source parts 61 of the density adjustment bias generators 119 are connected. This makes toner move to the squeegee rollers 51 through 53, the cleaning blades 55 remove thus moved toner and the toner accordingly returns back to the tank 33 via the collection pipe 56, whereby the toner density within the tank 33 increases.

On the contrary, when the calculated toner density is higher than the initial value (YES at #14), the toner density is increased (#18). That is, the squeegee rollers 51 through 53 are moved to the adjacent positions and the negative bias power source parts 62 of the density adjustment bias generators 119 are connected. This makes the carrier liquid move to the squeegee rollers 51 through 53, the cleaning blades 55 remove thus moved carrier liquid and the carrier liquid accordingly returns back to the tank 33 via the collection pipe 56, whereby the toner density within the tank 33 decreases.

As described above, during the operations shown in FIG. 10, the toner density within the tank 33 is detected, the toner density in the liquid developer carried on the developer roller 31 is adjusted based on the detected value, and the liquid developer collected from the squeegee rollers 51 through 53 is returned back to the tank 33. Hence, it is possible to maintain the toner density within the tank 33 at an initial value. This permits to use the liquid developer 32 held in the tank 33 to the very end without wasting, and minimizes the amount of a carrier liquid, toner or the like replenished from outside.

Alternatively, an initial viscosity value of the liquid developer 32 which corresponds to an initial toner density value of the liquid developer 32 may be calculated and stored in the memory 116 in advance based on the relationship between the viscosity of the liquid developer 32 detected by the viscometer 37 and the toner density in the liquid developer 32, and the detected viscosity may be compared directly with a corresponding initial value, to thereby make the judgments at #12 and #14 shown in FIG. 10.

Figure 11:
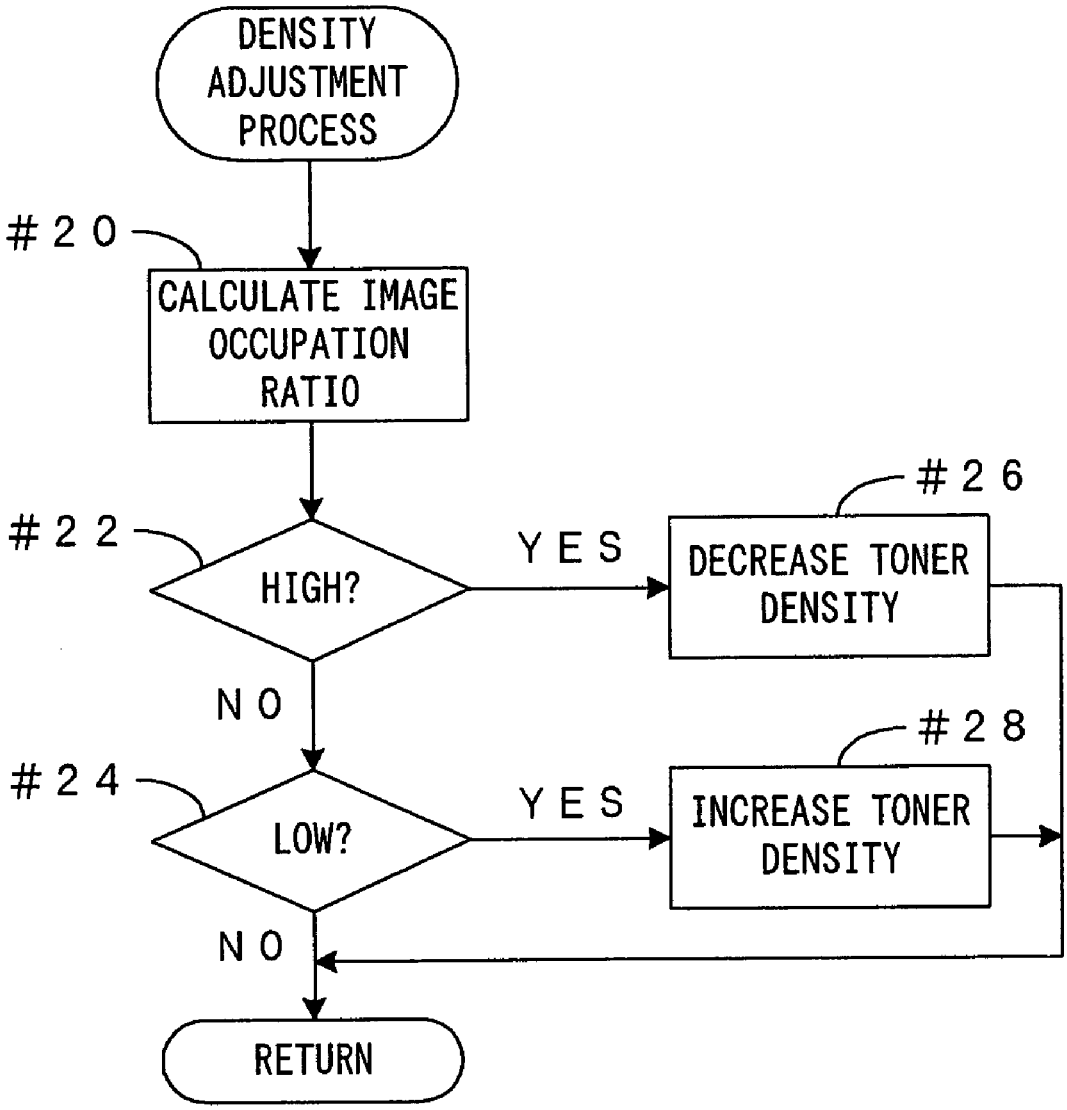
FIG. 11 is a flow chart which shows other example of the density adjustment process routine.

Alternatively, the toner density may be adjusted in accordance with an image occupation ratio as shown in FIG. 11. FIG. 11 is a flow chart which shows other example of the density adjustment process routine. First, an image occupation ratio is calculated which is a ratio of an image portion to an electrostatic latent image (#20). For instance, the main controller 100 comprises a dot counter which counts an on-dot count which represents the number of pixels to which toner adheres among pixels which form an electrostatic latent image. A ratio of the on-dot count to a dot count of the entire image is calculated as the image occupation ratio mentioned above. The image occupation ratio is 100% when the image is a solid black image but is 0% when the image is a solid white image portion (a blank portion within the image), for example.

Whether thus calculated image occupation ratio is high is determined (#22). When the image occupation ratio is not high (NO at #22), whether the image occupation ratio is low is determined (#24). An upper limit value and a lower limit value of the image occupation ratio are determined in advance. The judgment at #22 is made by comparing the calculated image occupation ratio with the upper limit value. The judgment at #24 is made by comparing the calculated image occupation ratio with the lower limit value.

When the calculated image occupation ratio is higher than the upper limit value (YES at #22), the toner density on the developer roller 31 is reduced (#26). In short, the amount of the carrier liquid stripped off by the squeegee rollers 51 through 53 is reduced. As a result, the toner density in the liquid developer carried on the developer roller 31 is adjusted to a value which corresponds to the high image occupation ratio. Further, when the image occupation ratio is high, toner contained in the liquid developer is consumed in a greater amount, and therefore, the toner density within the tank 33 decreases. However, since the amount of the carrier liquid returned back to the tank 33 from the squeegee rollers 51 through 53 decreases, the density drop is suppressed. Alternatively at the step #26, the squeegee rollers 51 through 53 may be positioned to the clear-off positions, to thereby maintain the toner density on the developer roller 31 as it is.

On the contrary, when the calculated image occupation ratio is lower than the lower limit value (YES at #24), the toner density on the developer roller 31 is increased (#28). That is, the amount of the carrier liquid stripped off by the squeegee rollers 51 through 53 is increased. As a result, the toner density in the liquid developer carried on the developer roller 31 is adjusted to a value which corresponds to the low image occupation ratio. Further, when the calculated image occupation ratio is low, the amount of toner contained in the liquid developer which is consumed during development is small, and the toner density within the tank 33 increases. However, since the amount of the carrier liquid returned back to the tank 33 from the squeegee rollers 51 through 53 increases, the density hike is suppressed.

As the toner density on the developer roller 31 is adjusted in accordance with an image occupation ratio as described above, the toner density in the liquid developer which has moved to the photosensitive member 11 remains approximately constant. For example, when an image occupation ratio is low, the amount of toner which moves to the photosensitive member 11 from the developer roller 31 becomes small. Still, since the amount of the carrier liquid on the developer roller 31 decreases, the amount of the carrier liquid which moves to the photosensitive member 11 from the developer roller 31, too, decreases. On the contrary, when an image occupation ratio is high, the amount of toner and the amount of the carrier liquid which move to the photosensitive member 11 from the developer roller 31 become large. Hence, it is possible to ensure that toner density in the liquid developer which moves to the photosensitive member 11 stays approximately the same regardless of an image occupation ratio.

As described above, during the operations shown in FIG. 11, the toner density in the liquid developer carried on the developer roller 31 is adjusted based on an image occupation ratio, and the liquid developer collected from the squeegee rollers 51 through 53 is returned back to the tank 33. Hence, it is possible to suppress a change of the toner density in the tank 33 and maintain the toner density at a constant value. This permits to use the liquid developer 32 held in the tank 33 to the very end without wasting, and minimizes the amount of a carrier liquid, toner or the like replenished from outside. Further, the toner density detecting means, such as the viscometer 37, of the tank 33 is not necessary unlike in the example shown in FIG. 10, the structure of the apparatus is simplified.

During the operations shown in FIG. 11, since the carrier liquid alone is consumed in a portion where the image occupation ratio is zero, it is difficult to maintain the toner density in the tank 33 constant. However, as an image occupation ratio per a certain range, e.g., an image occupation ratio per page is calculated, the toner density is maintained constant as an average value of the liquid developer which moves to the photosensitive member 11 without collected from the squeegee rollers 51 through 53. It is therefore possible to maintain the toner density in the tank 33 as constant as possible. In addition, since toner density in the liquid developer which moves to the photosensitive member 11 is constant, it is possible to execute primary transfer always in an excellent manner under the same transfer condition at the primary transfer position 44 regardless of whether an image occupation ratio is high or low. Further, when the liquid developer which remains on the developer roller 31 without moving to the photosensitive member 11 at the developing position 16 is returned back to the tank 33, the toner density in the tank 33 is maintained constant even more accurately.

Figure 12:
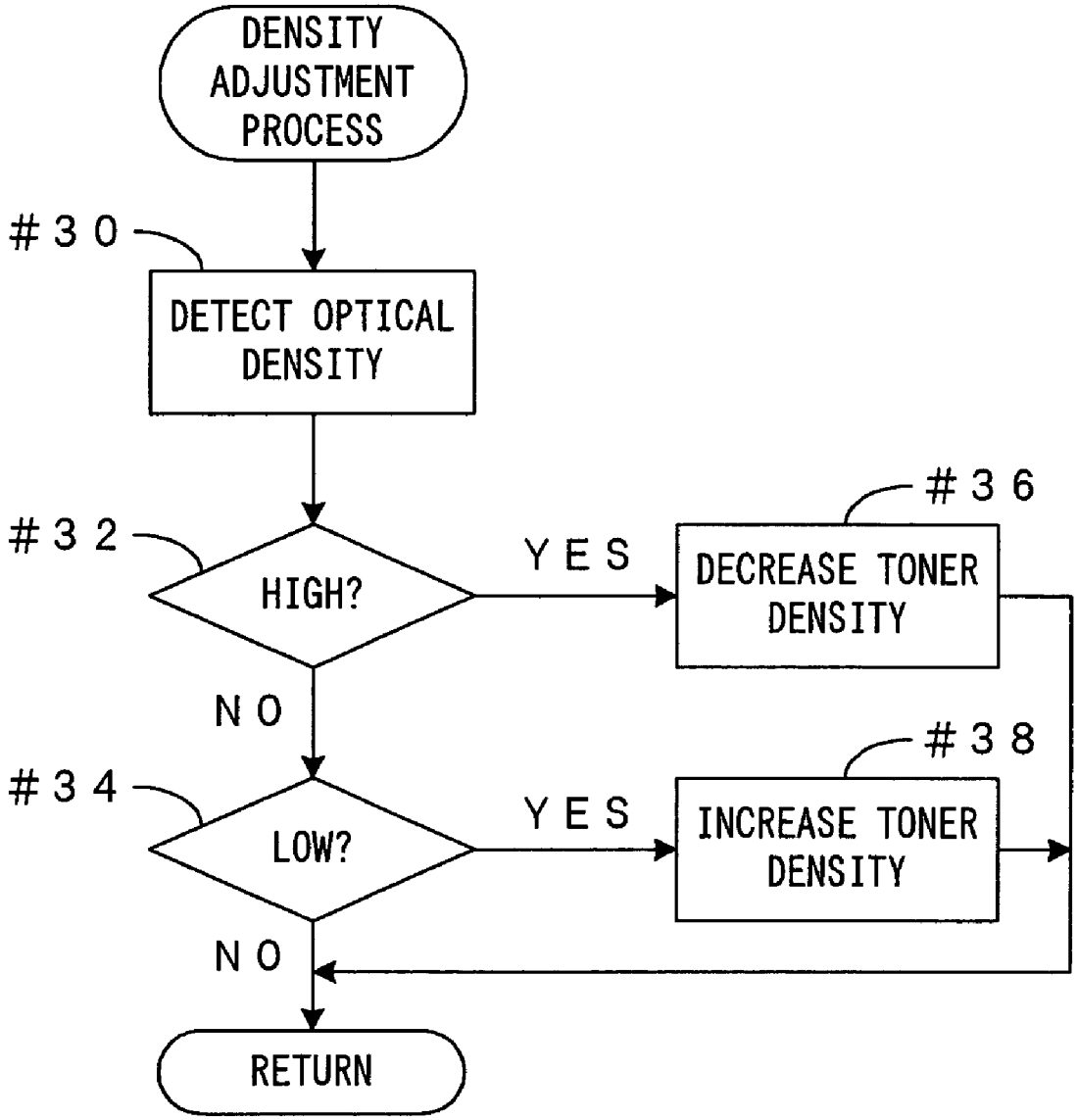
FIG. 12 is a flow chart which shows another example of the density adjustment process routine.

Alternatively, the toner density may be adjusted in accordance with the density of a patch image as shown in FIG. 12. FIG. 12 is a flow chart which shows another example of the density adjustment process routine. In this embodiment, a density sensor 17 is used which is faced with the photosensitive member 11 of the engine part 1 and formed by a reflection-type optical sensor for instance. First, the optical density of a predetermined patch image formed on the photosensitive member 11 is detected (#30). The optical density of the patch image is found in advance and stored in the memory 116 or the memory 38. Whether the detected optical density is higher than the stored optical density is determined (#32). When the detected optical density is not higher (NO at #32), whether the detected optical density is lower is determined (#34).

When the detected optical density is higher than the stored value (YES at #32), the toner density on the developer roller 31 is reduced (#36). The detected optical density being higher than the stored value means that the toner density within the tank 33 has increased. Therefore, decreasing the toner density on the developer roller 31, an image having an appropriate optical density is obtained.

On the contrary, when the detected optical density is lower than the stored value (YES at #34), the toner density on the developer roller 31 is increased (#38). The detected optical density being lower than the stored value means that the toner density within the tank 33 has decreased. Therefore, increasing the toner density on the developer roller 31, an image having an appropriate optical density is obtained.

As described above, during the operations shown in FIG. 12, the optical density of the predetermined patch image is detected, and the toner density in the liquid developer carried on the developer roller 31 is adjusted based on the detected optical density. Hence, it is always possible to obtain an image having an appropriate optical density.

In the embodiment performing the operations shown in FIG. 12, since returning of the liquid developer collected from the squeegee rollers 51 through 53 back to the tank 33 facilitates an increase alone or a decrease alone of the toner density in the tank 33 and makes it difficult to maintain the toner density constant, it is preferable not to return the liquid developer back to the tank 33. In this embodiment, the main controller 100 thus corresponds to a "calculating means" of the present invention, the density sensor 17 thus corresponds to an "optical density detecting means" of the present invention.

As described above, the first preferred embodiment requires that the squeegee rollers 51 through 53 are disposed which contact the liquid developer carried on the developer roller 31 and take away a portion of the liquid developer, that the density adjustment bias generators 119 apply bias voltages between the developer roller 31 and the squeegee rollers 51 through 53, and that the amount of the carrier liquid contained in the liquid developer which moves from the developer roller 31 to the squeegee rollers 51 through 53. Hence, it is possible to adjust the toner density in the liquid developer carried on the developer roller 31.

While shown in FIGS. 6A through 6D is a situation that the toner density in the liquid developer on the developer roller 31 is reduced to zero by keeping the positive bias power source parts 61 connected, the positive bias power source parts 61 may be kept connected for a short period of time to thereby ensure that not all of toner will move to the squeegee roller 51 and a portion of toner will remain on the developer roller 31.

Alternatively, the switches 64 of the density adjustment bias generators 119 shown in FIG. 4 may be formed by a transistor such as an IGBT and a MOS-FET, so as to allow the CPU 113 to PWM-control the switches 64. In this case, since the level of a bias voltage can be changed by changing the on/off duty ratio, it is possible to even more finely adjust the degree of a decrease or increase of the toner density. At #16 and #18 shown in FIG. 10 for instance, a bias voltage whose level corresponds to a difference between the toner density and the initial value may be generated in this case. At #26 and #28 shown in FIG. 11 for instance, a bias voltage whose level corresponds to a difference between the image occupation ratio and the upper or lower limit value may be generated. At #36 and #38 shown in FIG. 12 for instance, a bias voltage whose level corresponds to a difference between the optical density and the stored value may be generated.

Further, instead of moving all of the squeegee rollers 51 through 53 to the adjacent positions, only one or two of the rollers may be moved to the adjacent positions. Fine adjustment of the toner density is possible in this case, too. In addition, although the foregoing has described that there are three squeegee rollers 51 through 53, this is not limiting. One or two squeegee rollers, or further alternatively, four or more squeegee rollers may be used.

<Second Preferred Embodiment>

Figure 13:
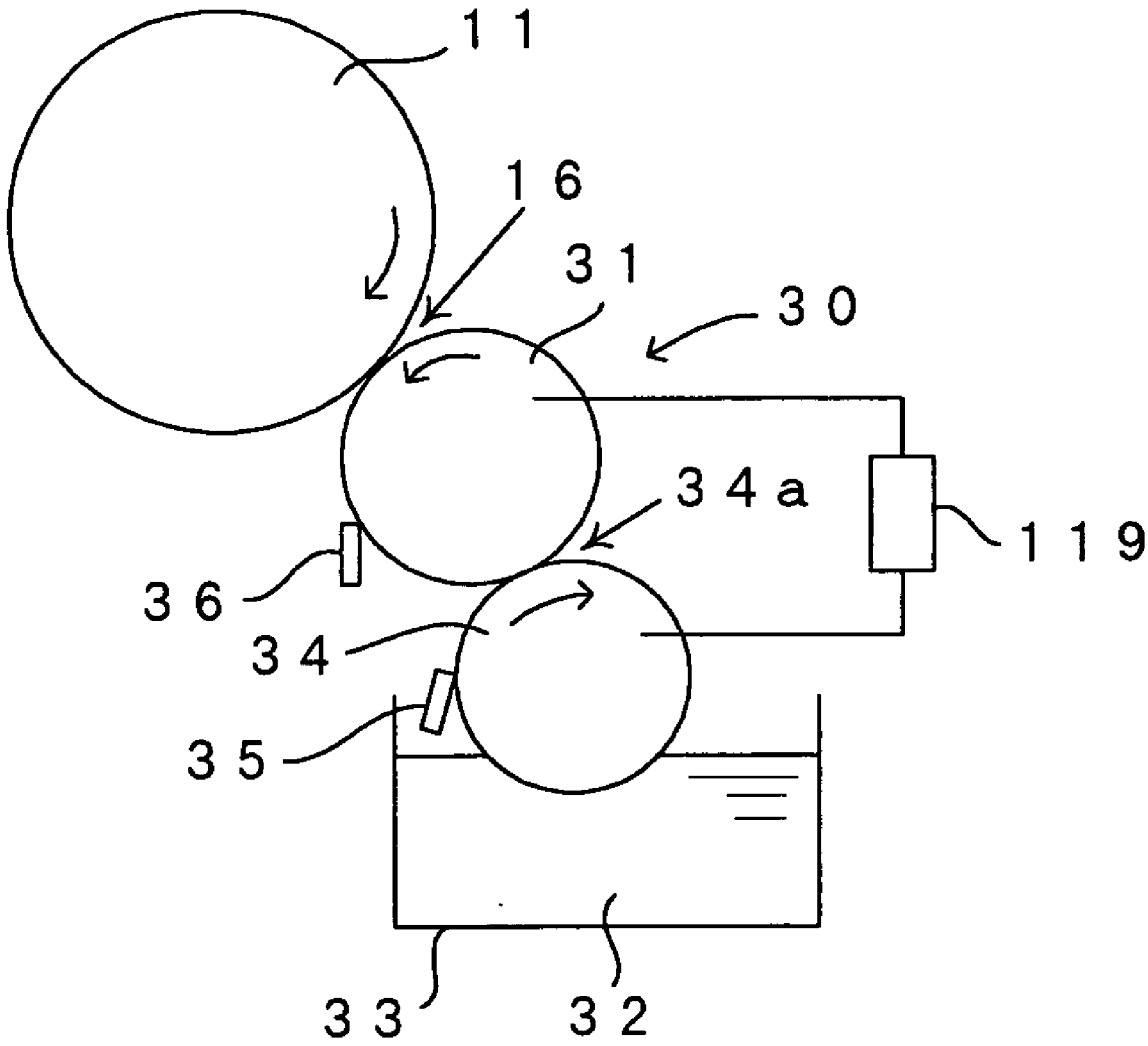
FIG. 13 is a drawing which shows a structure according to a second preferred embodiment of the present invention.

FIG. 13 is a drawing which shows a structure of a printer which is a second preferred embodiment of the image forming apparatus according to the present invention. Shown in FIG. 13 are only the photosensitive member 11, the developer unit 30 and the density adjustment bias generator 119, and other portions are omitted since the other portions are similar to those according to the first preferred embodiment. The same elements as those according to the first preferred embodiment are denoted at the same reference symbols.

The developer unit 30 according to the second preferred embodiment does not comprise the squeegee rollers which are used in the first preferred embodiment. Instead, the density adjustment bias generator 119 is connected between the coating roller 34 and the developer roller 31. As the coating roller 34 controls the amount of toner contained in the liquid developer carried on the developer roller 31, the toner density in the liquid developer carried on the developer roller 31 is adjusted. The coating roller 34 according to the second preferred embodiment rotates in a direction which follows the developer roller 31, as shown in FIG. 13 (the clockwise direction in FIG. 13).

Density adjustment operations in the second preferred embodiment will now be described. As the positive bias power source part 61 of the density adjustment bias generator 119 is connected, the liquid developer moves toward the developer roller 31 in the manner shown in FIG. 6 which has been described earlier. To be more specific, the amount of toner contained in the liquid developer which moves toward the developer roller 31 from the coating roller 34 increases, which realizes such adjustment that the toner density in the liquid developer carried on the developer roller 31 exceeds the toner density in the liquid developer 32 which is held within the tank 33.

When the negative bias power source part 62 of the density adjustment bias generator 119 is connected, the liquid developer moves toward the developer roller 31 in the manner shown in FIGS. 7A through 7D which has been described earlier. That is, the amount of toner contained in the liquid developer which moves toward the developer roller 31 from the coating roller 34 decreases, which realizes such adjustment that the toner density in the liquid developer carried on the developer roller 31 becomes smaller than the toner density in the liquid developer 32 which is held within the tank 33.

When the short-circuit line part 63 of the density adjustment bias generator 119 is connected, a toner density change does not occur and the liquid developer 32 whose density is the same as that within the tank 33 is carried on the developer roller 31, as shown in FIGS. 8A through 8D which has been described earlier. In the second preferred embodiment, the coating roller 34 thus corresponds to a "coating member" and "liquid developer supplying means" of the present invention, and the density adjustment bias generator 119 corresponds to "coating voltage applying means" of the present invention.

As described above, in the second preferred embodiment, the density adjustment bias generator 119 which is connected between the coating roller 34 and the developer roller 31 applies a bias voltage between the coating roller 34 and the developer roller 31, and the amount of toner contained in the liquid developer which moves toward the developer roller 31 from the coating roller 34 is controlled. Hence, it is possible to adjust the toner density in the liquid developer which is carried on the developer roller 31.

The operations shown in FIGS. 10 through 12 can be executed in the second preferred embodiment, too. However, for increasing or decreasing a toner density, the second preferred embodiment requires to connect the density adjustment bias generator 119 in the opposite manner to that according to the first preferred embodiment. In short, when the toner density on the developer roller 31 is to be decreased at the step #16 shown in FIG. 10, the step #26 shown in FIG. 11 and the step #36 shown in FIG. 12, the negative bias power source part 62 of the density adjustment bias generator 119 is connected, whereas when the toner density on the developer roller 31 is to be increased at the steps #18, #28 and #38 in the respective drawings, the positive bias power source part 61 of the density adjustment bias generator 119 is connected.

<Third Preferred Embodiment>

Figure 14:
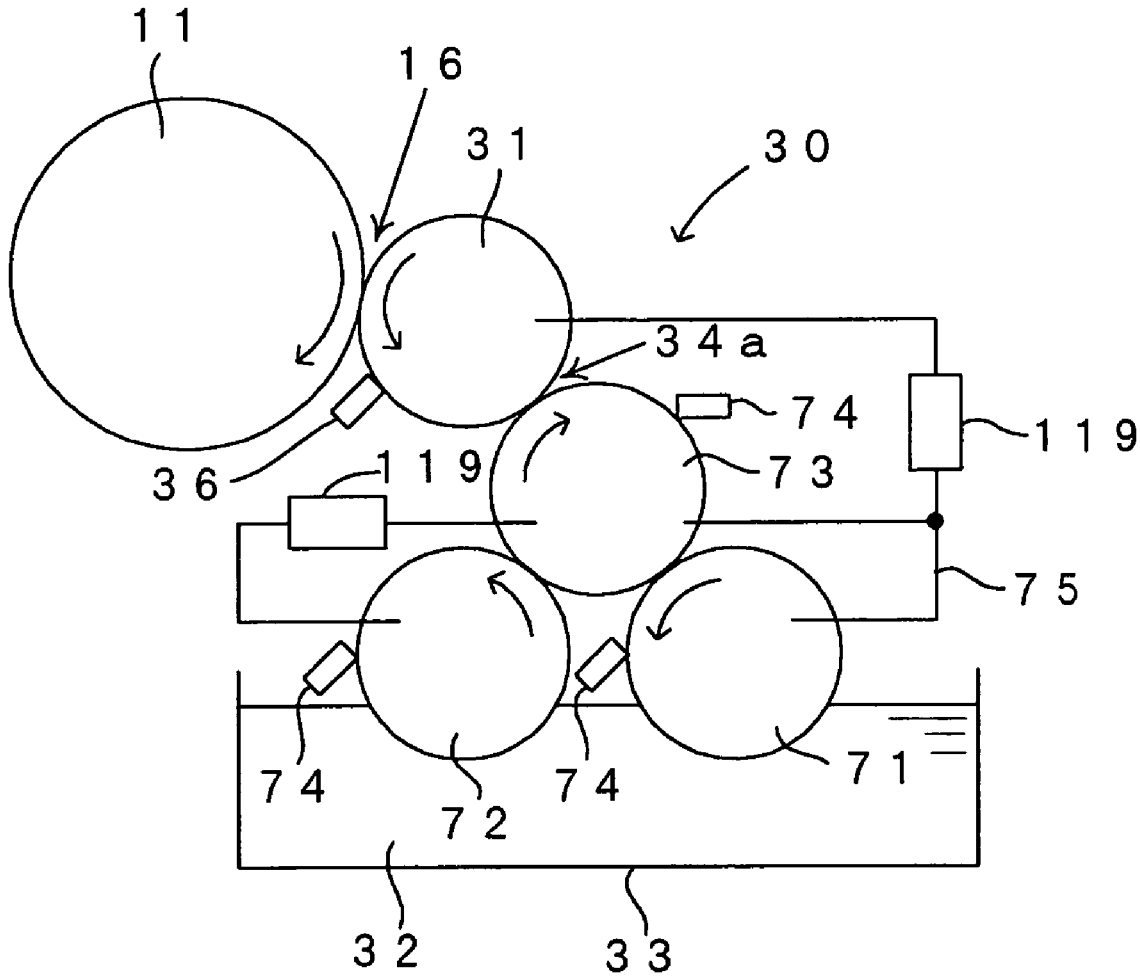
FIG. 14 is a drawing which shows a structure according to a third preferred embodiment of the present invention.

FIG. 14 is a drawing which shows a structure of a printer which is a third preferred embodiment of the image forming apparatus according to the present invention. Shown in FIG. 14 are only the photosensitive member 11, the developer unit 30 and the density adjustment bias generators 119, and other portions are omitted since the other portions are similar to those according to the first preferred embodiment. The same elements as those according to the first preferred embodiment are denoted at the same reference symbols.

The developer unit 30 according to the third preferred embodiment comprises scoop-up rollers 71 and 72 which scoop up the liquid developer 32 which is held within the tank 33, and a coating roller 73 which comes into contact with the liquid developer which has been scooped up by the scoop-up rollers 71 and 72, takes away a portion of the liquid developer and carries the liquid developer. The coating roller 73 brings thus carried liquid developer into contact with the developer roller 31 so that the developer roller 31 will carry a portion of thus carried liquid developer. The developer unit 30 further comprises cleaning blades 74 which remove the liquid developer which remains on the rollers 71, 72 and 73. The coating roller 73 rotates approximately at the same circumferential speed as the developer roller 31 in a direction which follows the developer roller 31 (the clockwise direction in FIG. 14). The scoop-up rollers 71 and 72 each rotate approximately at the same circumferential speed as the coating roller 73 in a direction which follows the coating roller 73 (the anti-clockwise direction in FIG. 14).

The scoop-up roller 71 and the coating roller 73 are electrically connected with each other by a short-circuit line part 75 and consequently held at the same bias with each other. There are the density adjustment bias generator 119 (which corresponds to "scoop-up voltage applying means" of the present invention) connected between the scoop-up roller 72 and the coating roller 73, and another density adjustment bias generator 119 (which corresponds to the "coating voltage applying means" of the present invention) connected between the coating roller 73 and the developer roller 31.

Density adjustment operations in the third preferred embodiment will now be described. As the scoop-up rollers 71 and 72 rotate and accordingly carry the liquid developer 32 on surfaces of the scoop-up rollers 71 and 72, and restricting blades (not shown) make layers of thus carried liquid developer uniform. As the layer of the liquid developer on the scoop-up roller 71 comes into contact with the coating roller 73, as shown in FIG. 5 which has been described earlier, the coating roller 73 takes away a portion of the liquid developer and carries the liquid developer on the surface of the coating roller 73, and the layer of the liquid developer now on the coating roller 73 contacts the layer of the liquid developer which is carried on the scoop-up roller 72. Movement of the liquid developer between the two rollers in a state that the both rollers carry the liquid developer will now be described with reference to FIGS. 15A and 15B.

Figure 15A:
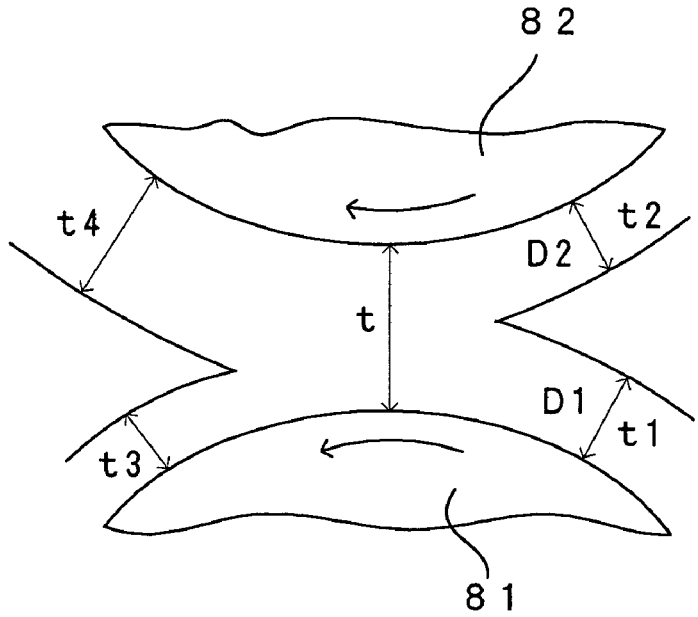
FIGS. 15A and 15B are drawings for describing movement of a liquid developer between rollers.
Figure 15B:
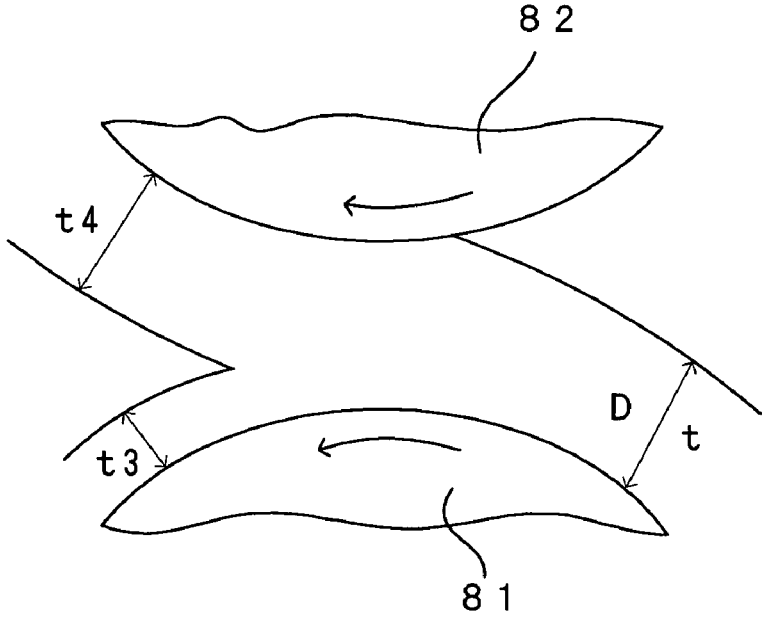

FIGS. 15A and 15B are drawings for describing movement of a liquid developer between two rollers in a state that the both rollers carry the liquid developer. In FIG. 15A, a roller 81 carries the liquid developer whose toner density is D1 and thickness is t1, while a roller 82 carries the liquid developer whose toner density is D2 and thickness is t2. The liquid developers are brought into contact with each other within a nipping zone and thereafter get separated from each other. In consequence, the roller 81 carries the liquid developer whose thickness is t3 and the roller 82 carries the liquid developer whose thickness is t4. In this case, the thickness t in the nipping zone is:

$$t=t1+t2$$

Meanwhile, the toner density D of the liquid developer mixed together in the nipping zone is:

$$D=(t1\cdot D1+t2\cdot D2)/(t1+t2)$$

Noting this, a situation as that shown in FIG. 15A is considered to be equivalent to a state that the roller 81 carries the liquid developer whose toner density is D and thickness is t as shown in FIG. 15B. Movement of the liquid developer between the scoop-up roller 72 and the coating roller 73 in FIG. 14 can be regarded to be similar to that shown in FIGS. 5 and 6A through 8D which have been described earlier.

Referring to FIG. 14 again, since the scoop-up roller 71 and the coating roller 73 are held at the same bias with each other by the short-circuit line part 75, the liquid developer 32 remains carried on the coating roller 73 without any toner density change as shown in FIGS. 8A through 8D which have been described earlier. When the positive bias power source part 61 of the density adjustment bias generator 119 is connected between the scoop-up roller 72 and the coating roller 73, the liquid developer moves toward the coating roller 73 as shown in FIGS. 6A through 6D which have been described earlier. In other words, the amount of toner contained in the liquid developer which moves toward the coating roller 73 from the scoop-up roller 72 increases, which realizes such adjustment that the toner density in the liquid developer carried on the coating roller 73 exceeds the toner density in the liquid developer 32 which is held within the tank 33.

When the negative bias power source part 62 of the density adjustment bias generator 119 is connected, the liquid developer moves toward the coating roller 73 as shown in FIGS. 7A through 7D which have been described earlier. That is, the amount of toner contained in the liquid developer which moves toward the coating roller 73 from the scoop-up roller 72 decreases, which realizes such adjustment that the toner density in the liquid developer carried on the coating roller 73 becomes smaller than the toner density in the liquid developer 32 which is held within the tank 33.

When the connection of the density adjustment bias generator 119 is established between the coating roller 73 and the developer roller 31 is changed, the amount of toner contained in the liquid developer which moves toward the developer roller 31 from the coating roller 73 is controlled. As a result, the toner density in the liquid developer carried on the developer roller 31 is adjusted. In the third preferred embodiment, the scoop-up rollers 71 and 72 thus correspond to a "scoop-up member" of the present invention, the coating roller 73 thus corresponds to a "coating member" of the present invention, and the scoop-up rollers 71 and 72 and the coating roller 73 thus correspond to the "liquid developer supplying means" of the present invention.

As described above, in the third preferred embodiment, the density adjustment bias generator 119 is connected between the coating roller 73 and the developer roller 31, and a bias voltage applied between the coating roller 73 and the developer roller 31 is controlled. Hence, it is possible to control the amount of toner contained in the liquid developer which moves toward the developer roller 31 from the coating roller 73, and therefore, adjust the toner density in the liquid developer carried on the developer roller 31.

Further, since the third preferred embodiment requires that the scoop-up roller 71 and the coating roller 73 are held at the same bias with each other and the density adjustment bias generator 119 is connected between the scoop-up roller 72 and the coating roller 73, it is possible to adjust the toner density in the liquid developer which is carried on the coating roller 73, and therefore, finely adjust the toner density in the liquid developer carried on the developer roller 31.

Further, returning of remaining liquid developer removed by the cleaning blades 74 back into the tank 33 in the third preferred embodiment would suppress a toner density change inside the tank 33 and maintain the toner density at a constant value as in the first preferred embodiment. This permits to use the liquid developer 32 held in the tank 33 to the very end without wasting, and minimizes the amount of a carrier liquid, toner or the like replenished from outside.

The operations shown in FIGS. 10 through 12 can be executed in the third preferred embodiment, too. However, for increasing or decreasing a toner density, the third preferred embodiment requires to connect the density adjustment bias generators 119 in the opposite manner to that according to the first preferred embodiment, i.e., in a similar manner to that according to the second preferred embodiment.

<Fourth Preferred Embodiment>

Figure 16:
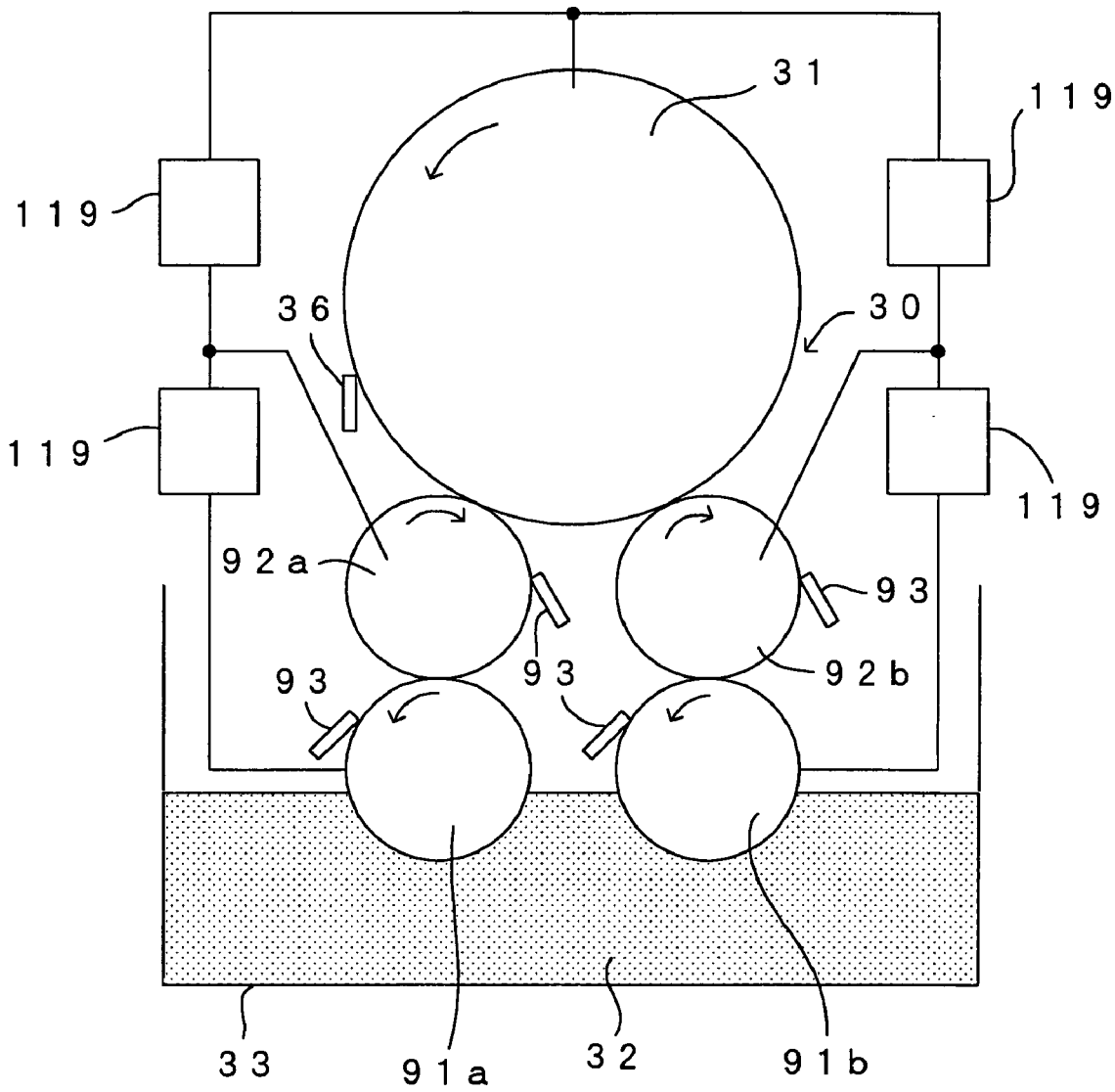
FIG. 16 is a drawing which shows a structure according to a fourth preferred embodiment of the present invention.

FIG. 16 is a drawing which shows a structure of a printer which is a fourth preferred embodiment of the image forming apparatus according to the present invention. Shown in FIG. 16 are only the developer unit 30 and the density adjustment bias generators 119, and other portions are omitted since the other portions are similar to those according to the first preferred embodiment. The same elements as those according to the first preferred embodiment are denoted at the same reference symbols.

The developer unit 30 according to the fourth preferred embodiment comprises scoop-up rollers 91*a* and 91*b* which scoop up the liquid developer 32 which is held within the tank 33, relay rollers 92*a* and 92*b* which carry the liquid developer thus scooped up by the scoop-up rollers 91*a* and 91*b* and coat the developer roller 31 with the liquid developer, and cleaning blades 93 which remove the liquid developer which remains on the respective rollers 91*a*, 91*b*, 92*a* and 92*b*.

The relay rollers 92*a* and 92*b* rotate approximately at the same circumferential speed as the developer roller 31 in a direction which follows the developer roller 31 (the clockwise direction in FIG. 16). The scoop-up rollers 91*a* and 91*b* rotate approximately at the same circumferential speed as the relay rollers 92*a* and 92*b* in a direction which follows the relay rollers 92*a* and 92*b* (the anti-clockwise direction in FIG. 16). The density adjustment bias generators 119 (which correspond to the "scoop-up voltage applying means" of the present invention) are connected between the relay roller 92*a* and the scoop-up roller 91*a* and between the relay roller 92*b* and the scoop-up roller 91*b*. Further, the density adjustment bias generators 119 (which correspond to the "coating voltage applying means" of the present invention) are connected between the developer roller 31 and the relay roller 92*a* and between the developer roller 31 and the relay roller 92*b*.

Density adjustment operations in the fourth preferred embodiment will now be described. As the scoop-up rollers 91*a* and 91*b* rotate, the liquid developer 32 is carried on surfaces of the scoop-up rollers 91*a* and 91*b*, and restricting blades (not shown) make layers of thus carried liquid developer uniform.

As the layer of the liquid developer on the scoop-up roller 91*a* comes into contact with the relay roller 92*a*, as shown in FIG. 5 which has been described earlier, a portion of the liquid developer moves to the relay roller 92*a* and is carried on the surface of the relay roller 92*a*. The connection of the density adjustment bias generator 119 is changed at this stage, thereby controlling the amount of toner contained in the liquid developer which moves toward the relay roller 92*a* from the scoop-up roller 91*a*.

Further, as the layer of the liquid developer on the relay roller 92*a* comes into contact with the developer roller 31, as shown in FIG. 5 which has been described earlier, a portion of the liquid developer moves to the developer roller 31 and is carried on the surface of the developer roller 31 in a similar manner. The connection of the density adjustment bias generator 119 is changed at this stage, thereby controlling the amount of toner contained in the liquid developer which moves toward the developer roller 31 from the relay roller 92*a*. In the fourth preferred embodiment, the scoop-up roller 91*a* and the relay roller 92*a* thus correspond to the "liquid developer supplying means" of the present invention.

On the other hand, as the layer of the liquid developer on the scoop-up roller 91*b* comes into contact with the relay roller 92*b*, as shown in FIG. 5 which has been described earlier, a portion of the liquid developer moves to the relay roller 92*b* and is carried on the surface of the relay roller 92*b* in a similar fashion. The connection of the density adjustment bias generator 119 is changed at this stage, thereby controlling the amount of toner contained in the liquid developer which moves toward the relay roller 92*b* from the scoop-up roller 91*b*.

Further, as the layer of the liquid developer on the relay roller 92*b* comes into contact with the developer roller 31, a situation as that shown in FIG. 15A which has been described earlier arises. As depicted in FIG. 15B which has been described earlier, the liquid developer having a predetermined toner density and predetermined thickness is eventually carried on the surface of the developer roller 31. The connection of the density adjustment bias generator 119 is changed at this stage, thereby controlling the amount of toner contained in the liquid developer which moves toward the developer roller 31 from the relay roller 92*b*. In the fourth preferred embodiment, the scoop-up roller 91*b* and the relay roller 92*b* thus correspond to the "liquid developer supplying means" of the present invention.

As described above, the developer unit 30 according to the fourth preferred embodiment comprises the two structures which correspond to the "liquid developer supplying means." In other words, as a liquid developer supply route to the developer roller 31, the developer unit 30 comprises a first supply route which goes through the scoop-up roller 91*a* and the relay roller 92*a* and a second supply route which goes through the scoop-up roller 91*b* and the relay roller 92*b*.

In addition, in each route, the amount of toner contained in the liquid developer is controlled at two points. That is, in the first supply route, the control is realized at two points, one during the movement of the liquid developer from the scoop-up roller 91*a* to the relay roller 92*a* and the other during the movement of the liquid developer from the relay roller 92*a* to the developer roller 31. Meanwhile, in the second supply route, the control is realized at two points, one during the movement of the liquid developer from the scoop-up roller 91*b* to the relay roller 92*b* and the other during the movement of the liquid developer from the relay roller 92*b* to the developer roller 31.

According to the fourth preferred embodiment, it is therefore possible to widely and finely adjust the toner density in the liquid developer which is carried on the developer roller 31.

In addition, the fourth preferred embodiment, when modified to require that the remaining liquid developer removed from the respective rollers 91*a*, 92*a*, 91*b* and 92*b* by the cleaning blades 93 is returned back to the tank 33, permits to suppress a toner density change inside the tank 33 and maintain the toner density at a constant value, like the first preferred embodiment. This allows to use the liquid developer 32 held in the tank 33 to the very end without wasting, and minimizes the amount of a carrier liquid, toner or the like replenished from outside.

The operations shown in FIGS. 10 through 12 can be executed in the fourth preferred embodiment, too. However, for increasing or decreasing a toner density, the fourth preferred embodiment requires to connect the density adjustment bias generators 119 in the opposite manner to that according to the first preferred embodiment, i.e., in a similar manner to that according to the second preferred embodiment.

In the fourth preferred embodiment, the liquid developer may be supplied to the developer roller 31 directly from the scoop-up rollers 91*a* and 91*b* without using the relay rollers 92*a* and 92*b*. Even in this case, since there are the two routes for supplying the liquid developer to the developer roller 31, it is possible to widely and finely adjust the toner density in the liquid developer which is carried on the developer roller 31.

<Fifth Preferred Embodiment>

Figure 17:
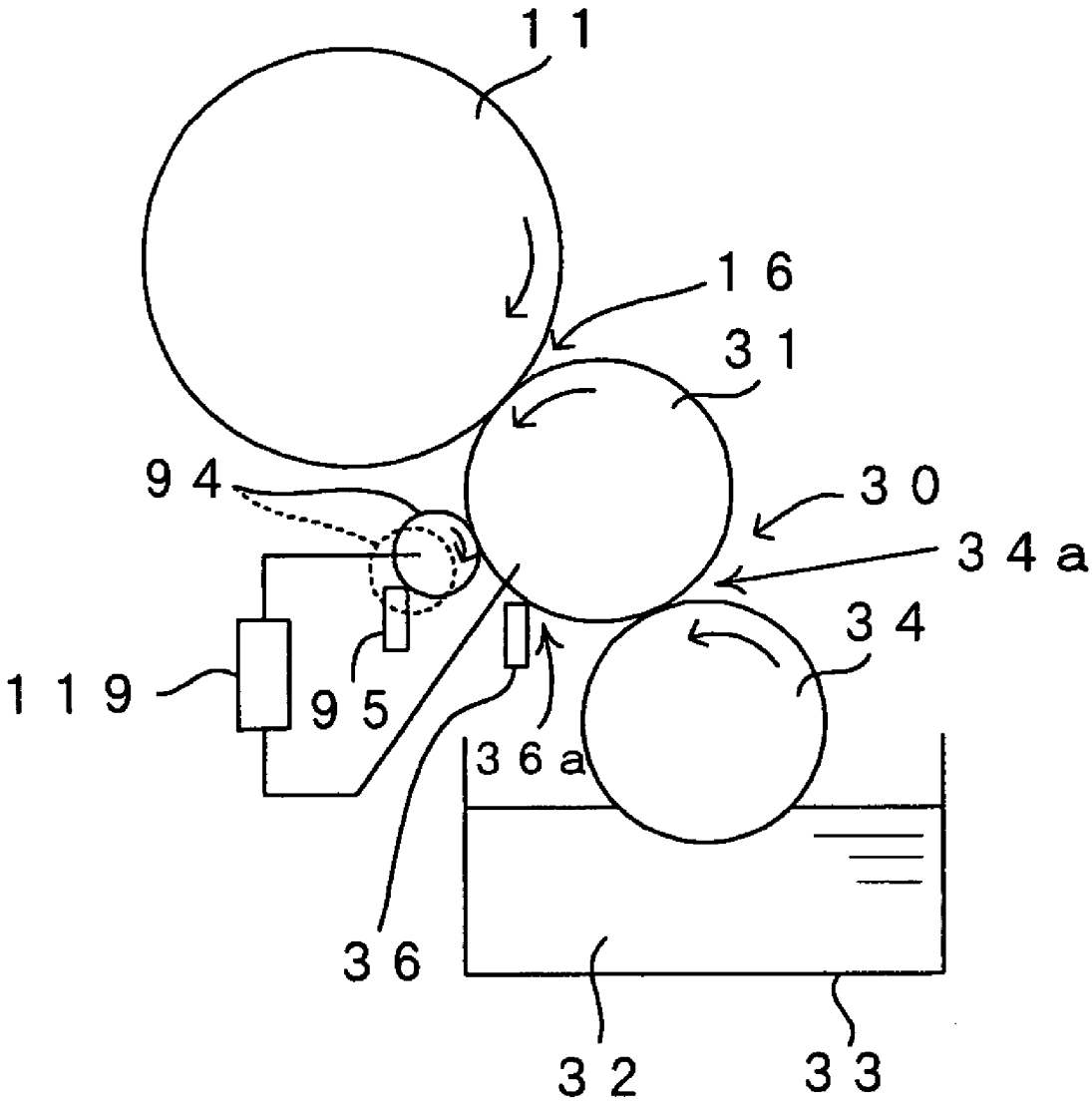
FIG. 17 is a drawing which shows a structure according to a fifth preferred embodiment of the present invention.

FIG. 17 is a drawing which shows a structure of a printer which is a fifth preferred embodiment of the image forming apparatus according to the present invention. Shown in FIG. 17 are only the photosensitive member 11, the developer unit 30 and the density adjustment bias generator 119, and other portions are omitted since the other portions are similar to those according to the first preferred embodiment. The same elements as those according to the first preferred embodiment are denoted at the same reference symbols.

The developer unit 30 according to the fifth preferred embodiment comprises a squeegee roller 94 which is disposed facing an area on the developer roller 31 which is located between the developing position 16 and a cleaning position 36*a* which is for cleaning by the cleaning blade 36. The squeegee roller 94 is supported in such a manner that the squeegee roller 94 can move in a direction closer to and away from the developer roller 31. In other words, when the contacting/clearing driver 118 (FIG. 2) drives the actuator 54 (FIG. 2) which is formed by a solenoid, a motor or the like for instance, the squeegee roller 94 reciprocally moves between an adjacent position on the developer roller 31 (denoted at the solid line in FIG. 17) and a clear-off position off the developer roller 31 (denoted at the broken line in FIG. 17). The adjacent position is such a position at which the squeegee roller 94 contacts the liquid developer which remains on the developer roller 31 after development has completed, whereas the clear-off position is such a position at which the squeegee roller 94 is off from the adjacent position and remains not in contact with the liquid developer. At the adjacent position, the squeegee roller 94 rotates approximately at the same circumferential speed as the developer roller 31 in a direction which follows the developer roller 31 (the clockwise direction in FIG. 17). The density adjustment bias generator 119 is connected between the squeegee roller 94 and the developer roller 31.

A cleaning blade 95 removes the liquid developer which the squeegee roller 94 has taken away from the developer roller 31, and the removed liquid developer is collected back to a waste solution tank (not shown) for instance. The cleaning blade 36 removes the liquid developer which remains on the developer roller 31 without being stripped off by the squeegee roller 94, and the removed liquid developer returns by its own weight back to the tank 33 for example. In the fifth preferred embodiment, the squeegee roller 94 corresponds to the "stripping member" of the present invention and the cleaning blade 36 corresponds to a "cleaning member" of the present invention.

Figure 18:
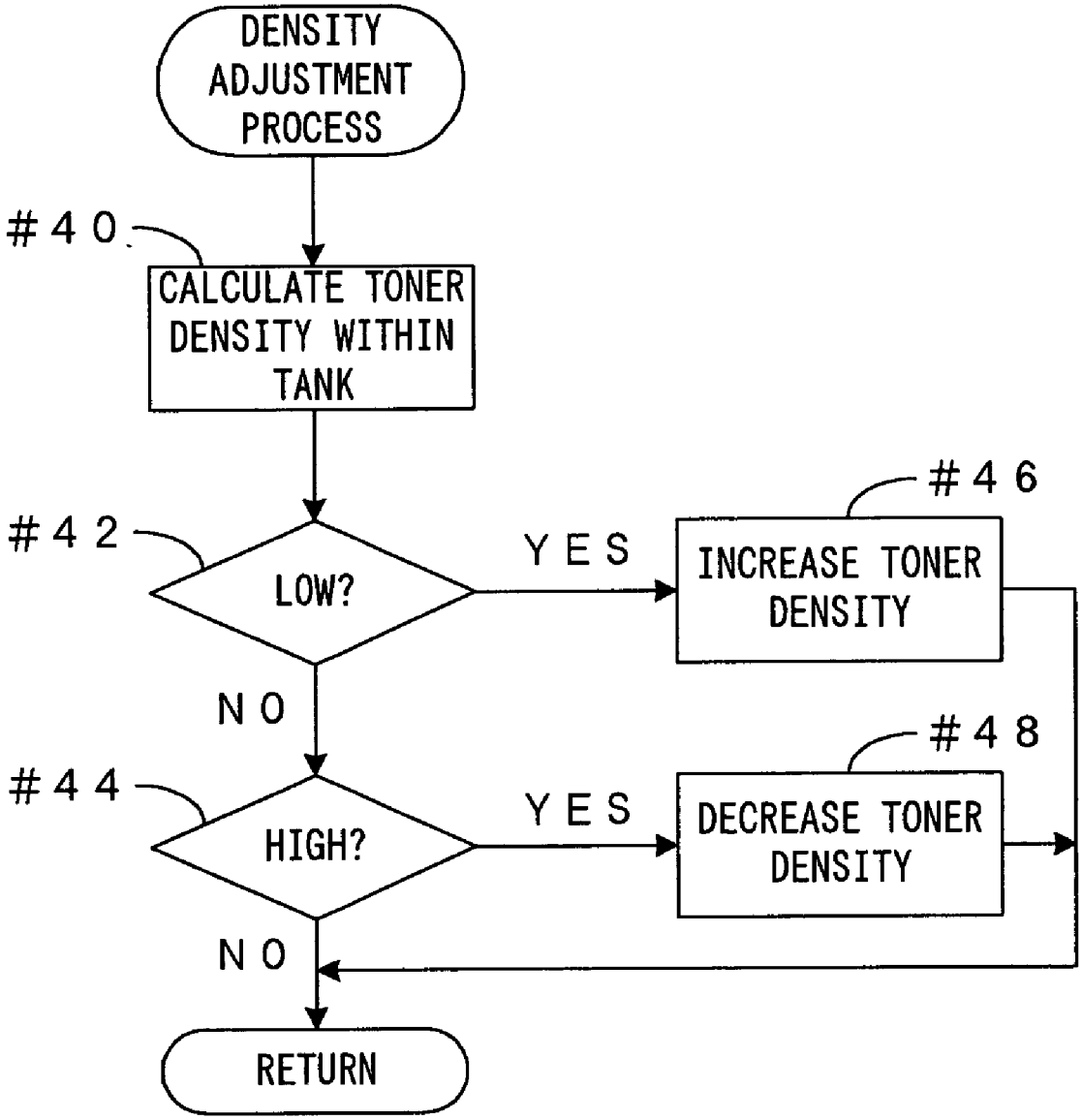
FIG. 18 is a flow chart of a density adjustment process routine according to the fifth preferred embodiment.

FIG. 18 is a flow chart of a density adjustment process routine according to the fifth preferred embodiment. In FIG. 18, steps #40, #42 and #44 are similar to the steps #10, #12 and #14 which are shown in FIG. 10, and therefore, will not be described. When the toner density within the tank 33 is low (YES at #42), the toner density is to be increased. To be more specific, the negative bias power source part 62 is connected, so that toner is rarely contained in the liquid developer which moves toward the squeegee roller 94 from the developer roller 31 and the carrier liquid alone is mostly stripped off. Hence, the toner density in the liquid developer which is on the developer roller 31 rises. The cleaning blade 36 removes and returns thus remaining liquid developer to the tank 33, and the toner density within the tank 33 increases.

On the contrary, when the toner density within the tank 33 is high (YES at #44), the toner density is to be decreased (#46). That is, the positive bias power source part 61 is connected, and the amount of toner contained in the liquid developer which moves toward the squeegee roller 94 from the developer roller 31 therefore increases. Hence, the toner density in the liquid developer which is on the developer roller 31 decreases. The cleaning blade 36 removes and returns thus remaining liquid developer to the tank 33, and the toner density within the tank 33 decreases.

In the fifth preferred embodiment, as the connection of the density adjustment bias generator 119 is changed, the amount of toner contained in the liquid developer which moves toward the squeegee roller 94 from the developer roller 31 is controlled. It is thus possible to adjust the toner density in the liquid developer which remains on the developer roller 31 after the end of development.

Further, since the remaining liquid developer is returned to the tank 33, it is possible to suppress a toner density change inside the tank 33 and maintain the toner density at a constant value. This permits to use the liquid developer 32 held in the tank 33 to the very end without wasting, and minimizes the amount of a carrier liquid, toner or the like replenished from outside.

An alternative in the fifth preferred embodiment is to strip the developer roller 31 of the liquid developer by means of the squeegee roller 94 and return the liquid developer removed by the cleaning blade 95 back to the tank 33, so that the liquid developer which remains on the developer roller 31 without being stripped off by the squeegee roller 94 but which is then removed by the cleaning blade 36 will be returned to the waste solution tank. In this case, it is possible to suppress a toner density change inside the tank 33 and attain a similar effect to that according to the fifth preferred embodiment described above, when the operation at the step #46 and the operation at the step #48 are exchanged each other.

<Modifications of First Through Fifth Preferred Embodiments>

The present invention is not limited to the preferred embodiments above, but may be modified in various manners in addition to the preferred embodiments above, to the extent not deviating from the object of the invention. For instance, the following modifications (1) through (4) may be used.

(1) In the first and the fifth preferred embodiments, the actuator 54 may be formed by a motor for instance and the adjacent positions at which the squeegee rollers 51 through 53 and 94 contact the liquid developer on the developer roller 31 may be variable. Such an embodiment allows to control the amount of the liquid developer which moves toward the squeegee rollers 51 through 53 and 94 from the developer roller 31, and hence, to more finely adjust a toner density.

(2) In the first and the fifth preferred embodiments, the rotation speed of the squeegee rollers 51 through 53 and 94 may be variable. This permits to control the amount of the liquid developer which moves toward the squeegee rollers 51 through 53 and 94 from the developer roller 31, and hence, to more finely adjust a toner density.

(3) While the developer roller 31 which has a roller shape is used as the liquid developer carrier in the preferred embodiments described above, this is not limiting. A carrier shaped like a belt may be used instead, for example. In addition, although the preferred embodiments described above use the squeegee rollers 51 through 53 and 94 which have a roller shape as the stripping member, a stripping member shaped like a belt may be used instead, for instance.

(4) Although the foregoing has described the preferred embodiments above in relation to a printer which prints on a transfer paper an image fed from an external apparatus such as a host computer, the present invention is not limited to this but is applicable to electrophotographic image forming apparatuses in general including copier machines, facsimile machines and the like. Further, the preferred embodiments above are an application of the present invention to an image forming apparatus which prints in monochrome, applications of the present invention are not limited to this. Rather, the present invention is applicable also to an image forming apparatus which prints in colors, in which case the apparatus is capable of detecting and adjusting a toner density in each color.

<Sixth Preferred Embodiment>

Figure 19:
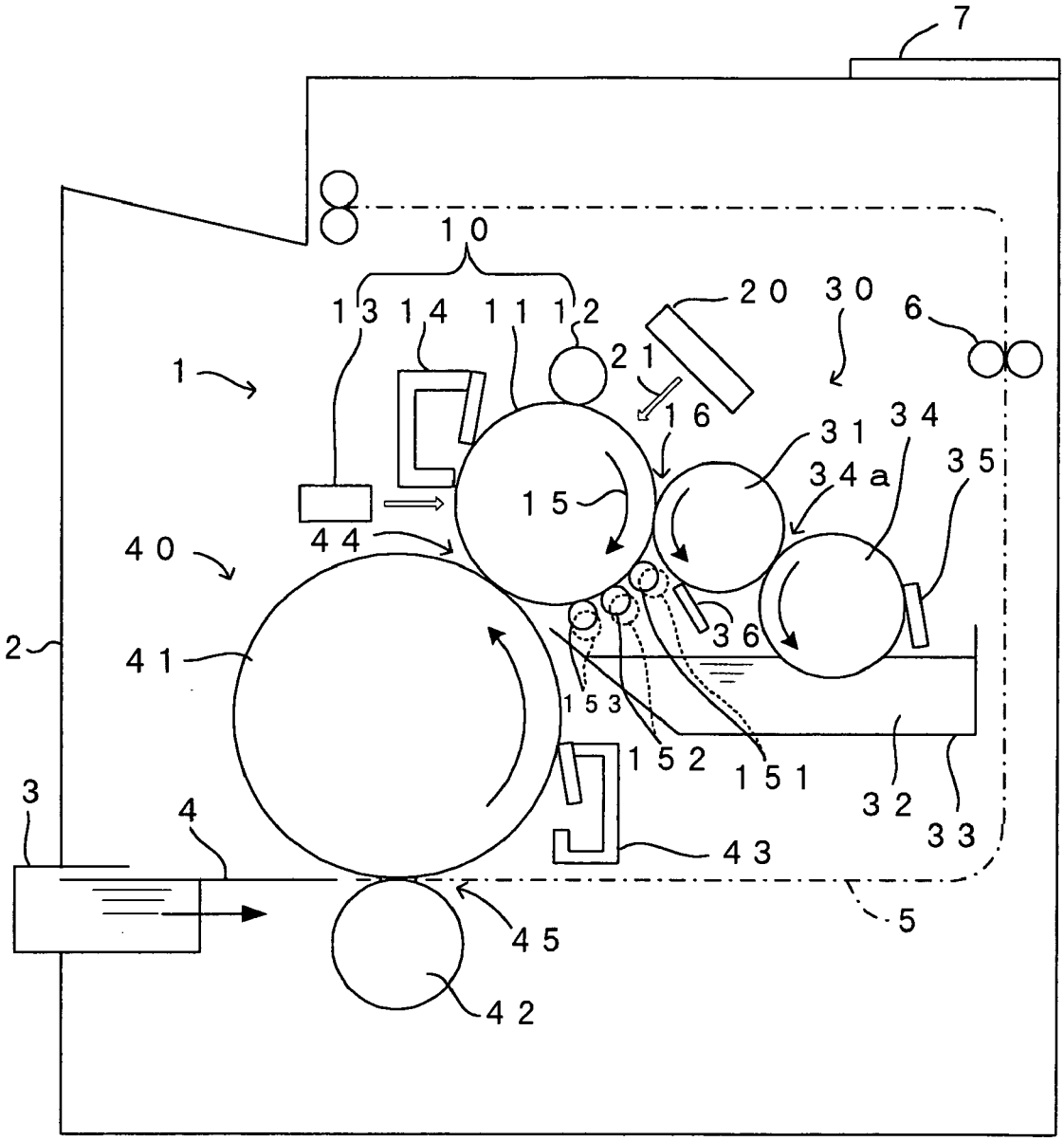
FIG. 19 is a drawing which shows an internal structure of a printer which is a sixth preferred embodiment of the present invention.
Figure 20:
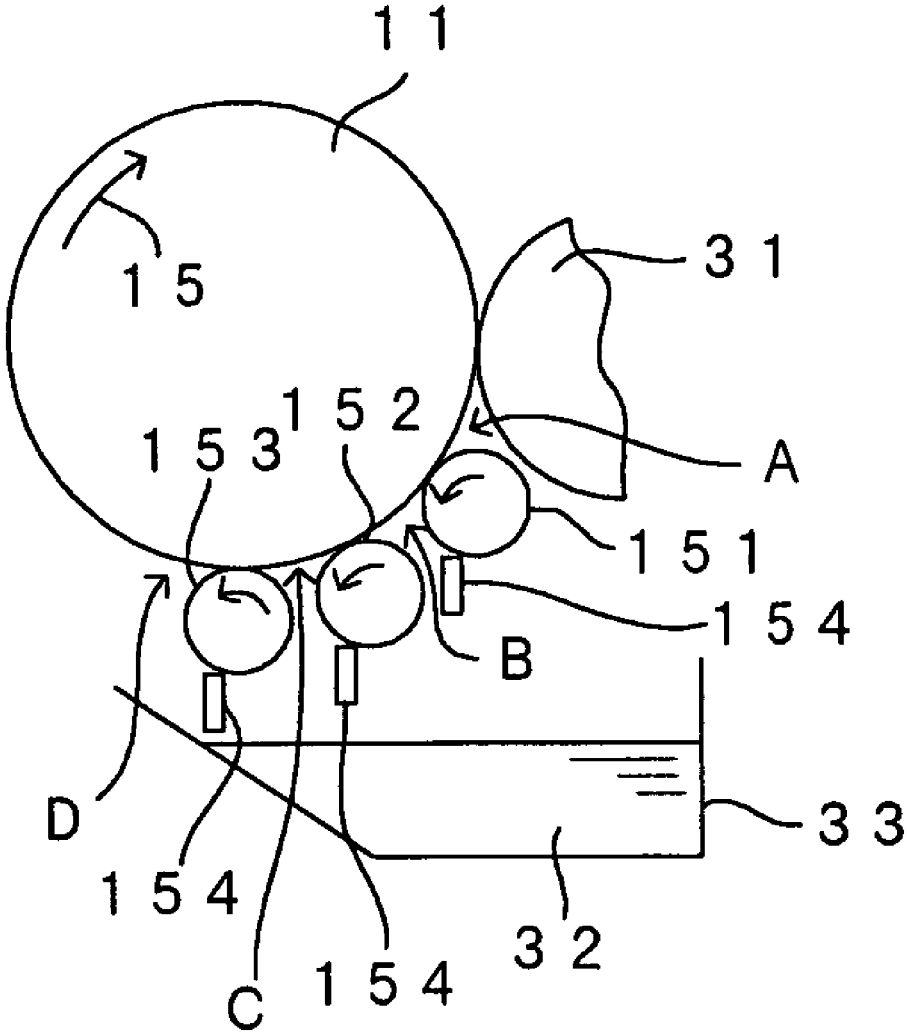
FIG. 20 is an expanded view of an essential section in FIG. 19.
Figure 21:
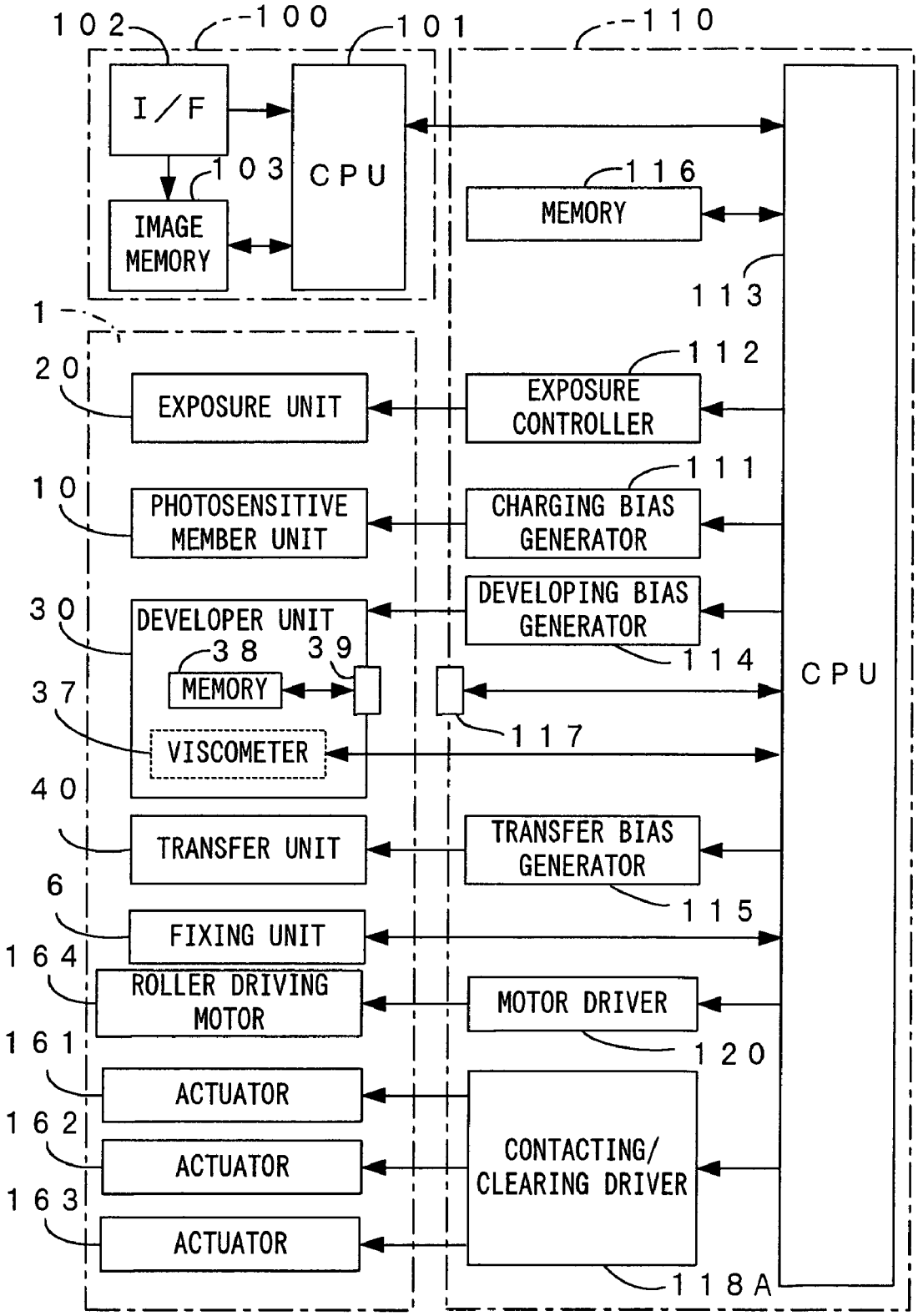
FIG. 21 is a block diagram which shows an electric structure of this printer.

FIG. 19 is a drawing which shows an internal structure of a printer which is a sixth preferred embodiment of the image forming apparatus according to the present invention, FIG. 20 is an expanded view of an essential section in FIG. 19, and FIG. 21 is a block diagram which shows an electric structure of this printer. The same elements as those according to the first preferred embodiment are denoted at the same reference symbols, and will not be described.

In the sixth preferred embodiment, the squeegee rollers 51, 52 and 53 used in the first preferred embodiment are replaced with squeegee rollers 151, 152 and 153. To be more specific, disposed around the photosensitive member 11 are the charger 12, the developer roller 31, the squeegee rollers 151, 152 and 153, the intermediate transfer roller 41, the static eliminator 13 and the cleaner 14 along the rotation direction 15 of the photosensitive member 11.

As in the first preferred embodiment, toner contained in the liquid developer is charged positively for example, owing to a function of the electric charge control agent and the like. At the developing position 16 therefore, the liquid developer carried on the developer roller 31 is supplied from the developer roller 31 to the photosensitive member 11 and adheres to the photosensitive member 11, toner moves within the liquid developer toward the photosensitive member 11 from the developer roller 31 because of the developing bias Vb (e.g., Vb=DC+400 V) which is applied upon the developer roller 31 by the developing bias generator 114, and an electrostatic latent image is accordingly visualized.

In addition, the cleaning blade 36 scrapes off the liquid developer which remains on the developer roller 31 without adhering to the photosensitive member 11, and the liquid developer returns by its own weight back to the tank 33 in the sixth preferred embodiment. In the sixth preferred embodiment, the photosensitive member 11 thus corresponds to the "image carrier" of the present invention, the developer roller 31 thus corresponds to the "liquid developer carrier," the tank 33 thus corresponds to the "container" of the present invention, and the transfer bias generator 115 thus corresponds to the "transfer means" of the present invention.

Structures of the squeegee rollers 151, 152 and 153 will now be described. The squeegee rollers 151, 152 and 153 are disposed next to each other along the rotation direction (i.e., a direction in which the liquid developer is transported) 15 in such a manner that the squeegee rollers 151, 152 and 153 are faced against an area on the photosensitive member 11 between the developing position 16 and the primary transfer position 44, namely, a developed image carrying area in which a toner image is carried. The squeegee rollers 151, 152 and 153 are supported in such a manner that the squeegee rollers 151, 152 and 153 can move in a direction closer to and away from the photosensitive member 11. In short, when a contacting/clearing driver 118A (FIG. 21) drives actuators 161, 162 and 163 (FIG. 21) which are formed by solenoids, motors or the like for instance, the squeegee rollers 151, 152 and 153 reciprocally move between contacting positions (denoted at the solid lines in FIG. 19) and clear-off positions (denoted at the broken lines in FIG. 19). The contacting positions are such positions at which the squeegee rollers 151, 152 and 153 contact the liquid developer which is carried on the photosensitive member 11. The clear-off positions are such positions at which the squeegee rollers 151, 152 and 153 remain not in contact with the above-mentioned liquid developer.

Further, when a motor driver 120 (FIG. 21) drives roller driving motors 164 (FIG. 21) into rotations at the contacting positions, the squeegee rollers 151, 152 and 153 rotate approximately at the same circumferential speed as the photosensitive member 11 in a direction which follows the photosensitive member 11 (the anti-clockwise direction in FIG. 19). When located at the contacting positions in contact with the carrier liquid which is in a surface layer of the liquid developer 32 which is carried on the photosensitive member 11, the squeegee rollers 151, 152 and 153 strip the photosensitive member 11 of the carrier liquid.

As shown in FIG. 20, cleaning blades 154 abut on the squeegee rollers 151, 152 and 153. The carrier liquid stripped off from the photosensitive member 11 by the squeegee rollers 151, 152 and 153 is scraped off by the respective cleaning blades 154 and removed from the squeegee rollers 151, 152 and 153. An opening of the tank 33 stretches out toward below the positions at which the respective cleaning blades 154 abut on the squeegee rollers 151, 152 and 153. Hence, the carrier liquid removed from the squeegee rollers 151 through 153 by the cleaning blades 154 returns by its own weight to the tank 33.

Although the sixth preferred embodiment requires that the removed carrier liquid returns by its own weight to the tank 33, this is not limiting. Alternatively, a pan which receives the removed carrier liquid and a collection pipe which links the pan to the tank 33, and a pump may be disposed so that the carrier liquid will be forced back to the tank 33 when the pump is driven. Operations of stripping off the carrier liquid using the squeegee rollers 151, 152 and 153 will be described in detail later.

Figure 22:
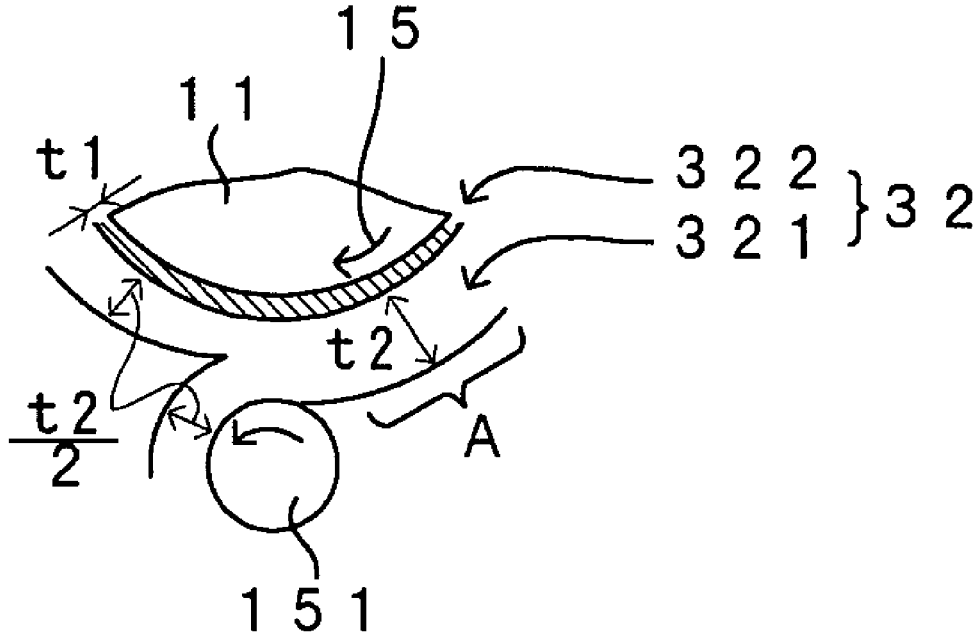
FIG. 22 is an explanatory view which shows a stripped amount of a carrier liquid which is removed by the squeegee rollers.

FIG. 22 is a drawing for describing an operation that the squeegee roller 151 strips the photosensitive member 11 of the carrier liquid. In FIG. 22, in an area A, that is, on the upstream side to the squeegee roller 151 along the rotation direction 15 of the photosensitive member 11, the liquid developer 32 is supplied from the developer roller 31 (FIG. 19) and adheres to the photosensitive member 11, toner 322 moves within a carrier liquid 321 owing to the developing bias Vb and adheres to the photosensitive member 11, and a toner image (which is a solid black image in FIG. 22) is formed. The toner 322 has thickness of t1, and the carrier liquid 321 has thickness of t2. In short, the thickness of the liquid developer 32 on the photosensitive member 11 is (t1+t2).

The liquid developer 32 on the photosensitive member 11 is nipped between the squeegee roller 151 which is located at the contacting position and the photosensitive member 11, and the carrier liquid 321 which is in the surface layer of the liquid developer 32 comes into contact with the squeegee roller 151 and adheres to the squeegee roller 151. As the squeegee roller 151 and the photosensitive member 11 rotate, the carrier liquid 321 gets separated approximately at the center of the carrier liquid 321. In other words, the thickness of the carrier liquid 321 which remains on the photosensitive member 11 and the thickness of the carrier liquid 321 which moves to the squeegee roller 151 each become about t2/2.

The squeegee roller 151 takes away a portion of the carrier liquid 321 off from the photosensitive member 11 in this manner. This embodiment uses the three squeegee rollers 151 through 153 which can move to the contacting positions and the clear-off positions, and the CPU 113 controls the positions of the squeegee rollers 151 through 153. When a combination of the squeegee rollers 151 through 153 which are moved to the contacting positions is controlled, a stripped amount of the carrier liquid 321 is controlled and a collection amount of the carrier liquid 321 is consequently adjusted. In this embodiment, the squeegee rollers 151 through 153 thus each correspond to the "stripping member" and "collecting means" of the present invention.

FIGS. 23A through 26D are drawings for describing a relationship between an image occupation ratio and a stripped amount of the carrier liquid. FIGS. 23A, 24A, 25A and 26A show toner images on the photosensitive member 11, FIGS. 23B, 24B, 25B and 26B show a position at which the squeegee roller 151 is located, FIGS. 23C, 24C, 25C and 26C show a position at which the squeegee roller 152 is located, and FIGS. 23D, 24D, 25D and 26D show a position at which the squeegee roller 153 is located. In FIGS. 23A through 26D, the squeegee rollers at the contacting positions are denoted at the solid lines but those at the clear-off positions are denoted at the broken lines as in FIG. 19. Further, the photosensitive member 11 is shown as a flat plate for the convenience of illustration.

An image occupation ratio is a ratio of an image portion to an electrostatic latent image. The main controller 100 (FIG. 21) comprises a dot counter which counts an on-dot count which represents the number of pixels to which toner adheres among pixels which form an electrostatic latent image for example, and therefore, is equipped with a function of calculating, as an image occupation ratio, a ratio of an on-dot count to a dot count of an image as a whole. For instance, the image occupation ratio of a solid black image is 100% but is 0% in a solid white portion within an image (e.g., a blank portion within an image). Instead of the main controller 100, the engine controller 110 (FIG. 21) may comprise the dot counter.

Although the liquid developer 32 held in the tank 33 is a high-density liquid developer whose density is in the range from 5 to 40 wt % in this embodiment as described earlier, the toner density in the liquid developer 32 is set to 20% by volume (an initial value of the toner density) for instance which is a value within the above-mentioned toner density range. In addition, the thickness to of the toner 322 which adheres to the photosensitive member 11 during development is 2 μm and the thickness t2 of the carrier liquid 321 is 8 μm in FIG. 22. That is, the thickness (t1+t2) of the liquid developer 32 on the photosensitive member 11 is 10 μm.

Figure 23A:
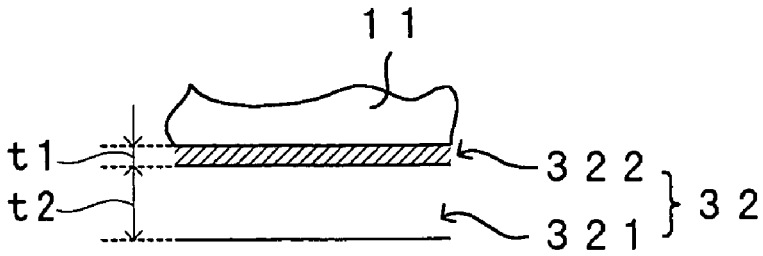
FIGS. 23A through 23D are drawings for describing a relationship between an image occupation ratio and a stripped amount of a carrier liquid.
Figure 23B:
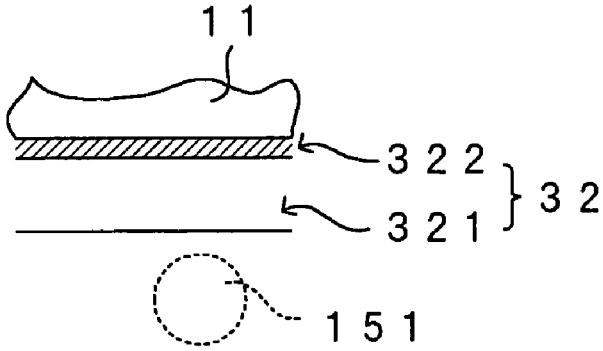
Figure 23C:
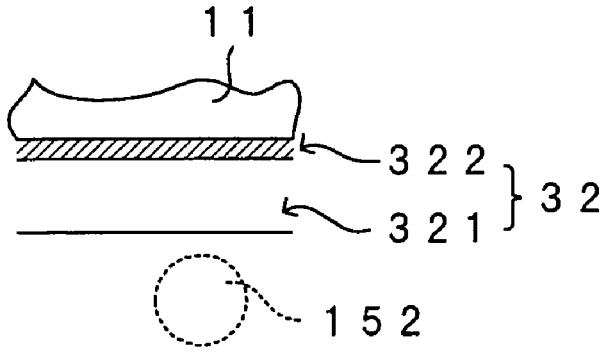
Figure 23D:
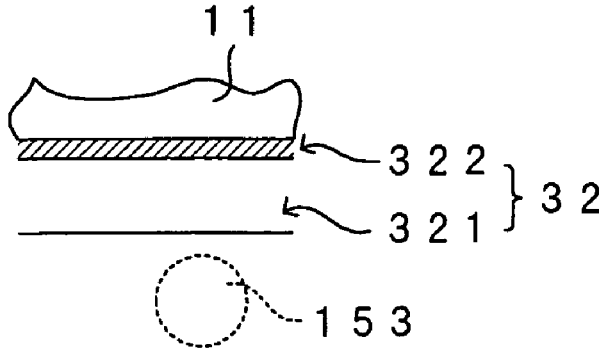

FIGS. 23A through 23D represent an example that an image occupation ratio is 100% (solid black image) as shown in FIG. 23A. In this case, the toner density in the liquid developer 32 which is on the photosensitive member 11 is 20% by volume (vol %) which is the same as the initial value of the toner density within the tank 33. Noting this, the squeegee rollers 151 through 153 are all moved to the clear-off positions as shown in FIGS. 23B through 23D, so as not to collect the carrier liquid 321. In short, a collection amount of the carrier liquid 321 is zero. Although this makes the liquid developer 32 on the photosensitive member 11 all consumed, since the toner density of thus consumed liquid developer is equal to the initial value of the liquid developer 32 of the toner density within the tank 33, the toner density within the tank 33 is maintained at the initial value of 20 vol %.

Figure 24A:
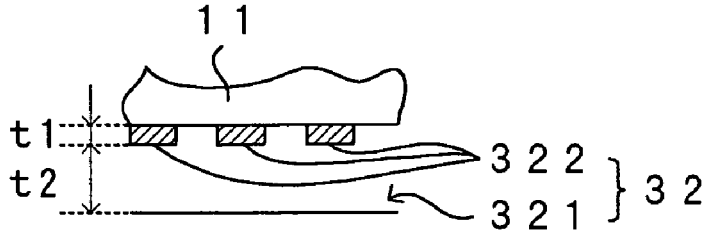
FIGS. 24A through 24D are drawings for describing a relationship between an image occupation ratio and a stripped amount of a carrier liquid.

FIGS. 24A through 24D represent an example that an image occupation ratio is 50% as shown in FIG. 24A for instance. In this case, the toner density in the liquid developer 32 which is on the photosensitive member 11 is 10 vol %, t1=2 μm and t2=8 μm hold truth. However, the thickness of the toner 322 on the average is 1 μm and the thickness of the carrier liquid 321 on the average is 9 μm. This means that more carrier liquid has moved to the photosensitive member 11 as compared with the example shown in FIGS. 23A through 23D.

Figure 24B:
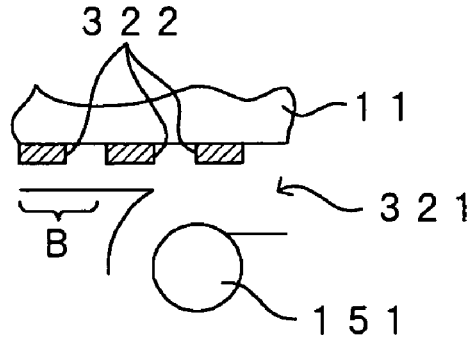

Noting this, the squeegee roller 151 is moved to the contacting position as shown in FIG. 24B, thereby stripping off approximately half the carrier liquid 321 which is in the surface layer. As a result, the thickness of the carrier liquid 321 on the average which remains in an area B in FIG. 24B, namely, the photosensitive member 11 is about 4.5 μm. The toner density in the liquid developer 32 within the area B is therefore about 18 vol % which is approximately equal to the toner density inside the tank 33.

Figure 24C:
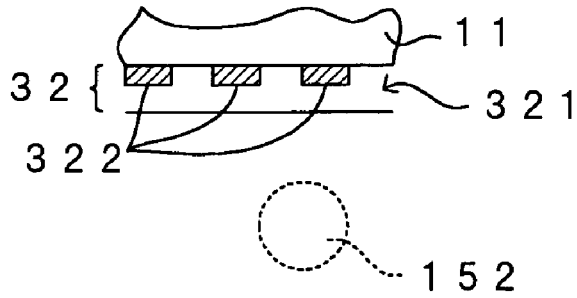
Figure 24D:
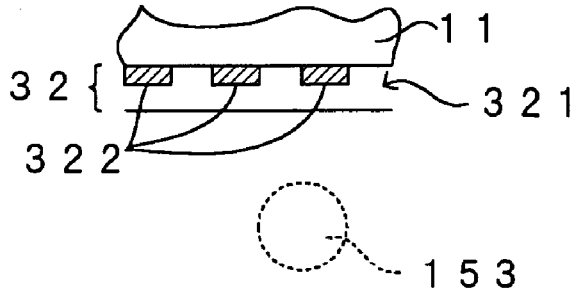

With the squeegee rollers 152 and 153 located at the clear-off positions as shown in FIGS. 24C and 24D, the toner density in the liquid developer 32 which remains on the photosensitive member 11 is maintained at about 18 vol %. In addition, although the toner density inside the tank 33 rose upon movement of a great amount of the carrier liquid 321 to the photosensitive member 11, the carrier liquid 321 taken away by the squeegee roller 151 is returned to the tank 33, the toner density inside the tank 33 decreases and becomes close to 20 vol % which is the initial value.

Figure 25A:
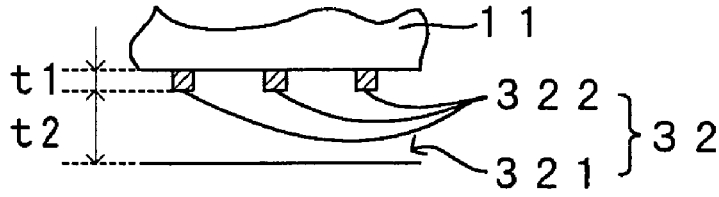
FIGS. 25A through 25D are drawings for describing a relationship between an image occupation ratio and a stripped amount of a carrier liquid.

FIGS. 25A through 25D represent an example that an image occupation ratio is 20% as shown in FIG. 25A. In this case, the toner density in the liquid developer 32 which is on the photosensitive member 11 is 4 vol %, t1=2 μm and t2=8 μm hold truth. However, the thickness of the toner 322 on the average is 0.4 μm and the thickness of the carrier liquid 321 on the average is 9.6 μm. This means that more carrier liquid has moved to the photosensitive member 11 as compared with the example shown in FIGS. 24A through 24D.

Figure 25B:
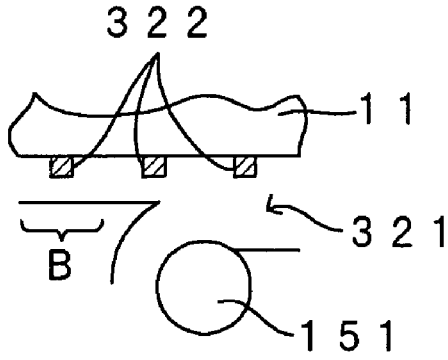
Figure 25C:
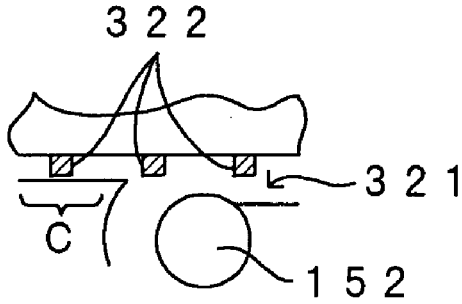
Figure 25D:
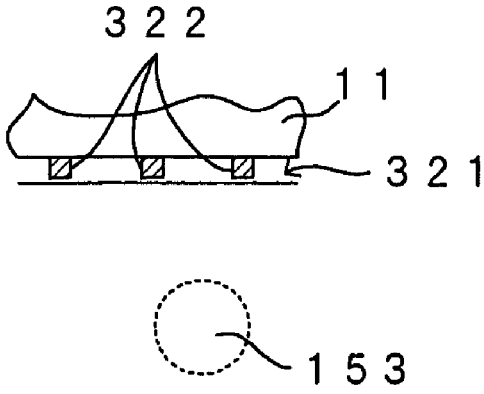

Noting this, the squeegee roller 151 is moved to the contacting position as shown in FIG. 25B, thereby stripping off approximately half the carrier liquid 321 which is in the surface layer. As a result, the thickness of the carrier liquid 321 on the average which remains on the photosensitive member 11 within an area B in FIG. 25B is about 4.8 μm and the toner density in the liquid developer 32 which is within the area B is about 7.7 vol %. Further, as shown in FIG. 25C, when the squeegee roller 152 is moved to the contacting position, thereby stripping off approximately half the carrier liquid 321 which is in the surface layer. In consequence, the thickness of the carrier liquid 321 on the average which remains on the photosensitive member 11 within an area C in FIG. 25C is about 2.4 μm. Hence, the toner density in the liquid developer 32 which is within the area C is about 14 vol %, thus becoming close to the toner density inside the tank 33. The squeegee roller 153 however is located at the clear-off position as shown in FIG. 25D and therefore does not take away the carrier liquid 321. This is because further stripping off of the carrier liquid 321 could adversely affect a toner image on the photosensitive member 11.

Hence, the toner density in the liquid developer 32 which remains on the photosensitive member 11 is about 14 vol %. Meanwhile, although the toner density inside the tank 33 rises upon movement of a great amount of the carrier liquid 321 to the photosensitive member 11, the toner density inside the tank 33 decreases and becomes close to 20 vol % which is the initial value as the carrier liquid 321 taken away by the squeegee rollers 151 and 152 is returned back to the tank 33.

Figure 26A:
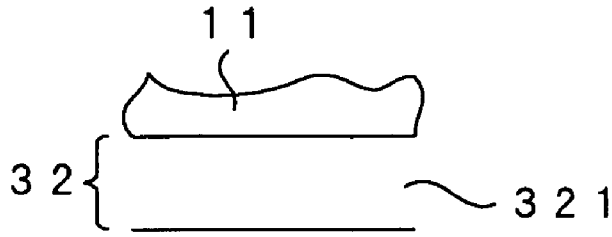
FIGS. 26A through 26D are drawings for describing a relationship between an image occupation ratio and a stripped amount of a carrier liquid.
Figure 26B:
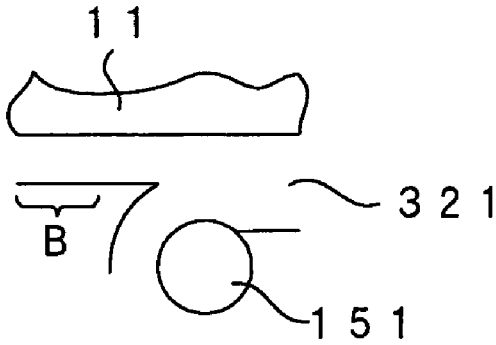
Figure 26C:
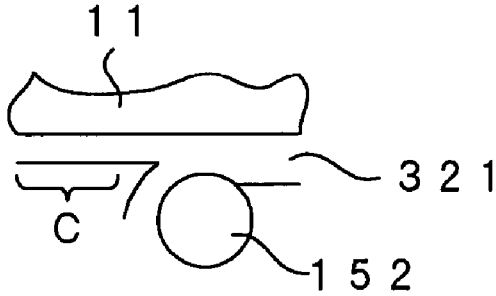
Figure 26D:
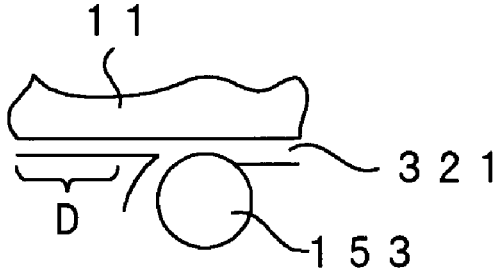

FIGS. 26A through 26D represent an example that an image occupation ratio is 0% (solid white image) as shown in FIG. 26A. In this case, the toner density in the liquid developer 32 which is on the photosensitive member 11 is 0 vol %, the carrier liquid 321 alone is consumed and the toner density inside the tank 33 increases. Noting this, as shown in FIGS. 26B through 26D, the squeegee rollers 151 through 153 are all moved to the contacting positions, thereby collecting the carrier liquid 321. The thickness within the area B after the stripping by the squeegee roller 151 is therefore about 5 μm, the thickness within the area C after the stripping by the squeegee roller 152 is about 2.5 μm, and the thickness within the area D after the stripping by the squeegee roller 153 is about 1.25 μm. As the carrier liquid 321 taken away by the respective squeegee rollers 151 through 153 is returned to the tank 33, an increase of the toner density inside the tank 33 is suppressed.

Figure 27:
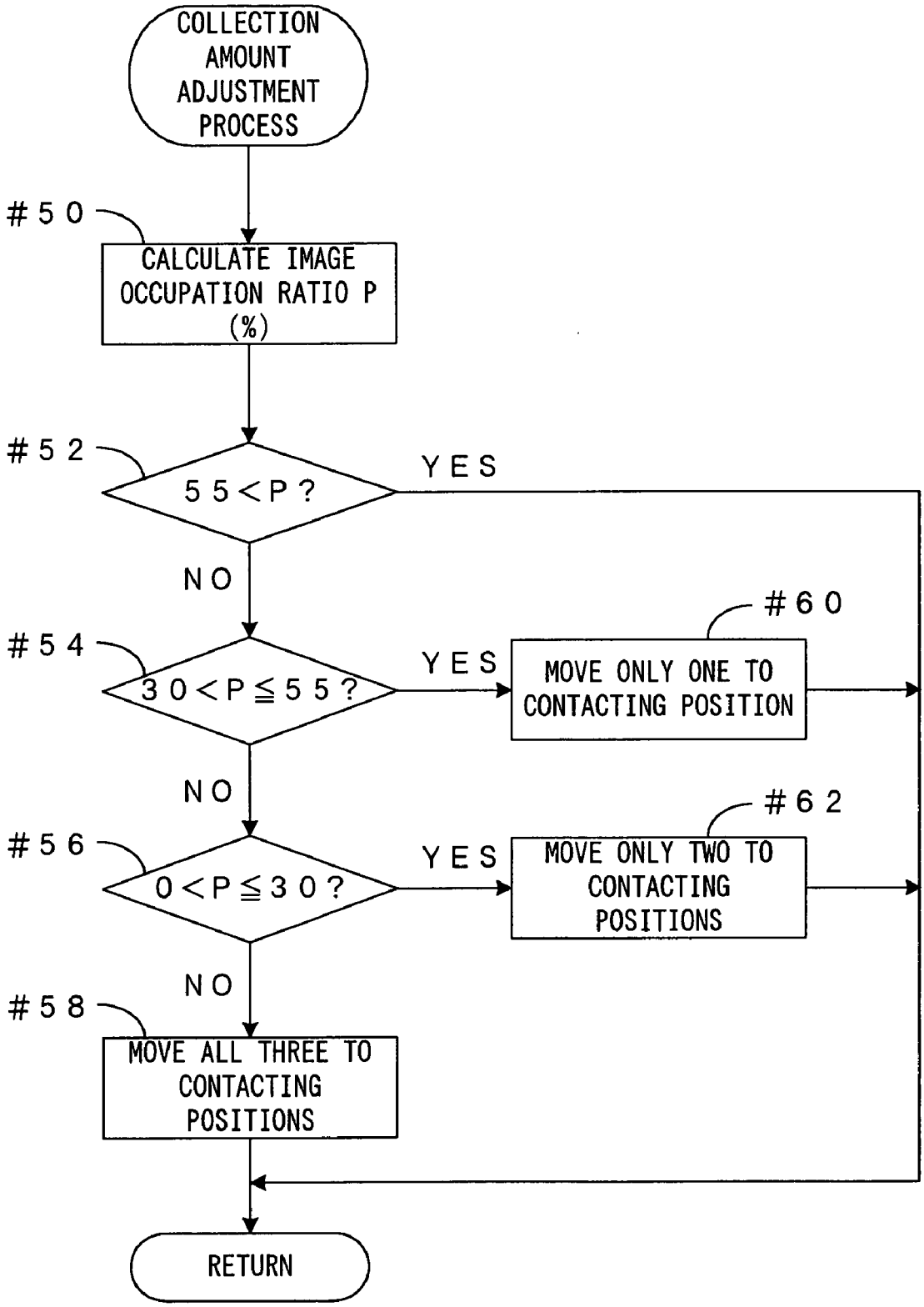
FIG. 27 is a flow chart which shows an example of a collection amount adjustment process routine.

FIG. 27 is a flow chart which shows an example of a collection amount adjustment process routine. A collection amount adjustment process program is stored in advance in the memory 116 of the engine controller 110. As the CPU 113 controls the respective portions of the apparatus in accordance with the program, the following collection amount adjustment process is executed.

First, an image occupation ratio P (%) which is a ratio of an image portion to an electrostatic latent image is calculated (#50), and the level of the calculated image occupation ratio is judged. That is, whether 55<P holds truth is determined (#52). When P≦55 holds truth (NO at #52), whether 30<P≦55 is determined (#54). When P≦30 holds truth (NO at #54), whether 0<P≦30 is determined (#56). Since P=0 holds truth when NO at #56, as described with reference to FIGS. 26A through 26D, the squeegee rollers 151 through 153 are all moved to the contacting positions (#58).

When 55<P holds truth (YES at #52), this means that the toner density on the photosensitive member 11 is high. Therefore, as described with reference to FIGS. 23A through 23D, this routine is terminated with the squeegee rollers 151 through 153 all kept at the clear-off positions. When 30<P≦55 holds truth (YES at #54), since this means that the toner density on the photosensitive member 11 is medium, the squeegee roller 151 for example is moved to the contacting position (#60) as described with reference to FIGS. 24A through 24D. Only one roller may be moved at this stage. Therefore, the squeegee roller 152 or 153 may be moved instead of the squeegee roller 151.

When 0<P≦30 holds truth (YES at #56), this means that the toner density on the photosensitive member 11 is low. Therefore, as described with reference to FIGS. 25A through 25D, the squeegee rollers 151 and 152 for example are moved to the contacting positions (#62). Since two rollers may be moved at this stage, the squeegee rollers 151 and 153 or the squeegee rollers 152 and 153 may be moved. The threshold values used to determine the level of the image occupation ratio at the steps #52, #54 and #56 are merely examples, and other values may be used instead.

Figure 28:
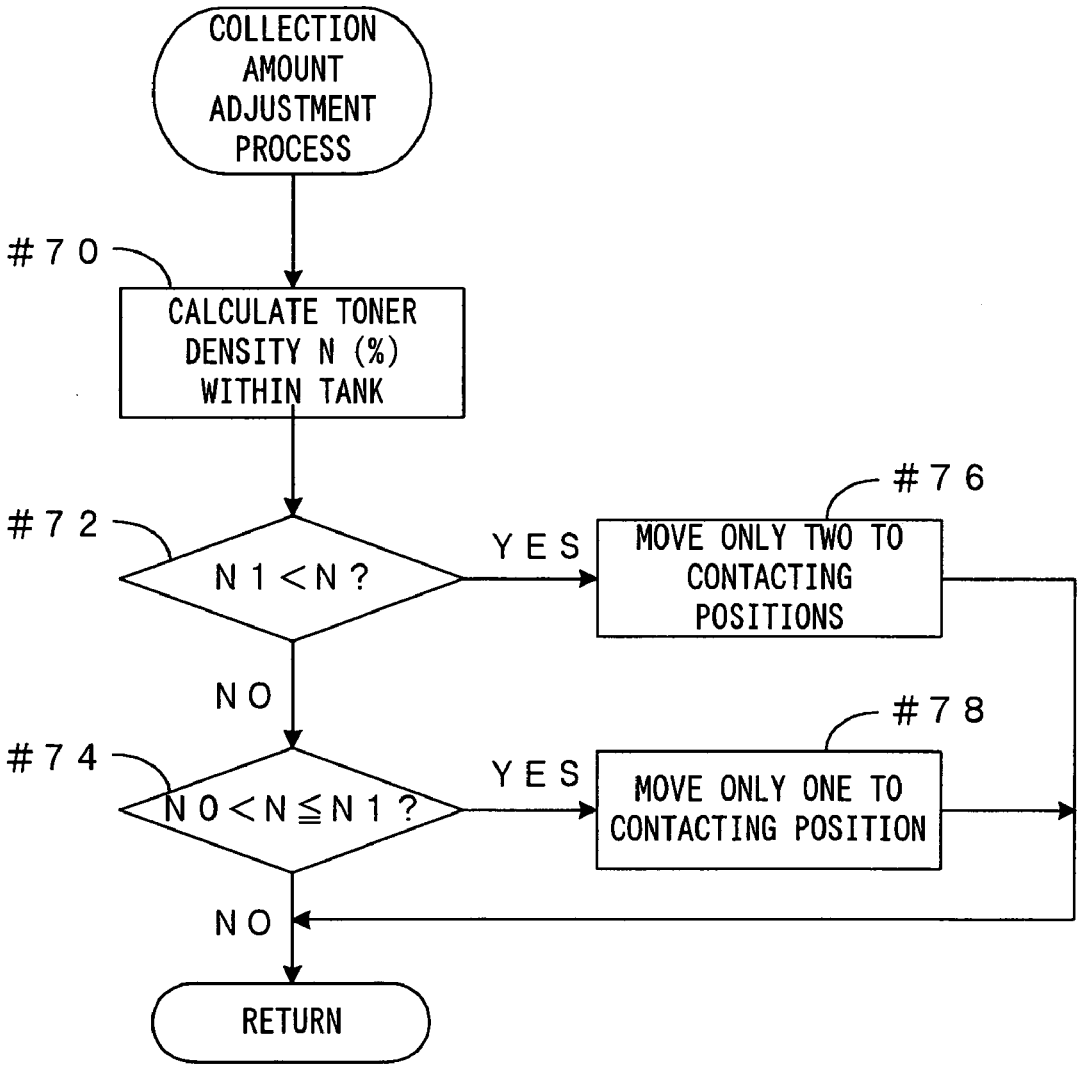
FIG. 28 is a flow chart which shows other example of the collection amount adjustment process routine.

FIG. 28 is a flow chart which shows other example of the collection amount adjustment process routine. During operations according to the illustrated example, the developer unit 30 comprises the viscometer 37 as denoted at the broken lines in FIG. 21. The viscometer 37 is disposed inside the tank 33, and the CPU 113 calculates a toner density based on the viscosity of the liquid developer 32 which is detected by the viscometer 37. Instead of the viscometer 37, a density sensor formed by a transmission-type optical sensor for example may be disposed inside the tank 33 and the sensor itself may detect the toner density in the liquid developer 32 which is within the tank 33. In this embodiment, the viscometer 37 thus corresponds to the "toner density detecting means" of the present invention.

First, the toner density N (%) in the liquid developer 32 which is within the tank 33 is calculated based on a detection signal obtained by the viscometer 37 (#70). A relationship between the viscosity of the liquid developer 32 which is detected by the viscometer 37 and the toner density in the liquid developer 32 is identified in the form of an arithmetic expression or table data in advance and contained in the program which is stored in the memory 116. The processing of calculating the toner density at #70 is executed based on the relationship described above.

Whether thus calculated toner density is N1<N is determined (#72). When N≦N1 holds truth (NO at #72), whether N0<N≦N1 is determined (#74). When N≦N0 holds truth (NO at #72), since this means that the toner density has dropped, this routine is terminated without collecting the carrier liquid. N0 is an initial value of the toner density in the liquid developer 32 which is within the tank 33, and N1 is a value which is calculated through experiments or the like in advance and satisfies the relationship N0<N1.

On the contrary, when N1<N holds truth (YES at #72), since this means that the toner density has largely increased, the squeegee rollers 151 and 152 for example are moved to the contacting positions (#76) as described with reference to FIGS. 25A through 25D. Since two rollers may be moved at this stage, the squeegee rollers 151 and 153 or the squeegee rollers 152 and 153 may be moved to the contacting positions.

Further, when N0<N≦N1 holds truth (YES at #74), the toner density has just slightly increased. Therefore, the squeegee roller 151 for instance is moved to the contacting position (#78) as described with reference to FIGS. 24A through 24D. Since only one roller may be moved at this stage, the squeegee roller 152 or 153 may be moved to the contacting position instead of the squeegee roller 151.

Alternatively, values of the viscosity of the liquid developer 32 which correspond to comparison values of the toner density in the liquid developer 32 (N0 and N1 in FIG. 28)

may be identified and stored in the memory 116 in advance based on the relationship between the viscosity of the liquid developer 32 which is detected by the viscometer 37 and the toner density in the liquid developer 32, and the detected viscosity may be compared with a corresponding value directly, to thereby make the judgments at the steps #72 and #74 in FIG. 28.

As described above, the sixth preferred embodiment uses the squeegee rollers 151 through 153 which can move to the contacting positions which are in contact with the liquid developer 32 which is on the photosensitive member 11 and the clear-off positions which are not in contact with the liquid developer 32 which is on the photosensitive member 11, and a combination of the squeegee rollers 151 through 153 which are moved to the contacting positions is controlled. Hence, it is possible to control a stripped amount of the carrier liquid 321 which is stripped off from the photosensitive member 11. This permits to adjust a collection amount of the carrier liquid 321 which is collected from the photosensitive member 11. Since the carrier liquid 321 which has been taken away by the squeegee rollers 151 through 153 is all scraped off by the cleaning blades 154 and returned back to the tank 33, it is possible through the collection amount adjustment described above to adjust the amount of the carrier liquid 321 which is returned back to the tank 33.

In addition, since the opening of the tank 33 stretches out toward below the positions at which the respective cleaning blades 154 abut on the squeegee rollers 151 through 153 and the carrier liquid 321 scraped off from the squeegee rollers 151 through 153 by the cleaning blades 154 returns by its own weight to the tank 33 according to this embodiment. Hence, it is not necessary to separately dispose a collection tank and install a pipe or the like which is for returning the carrier liquid 321 to the tank 33 from the collection tank. In addition, it is possible to simplify the structure of the apparatus and reduce the size of the apparatus. Further, as thus stripped carrier liquid 321 is returned back to the tank 33, it is possible to make an effective use of the carrier liquid 321 and minimize the amount of the carrier liquid 321 which is replenished.

During the operations shown in FIG. 27, an image occupation ratio is calculated, a stripped amount of the carrier liquid 321 is controlled such that the toner density in the liquid developer 32 which remains on the photosensitive member 11 after collection will be close to the initial value of the toner density in the liquid developer 32 which is within the tank 33, and the carrier liquid 321 taken away by the squeegee rollers 151 through 153 is all scraped off by the cleaning blades 154 and returned back to the tank 33. Hence, it is possible to suppress a toner density change in the liquid developer 32 inside the tank 33 and maintain the toner density at the initial value. This permits to use the liquid developer 32 held in the tank 33 to the very end without wasting, and minimizes the amount of a carrier liquid, toner or the like replenished from outside. In the case of the operations shown in FIG. 27, since the toner density detecting means, such as the viscometer 37, of the tank 33 is not needed, there is an advantage that it is possible to simplify the structure of the apparatus as compared with the example shown in FIG. 28.

Further, during the operations shown in FIG. 28, the toner density inside the tank 33 is calculated based on a detection value obtained by the viscometer 37, a stripped amount of the carrier liquid which has been stripped off from the photosensitive member 11 is controlled based on the detection value, and thus stripped carrier liquid is returned to the tank 33. Hence, it is possible to suppress a toner density change within the tank 33 and maintain the toner density at the initial value. This permits to use the liquid developer 32 held in the tank 33 to the very end without wasting, and minimizes the amount of a carrier liquid, toner or the like replenished from outside.

<Modification of Sixth Preferred Embodiment>

The present invention is not limited to the sixth preferred embodiment described above, but may be modified in various manners in addition to the sixth preferred embodiment described above, to the extent not deviating from the object of the invention. For instance, the following modifications (1) through (4) may be implemented.

(1) Although the preferred embodiment described above requires that a collection amount of the carrier liquid 321 is adjusted and the collected carrier liquid 321 is all returned back to the tank 33, this is not limiting. Instead, the carrier liquid 321 may be stripped off as much as possible to the extent that the stripped amount of the carrier liquid 321 remains constant, e.g., to the extent not adversely influencing a toner image, and the amount of the carrier liquid 321 which is returned to the tank 33 may be adjusted in accordance with an image occupation ratio (FIG. 27), a toner density (FIG. 28), etc.

(2) While the squeegee rollers 151 through 153 are disposed facing the area on the photosensitive member 11 which is located between the developing position 16 and the primary transfer position 44, namely, a developed image carrying area in which a toner image is carried according to the preferred embodiment described above, and the carrier liquid is stripped off from the photosensitive member 11 prior to primary transfer, this is not limiting. For example, the squeegee rollers 151 through 153 may be disposed facing an area between the primary transfer position 44 for the photosensitive member 11 and the cleaner 14 to thereby strip the photosensitive member 11 of the carrier liquid after primary transfer. Alternatively, the squeegee rollers 151 through 153 may be disposed facing an area between the primary transfer position 44 for the intermediate transfer roller 41 and the secondary transfer position 45 to thereby strip a primarily transferred toner image on the intermediate transfer roller 41 of the carrier liquid for instance. Further, alternatively, the squeegee rollers 151 through 153 may be disposed facing an area between the secondary transfer position 45 for the intermediate transfer roller 41 and the cleaner 43 to thereby strip the intermediate transfer roller 41 of the carrier liquid after secondary transfer.

As described above, positions at which the squeegee rollers 151 through 153 strip off the carrier liquid are not limited. However, as described earlier with reference to FIG. 22, the carrier liquid is separated approximately to half when moving from one roller to another, and the amount of the carrier liquid which can be stripped off decreases as the carrier liquid moves from one roller to another. According to the preferred embodiment described above therefore which requires to strip the photosensitive member 11 of the carrier liquid before primary transfer, it is possible to strip off the greatest amount of the carrier liquid. The preferred embodiment described above is most preferable in this aspect.

(3) During the operations shown in FIG. 27 according to the preferred embodiment described above, it is not possible to sufficiently collect the carrier liquid in an area where an image occupation ratio is low, and the toner density within the tank 33 tends to increase. That is, as shown in FIG. 25A for instance, since the thickness to of the toner 322 is 2 $\mu$m and the thickness t2 of the carrier liquid 321 is 8 $\mu$m, when the squeegee roller 153 is moved to the contacting position in FIG. 25D, a toner image could be adversely affected. Hence, as described earlier with reference to FIGS. 25A through 25D, when an image occupation ratio is 20%, the toner density in the liquid developer 32 which remains on the photosensitive member 11 becomes close to about 14 vol % but fails to reach 20 vol % which is the initial value.

Noting this, at the step #52 for instance, only one squeegee roller may be moved to the contacting position also when 55<P holds truth. This allows to increase a collection amount of the carrier liquid 321 and increase the amount of the carrier liquid 321 which is returned back to the tank 33, to suppress an increase in toner density within the tank 33 and maintain the toner density at the initial value as much as possible.

(4) Although the foregoing has described the preferred embodiment above in relation to a printer which prints on a transfer paper an image fed from an external apparatus such as a host computer, the present invention is not limited to this but is applicable to electrophotographic image forming apparatuses in general including copier machines, facsimile machines and the like. Further, the preferred embodiment above is an application of the present invention to an image forming apparatus which prints in monochrome, applications of the present invention are not limited to this. Rather, the present invention is applicable also to an image forming apparatus which prints in colors, in which case it is possible to adjust the amount of the carrier liquid on the photosensitive member which is returned back to the tank for each color in the event that the apparatus is of the so-called tandem type for instance which requires to dispose a photosensitive member unit, an exposure unit and a developer unit for each color and sequentially transfer on an intermediate transfer belt.

<Seventh Preferred Embodiment>

Figure 29:
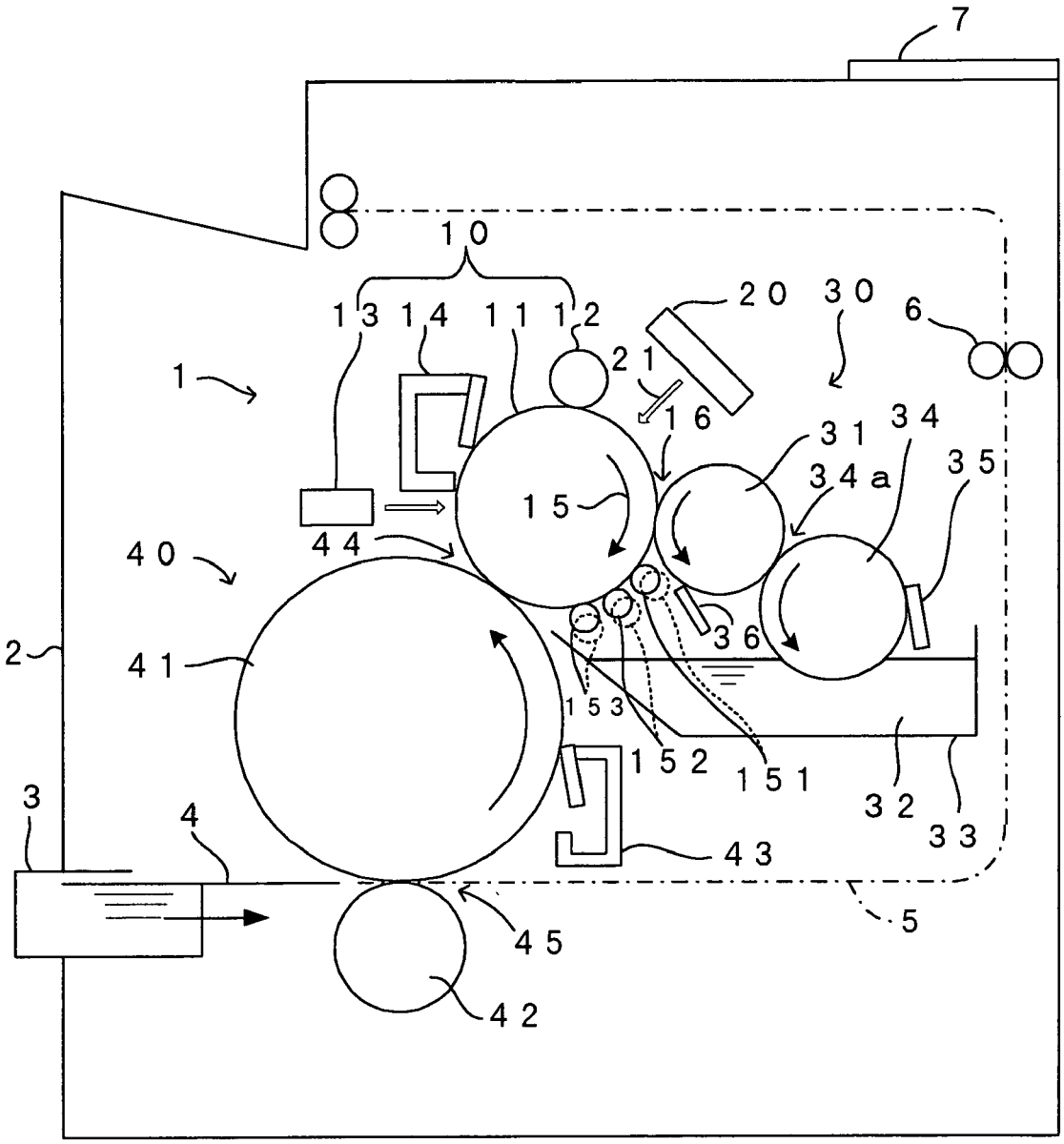
FIG. 29 is a drawing which shows an internal structure of a printer which is a seventh preferred embodiment of the present invention.
Figure 30:
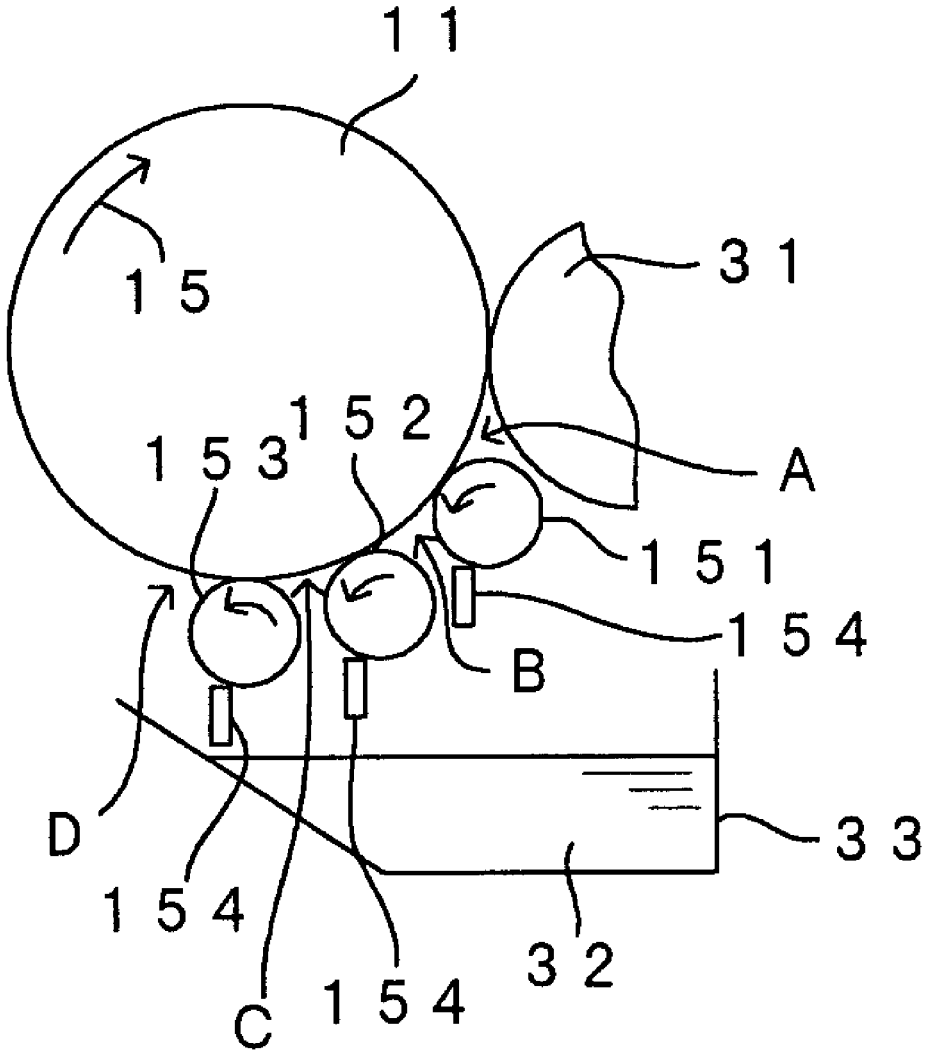
FIG. 30 is an expanded view of an essential section in FIG. 29.
Figure 31:
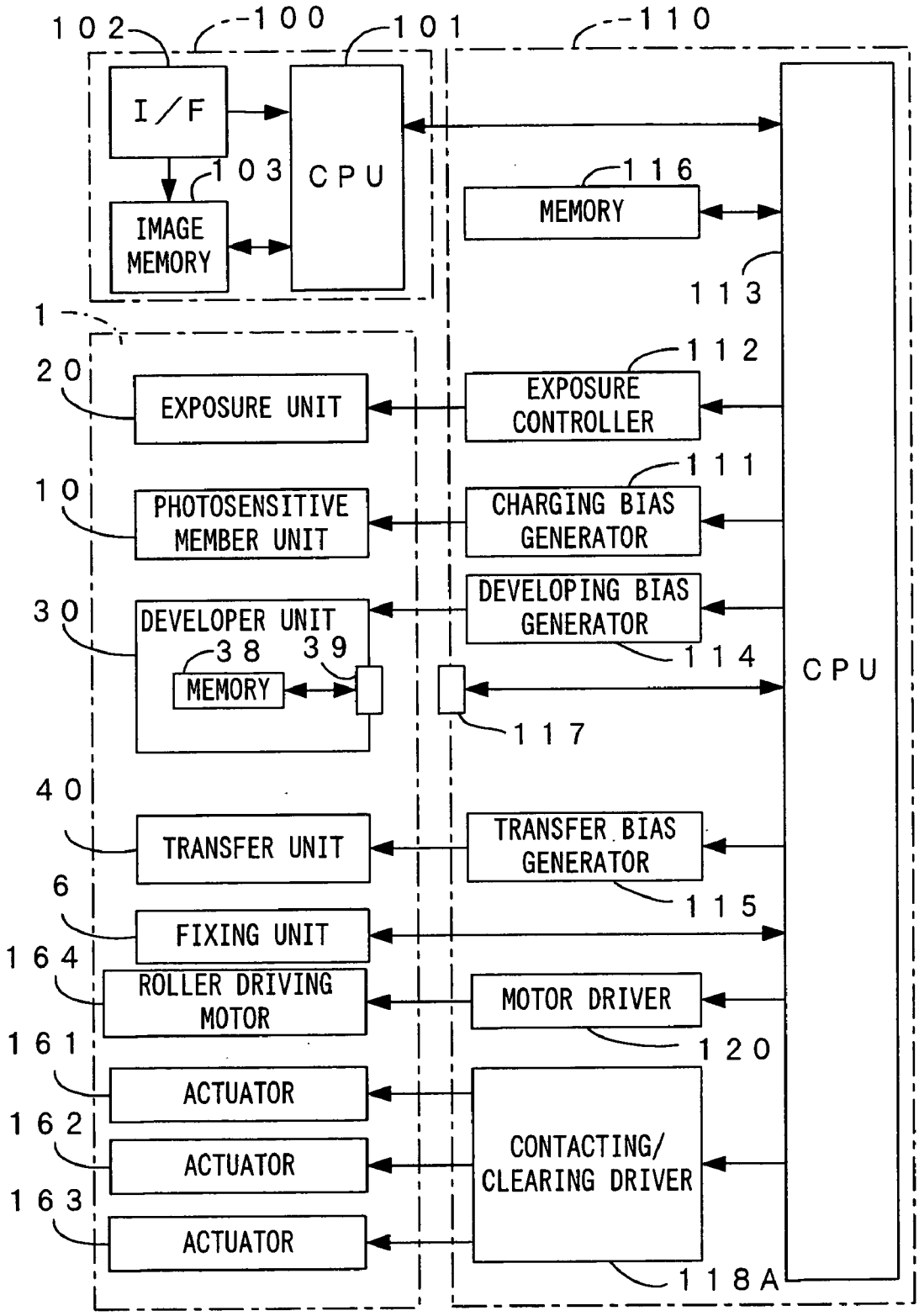
FIG. 31 is a block diagram which shows an electric structure of this printer.

FIG. 29 is a drawing which shows an internal structure of a printer which is a seventh preferred embodiment of the image forming apparatus according to the present invention, FIG. 30 is an expanded view of an essential section in FIG. 29, and FIG. 31 is a block diagram which shows an electric structure of this printer. The same elements as those according to the sixth preferred embodiment are denoted at the same reference symbols, and will not be described.

In the seventh preferred embodiment, too, the squeegee rollers 151, 152 and 153 are disposed around the photosensitive member 11 as in the sixth preferred embodiment. An arrangement and structures of the squeegee rollers 151, 152 and 153 are similar to those according to the sixth preferred embodiment which have been described with reference to FIGS. 19 and 20. Operations of stripping the photosensitive member 11 of the carrier liquid by the squeegee rollers 151 through 153 are similar to those according to the sixth preferred embodiment which have been described with reference to FIG. 22. A relationship between an image occupation ratio and a stripped amount of the carrier liquid is similar to that according to the sixth preferred embodiment which has been described with reference to FIGS. 23A through 26D.

In the seventh preferred embodiment, too, the cleaning blades 154 abut on the squeegee rollers 151, 152 and 153 as shown in FIG. 30, which is similar to that in the sixth preferred embodiment. Therefore, the respective cleaning blades 154 scrape off the carrier liquid stripped off from the photosensitive member 11 by the squeegee rollers 151, 152 and 153, and remove the carrier liquid from the squeegee rollers 151, 152 and 153. The opening of the tank 33 stretches out toward below the positions at which the respective cleaning blades 154 abut on the squeegee rollers 151, 152 and 153. Hence, the carrier liquid removed off from the squeegee rollers 151 through 153 by the cleaning blades 154 returns by its own weight to the tank 33.

As in the sixth preferred embodiment, toner contained in the liquid developer is charged positively for example, owing to a function of the electric charge control agent and the like. At the developing position 16 therefore, the liquid developer carried on the developer roller 31 is supplied from the developer roller 31 to the photosensitive member 11 and adheres to the photosensitive member 11, toner moves within the liquid developer toward the photosensitive member 11 from the developer roller 31 because of the developing bias Vb (e.g., Vb=DC+400 V) which is applied upon the developer roller 31 by the developing bias generator 114, and an electrostatic latent image is accordingly visualized. In addition, as in the sixth preferred embodiment, the cleaning blade 36 scrapes off the liquid developer which remains on the developer roller 31 without adhering to the photosensitive member 11, and the liquid developer returns by its own weight back to the tank 33. In this embodiment, the photosensitive member 11 thus corresponds to the "image carrier" of the present invention, the developer roller 31 thus corresponds to the "liquid developer carrier" of the present invention, the tank 33 thus corresponds to the "container" of the present invention, and the transfer bias generator 115 thus corresponds to the "transfer means" of the present invention.

Figure 32:
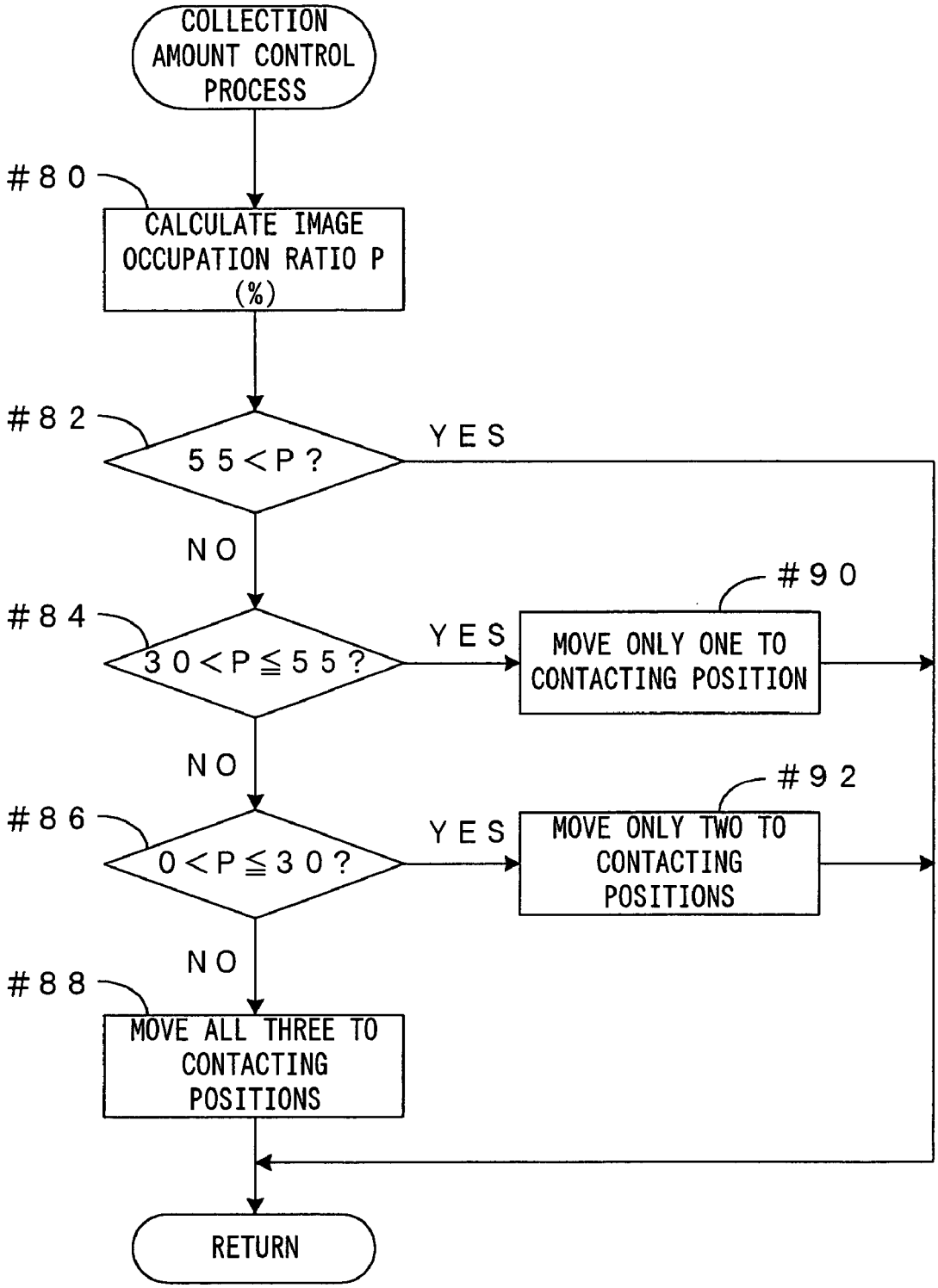
FIG. 32 is a flow chart which shows an example of a collection amount control process routine.

FIG. 32 is a flow chart which shows an example of a collection amount control process routine. A collection amount control process program is stored in advance in the memory 116 of the engine controller 110. As the CPU 113 controls the respective portions of the apparatus in accordance with the program, the following collection amount control process is executed.

First, an image occupation ratio P (%) which is a ratio of an image portion to an electrostatic latent image is calculated (#80), and the level of the calculated image occupation ratio is judged. That is, whether 55<P holds truth is determined (#82). When P≦55 holds truth (NO at #82), whether 30<P≦55 is determined (#84). When P≦30 holds truth (NO at #84), whether 0<P≦30 is determined (#86). Since P=0 holds truth when NO at #86, as described with reference to FIGS. 26A through 26D, the squeegee rollers 151 through 153 are all moved to the contacting positions (#88).

When 55<P holds truth (YES at #82), this means that the toner density on the photosensitive member 11 is high. Therefore, as described with reference to FIGS. 23A through 23D, this routine is terminated with the squeegee rollers 151 through 153 all kept at the clear-off positions. When 30<P≦55 holds truth (YES at #84), since this means that the toner density on the photosensitive member 11 is medium, the squeegee roller 151 for example is moved to the contacting position (#120) as described with reference to FIGS. 24A through 24D. Only one roller may be moved at this stage. Therefore, the squeegee roller 152 or 153 may be moved instead of the squeegee roller 151.

When 0<P≦30 holds truth (YES at #86), this means that the toner density on the photosensitive member 11 is low. Therefore, as described with reference to FIGS. 25A through 25D, the squeegee rollers 151 and 152 for example are moved to the contacting positions (#122). Since two rollers may be moved at this stage, the squeegee rollers 151 and 153 or the squeegee rollers 152 and 153 may be moved. The threshold values used to determine the level of the image occupation ratio at the steps #82, #84 and #86 are merely examples, and other values may be used instead.

As described above, the seventh preferred embodiment uses the squeegee rollers 151 through 153 which can move between the contacting positions which are on the liquid developer 32 which is on the photosensitive member 11 and the clear-off positions which are off the liquid developer 32 which is on the photosensitive member 11 and a combination of the squeegee rollers 151 through 153 which are moved to the contacting positions is controlled. Hence, it is possible to control a stripped amount (collection amount) of the carrier liquid 321 which is stripped off from the photosensitive member 11. This permits to adjust the amount of the carrier liquid 321 which is consumed for formation of a toner image. As a result, it is possible to obviate a wasteful consumption of the carrier liquid 321 and form an excellent toner image.

In addition, the opening of the tank 33 stretches out toward below the positions at which the respective cleaning blades 154 abut on the squeegee rollers 151 through 153 and the carrier liquid 321 removed off from the squeegee rollers 151 through 153 by the cleaning blades 154 returns by its own weight to the tank 33 according to this embodiment. Hence, it is not necessary to separately dispose a collection tank and install a pipe or the like which is for returning the carrier liquid 321 to the tank 33 from the collection tank. In addition, it is possible to simplify the structure of the apparatus and reduce the size of the apparatus. Further, as thus stripped carrier liquid 321 is returned back to the tank 33, it is possible to make an effective use of the carrier liquid 321 and minimize the amount of the carrier liquid 321 which is replenished.

Further, in the seventh preferred embodiment, the squeegee rollers 151 through 153 are disposed facing the area on the photosensitive member 11 which is located between the developing position 16 and the primary transfer position 44, namely, a developed image carrying area in which a toner image is carried. The photosensitive member 11 is therefore stripped of the carrier liquid 321 before primary transfer. An image occupation ratio is calculated, and a stripped amount of the carrier liquid is controlled so that the toner density in the liquid developer which remains on the photosensitive member 11 after collection will become close to a predetermined value (which is the initial value of the toner density within the tank 33 in the seventh preferred embodiment). Hence, it is possible to ensure that a transfer condition for primary transfer, i.e., the toner density in the liquid developer always stays approximately the same, which in turn favorably realizes primary transfer.

<Eighth Preferred Embodiment>

Figure 33:
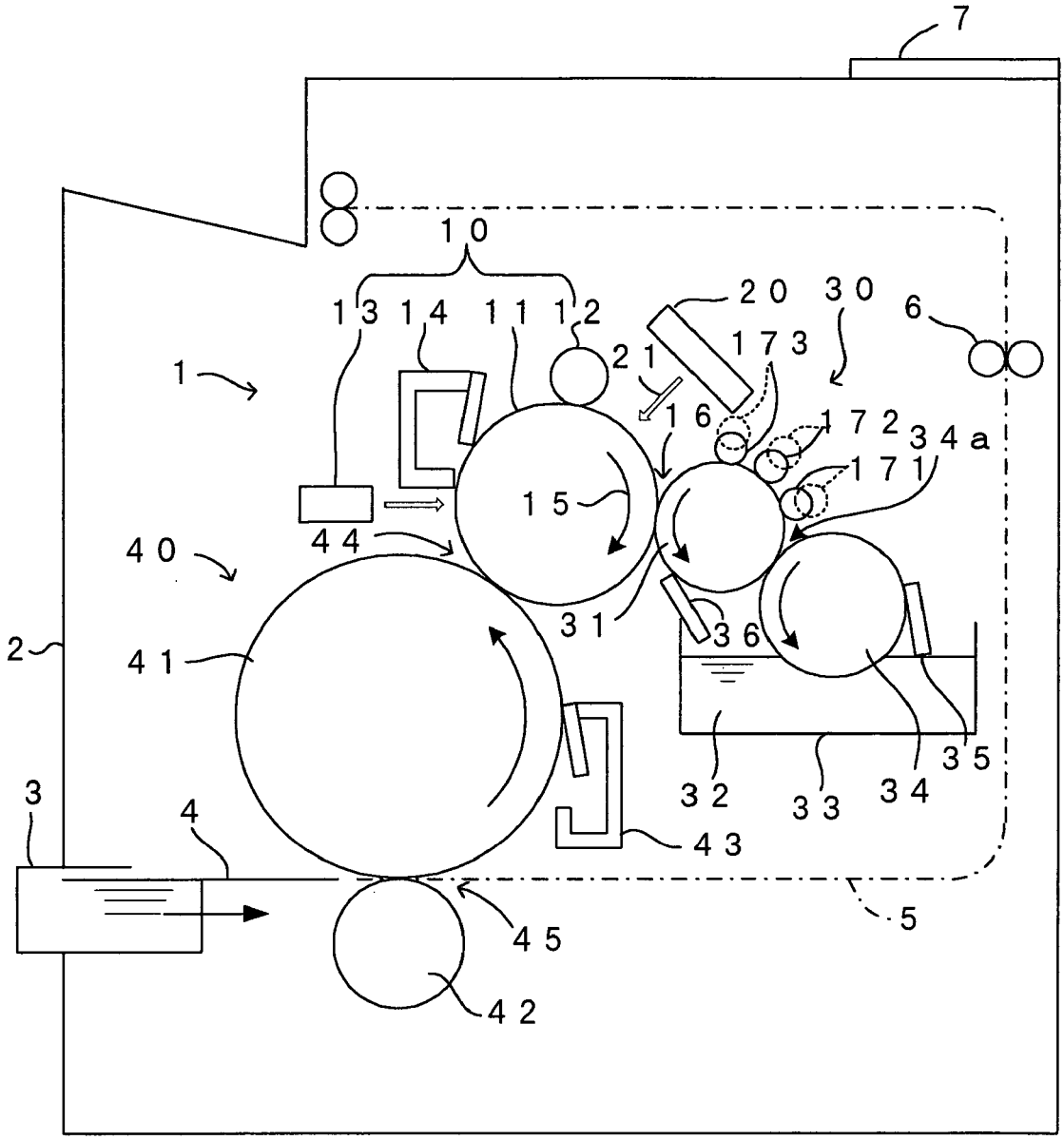
FIG. 33 is a drawing which shows a structure of a printer which is an eighth preferred embodiment of the present invention.
Figure 34:
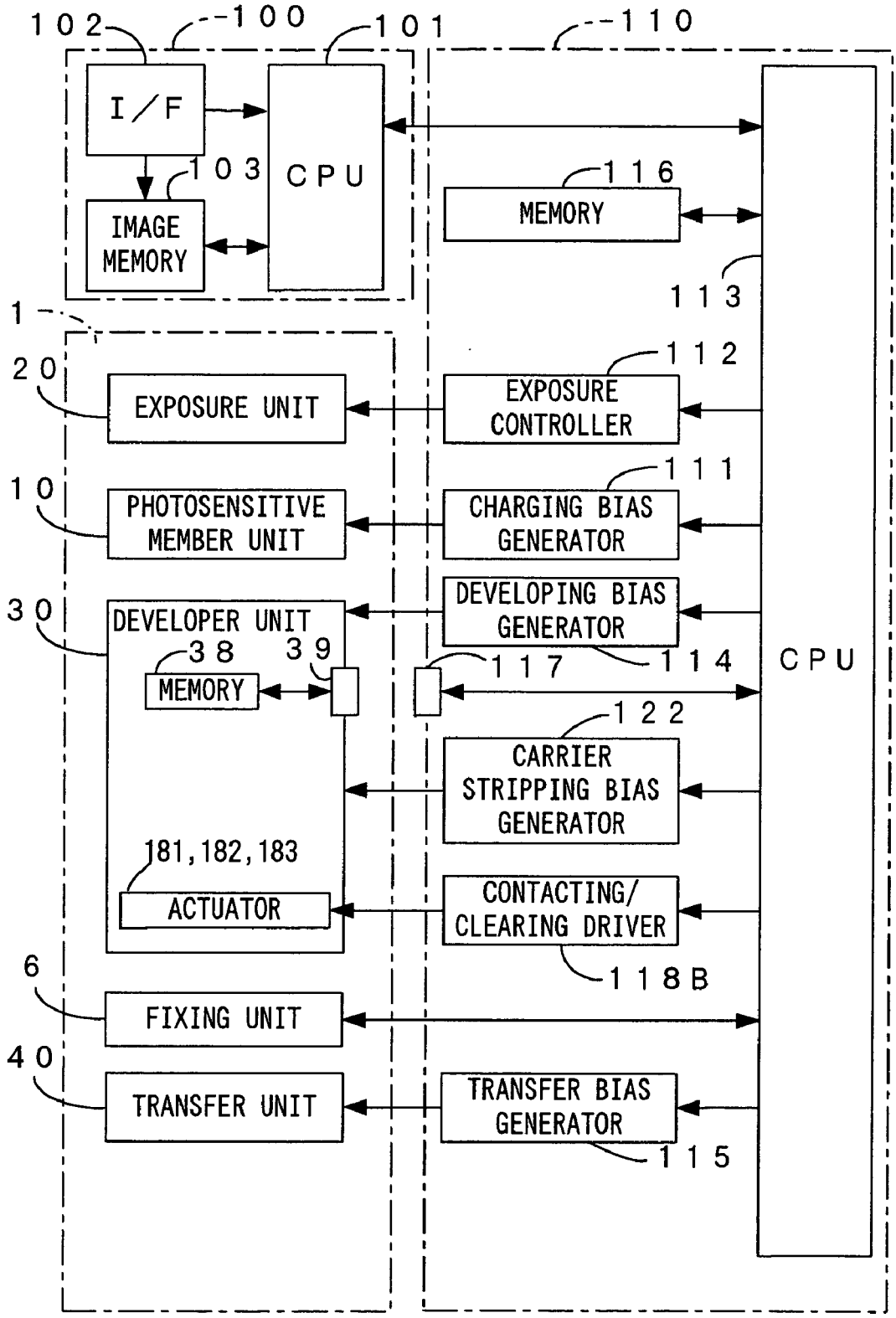
FIG. 34 is a block diagram which shows an electric structure of this printer.

FIG. 33 is a drawing which shows a structure of a printer which is an eighth preferred embodiment of the image forming apparatus according to the present invention, and FIG. 34 is a block diagram which shows an electric structure of this printer. In FIGS. 33 and 34, the same elements as those according to the seventh preferred embodiment are denoted at the same reference symbols. As shown in FIG. 33, the printer according to the eighth preferred embodiment comprises squeegee rollers 171, 172 and 173 which are disposed facing the developer roller 31, instead of the squeegee rollers which are disposed facing the photosensitive member 11 in the seventh preferred embodiment. In short, in the developer unit 30 according to the eighth preferred embodiment, between the coating position 34*a*, at which the coating roller 34 supplies the liquid developer to the developer roller 31, and the developing position 16, the squeegee rollers 171, 172 and 173 are arranged along the rotation direction of the developer roller 31 (i.e., a direction in which the liquid developer is transported) and disposed facing the developer roller 31.

The squeegee rollers 171, 172 and 173 are supported in such a manner that the squeegee rollers 171, 172 and 173 can move in a direction closer to and away from the developer roller 31. That is, when a contacting/clearing driver 118B (FIG. 34) drives actuators 181, 182 and 183 (FIG. 34) which are formed by solenoids, motors or the like for instance, the squeegee rollers 171, 172 and 173 reciprocally move between contacting positions (denoted at the solid lines in FIG. 33) and clear-off positions (denoted at the broken lines in FIG. 33). The contacting positions are such positions at which the squeegee rollers 171, 172 and 173 contact the liquid developer which is carried on the developer roller 31. The clear-off positions are such positions at which the squeegee rollers 171, 172 and 173 remain not in contact with the above-mentioned liquid developer. The squeegee rollers 171, 172 and 173 rotate approximately at the same circumferential speed as the developer roller 31 in a direction which follows the developer roller 31 (the clockwise direction in FIG. 33). The squeegee rollers 171, 172 and 173 strip off the carrier liquid 321 of the liquid developer 32 which is carried on the surface of the developer roller 31.

Figure 35:
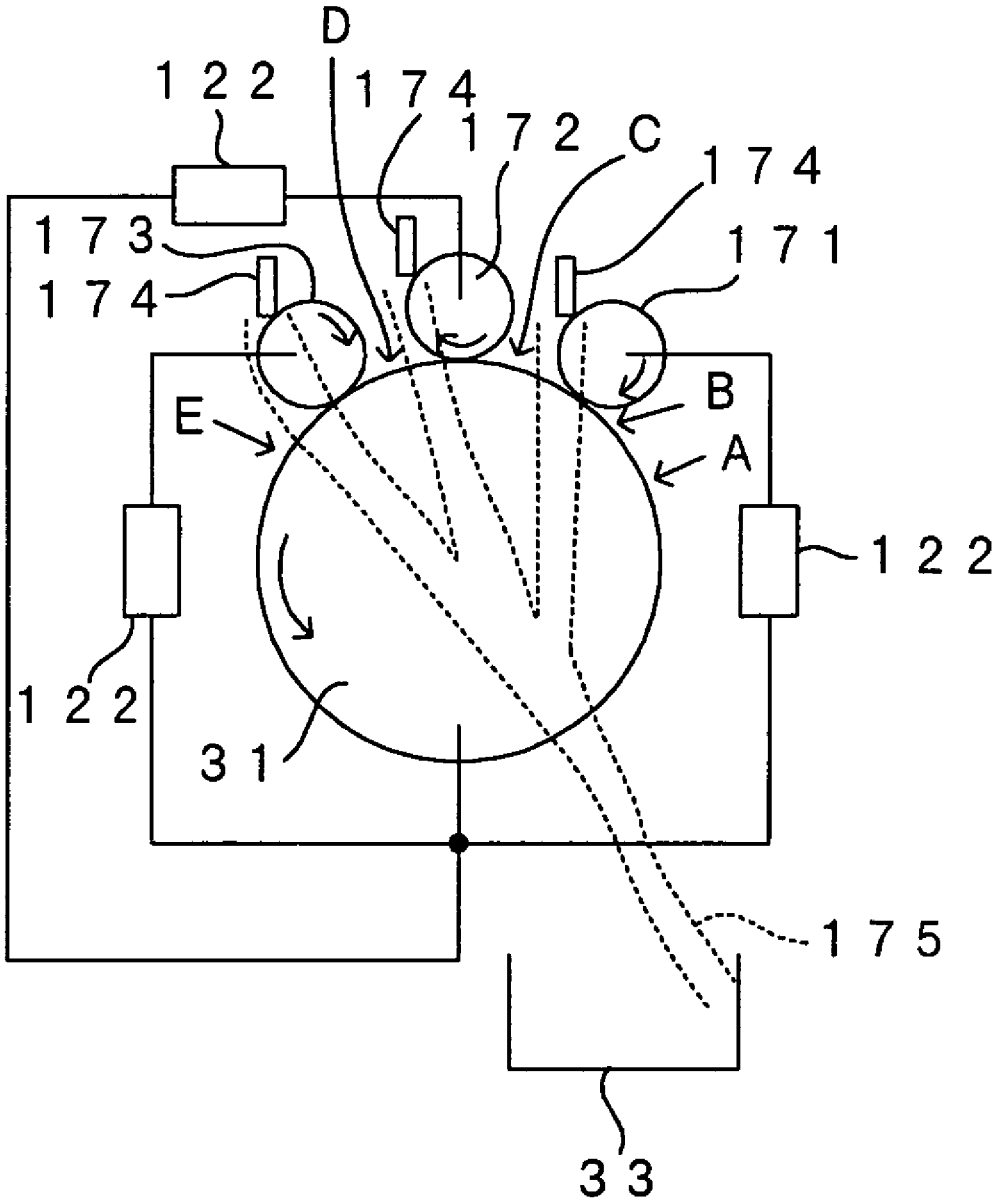
FIG. 35 is a drawing which schematically shows structures of squeegee rollers and a developer roller.
Figure 36:
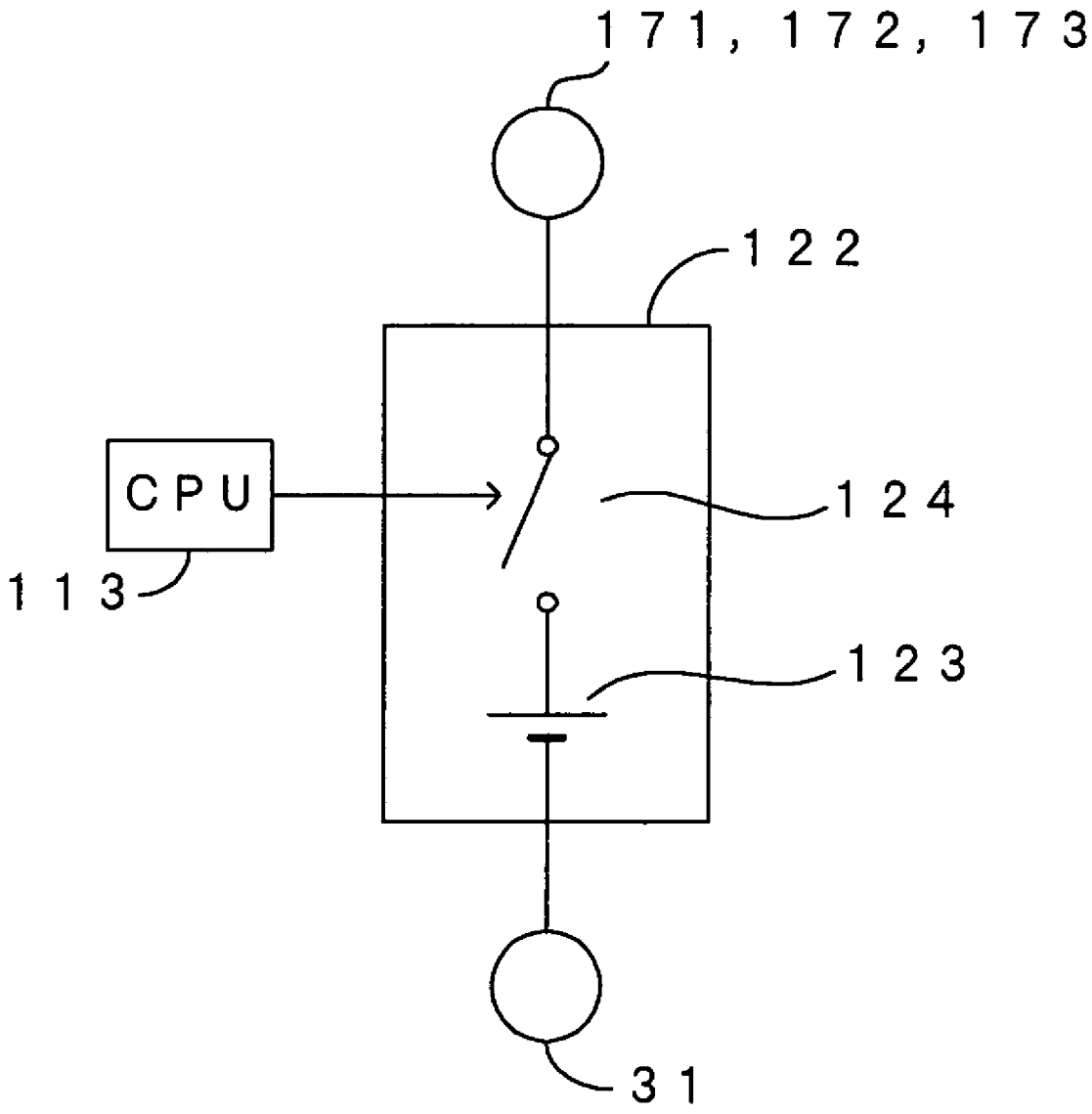
FIG. 36 is a circuitry diagram of a carrier stripping bias generator.

FIG. 35 is a drawing which schematically shows structures of squeegee rollers and a developer roller, and FIG. 36 is a circuitry diagram of a carrier stripping bias generator. As shown in FIG. 35, carrier stripping bias generators 122 are connected between the developer roller 31 and the respective squeegee rollers 171, 172 and 173. The carrier stripping bias generators 122 comprise bias power source parts 123 and switches 124 which turn on and off the bias power source parts 123 in accordance with a control signal fed from the CPU 113 as shown in FIG. 36.

The bias power source part 123 is turned on, thereby applying a bias voltage which makes positively charged toner move from an upper roller connected with the carrier stripping bias generator 122 (i.e., the squeegee rollers 171 through 173) toward a lower roller (i.e., the developer roller 31) in FIG. 36. A function that the squeegee rollers 171 through 173 strip off the carrier liquid will now be described with reference to FIGS. 37 and 38A through 38D.

Figure 37:
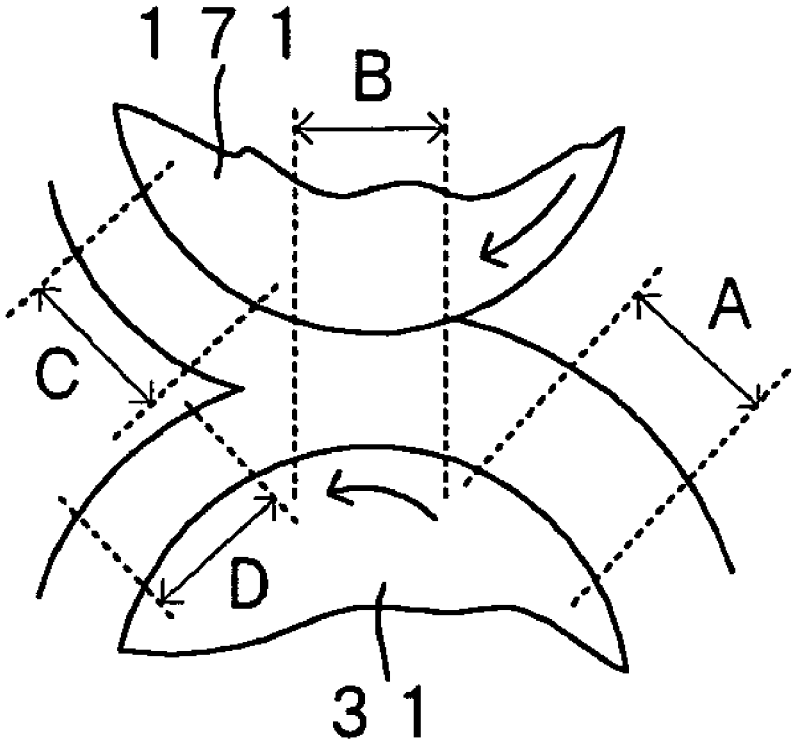
FIG. 37 is a drawing for describing movement of a carrier liquid between two rollers.

FIG. 37 is a drawing for describing movement of the carrier liquid between two rollers (which are the squeegee roller 171 and the developer roller 31). FIGS. 38A through 38D are drawings which show a liquid developer layer as it is in each area in FIG. 37 upon turning on of the bias power source parts 123 by the switches 124. FIGS. 38A, 38B, 38C and 38D correspond respectively to areas A, B, C and D shown in FIG. 37.

Figure 38A:
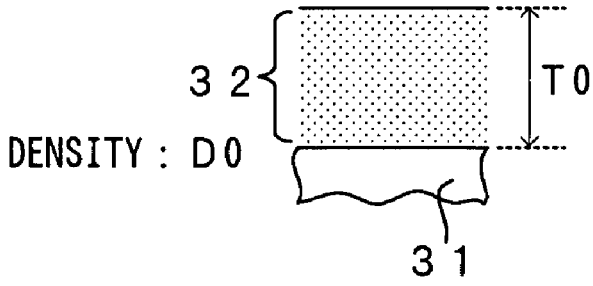
FIGS. 38A through 38D are drawings which show a liquid developer layer as it is in each area in FIG. 37.

In FIG. 37, the liquid developer layer in the area A is in such a state that the coating roller 34 has supplied the liquid developer 32 to the developer roller 31. In other words, the area A carries the liquid developer 32 whose thickness is T0 and toner density is D0 for instance, as shown in FIG. 38A. The liquid developer layer in the area B is in such a state that the liquid developer on the developer roller 31 is in contact with the squeegee roller 171 and is nipped between the two rollers 31 and 171. In the area B, the layer of the liquid developer nipped between the two rollers 31 and 171 gets separated as the rollers 31 and 171 rotate, thereby creating a liquid developer layer within the area C on the roller 171 side and a liquid developer layer within the area D on the roller 31 side.

Figure 38B:
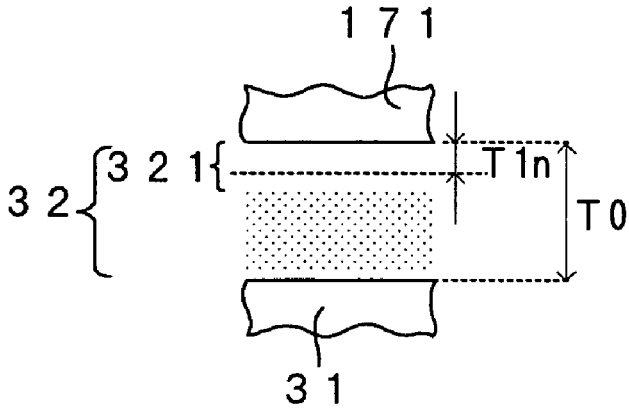
Figure 38C:
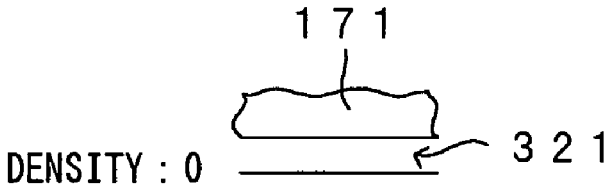
Figure 38D:
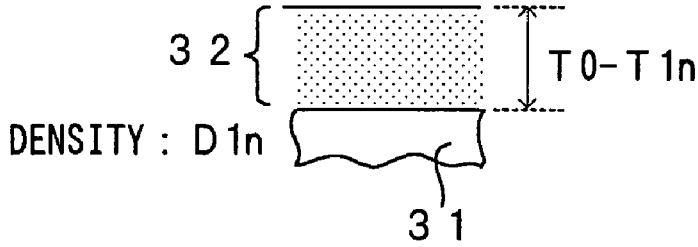

The area B is applied with a bias voltage which makes positively charged toner move from the squeegee roller 171 toward the developer roller 31 as described above. Hence, as shown in FIG. 38B, a toner density in a portion contacting the developer roller 31 is the highest but the toner density decreases gradually with a distance away from the developer roller 31. In a portion contacting the squeegee roller 171, a layer of the carrier liquid 321 which does not contain toner is created. It is considered that since a layer of the carrier liquid 321 which does not contain toner has the lowest viscosity, the liquid developer 32 is separated within this layer of the carrier liquid 321. Assuming therefore that the separation has occurred at a position denoted at the broken line in FIG. 38B, the carrier liquid 321 whose thickness is T1*n* and toner density is zero moves toward the squeegee roller 171 within the area C as shown in FIG. 38C. Meanwhile, in the area D as shown in FIG. 38D, the thickness of the liquid developer 32 is (T0−T1*n*) and the toner density in the liquid developer 32 is D1*n*=D0·T0/(T0−T1*n*) and hence D1*n*>D0 holds truth, whereby the liquid developer 32 whose toner density is higher than the density at the time of coating is carried by the developer roller 31.

While the foregoing has described the squeegee roller 171 with reference to FIGS. 37 and 38A through 38D, exactly the same description applies to the squeegee rollers 172 and 173. For instance, when all bias power source parts 123 of the carrier stripping bias generators 122 which are connected respectively to the squeegee rollers 171, 172 and 173 are turned on in FIG. 35, the layer of the liquid developer 32 on the developer roller 31 in the respective areas A, B, C, D and E shown in FIG. 35 becomes as shown in FIGS. 39A, 39B, 39C, 39D and 39E.

Figure 39A:
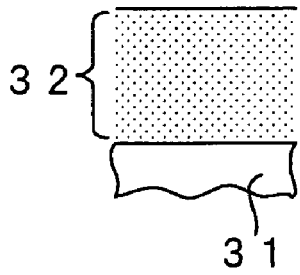
FIGS. 39A through 39E are drawings which show a change of a liquid developer layer on a developer roller.
Figure 39B:
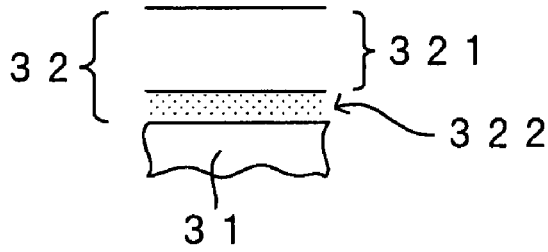

FIGS. 39A through 39E are drawings which show a change of the liquid developer layer on the developer roller 31 due to the carrier liquid stripping function of the squeegee rollers 171, 172 and 173. In the area A in FIG. 35, the liquid developer 32 remains as it has been supplied to the developer roller 31 by the coating roller 34, and as shown in FIG. 39A, toner is dispersed within the carrier liquid. In the area B in FIG. 35, a bias voltage which makes positively charged toner move from the squeegee roller 171 toward the developer roller 31 is applied, and as shown in FIG. 39B, a toner layer 322 is created on the developer roller 31 side and the carrier liquid layer 321 is created in a surface layer portion.

Figure 39C:
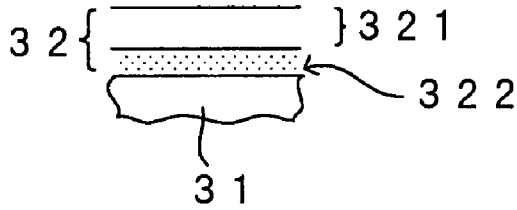
Figure 39D:
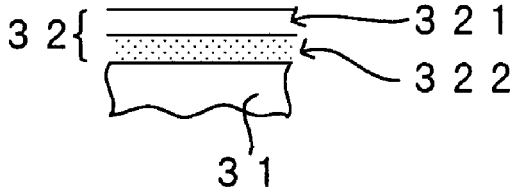
Figure 39E:
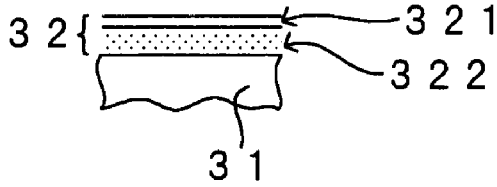

It is believed that separation occurs approximately at the center of the liquid developer layer 321 when the squeegee roller 171 takes away a portion of the liquid developer layer 321. Therefore, within the area C in FIG. 35, as shown in FIG. 39C, the thickness of the liquid developer layer 321 becomes approximately half the thickness shown in FIG. 39B. Following this, the squeegee roller 172 further takes away a portion of the liquid developer layer 321. In consequence, within the area D in FIG. 35, as shown in FIG. 39D, the thickness of the liquid developer layer 321 becomes approximately half the thickness shown in FIG. 39C. The squeegee roller 173 then further takes away a portion of the liquid developer layer 321 in a similar fashion. As a result, within the area E in FIG. 35, as shown in FIG. 39E, the thickness of the liquid developer layer 321 becomes approximately half the thickness shown in FIG. 39D.

The squeegee rollers 171, 172 and 173 thus take away a portion of the liquid developer layer 321 which is in the surface layer portion one after another. As shown in FIG. 35, cleaning blades 174 respectively remove the liquid developer 321 which has been stripped off from the developer roller 31 by the squeegee rollers 171, 172 and 173. The removed liquid developer 321 returns back to the tank 33 through a collection duct 175 (which is denoted at the broken line in FIG. 35). Although the removed liquid developer 321 returns by its own weight back to the tank 33 in this embodiment, a pump may be disposed to the collection duct 175 and driven to force the liquid developer 321 back into the tank 33. In the eighth preferred embodiment, the coating position 34*a* thus corresponds to a "carrying start position" of the present invention, the squeegee rollers 171 through 173 thus correspond to the "stripping member" and the "collecting means" of the present invention, and the carrier stripping bias generators 122 thus correspond to the "voltage applying means" of the present invention.

As described above, the eighth preferred embodiment uses the squeegee rollers 171 through 173 which come into contact with the liquid developer which is carried on the developer roller 31 and strip off a portion of the carrier liquid which is in the surface layer. The carrier stripping bias generators 122 apply bias voltages which make positively charged toner move from the squeegee rollers 171 through 173 to the developer roller 31, and the squeegee rollers 171 through 173 strip off the carrier liquid 321 which is within the surface layer of the liquid developer 32. Hence, it is possible to adjust the amount of the carrier liquid 321 which is consumed for formation of a toner image.

The operations shown in FIG. 32 can be executed in the eighth preferred embodiment, too. That is, when one squeegee roller is to be moved to the contacting position at the step #90 in FIG. 32, any one of the squeegee rollers 171 through 173 is moved. When two squeegee rollers are to be moved to the contacting positions at the step #92 in FIG. 32, any two rollers among the squeegee rollers 171 through 173 are moved. In the event that toner is negatively charged, the polarity of the bias power source parts 123 of the carrier stripping bias generators 122 is reversed.

<Ninth Preferred Embodiment>

Figure 40:
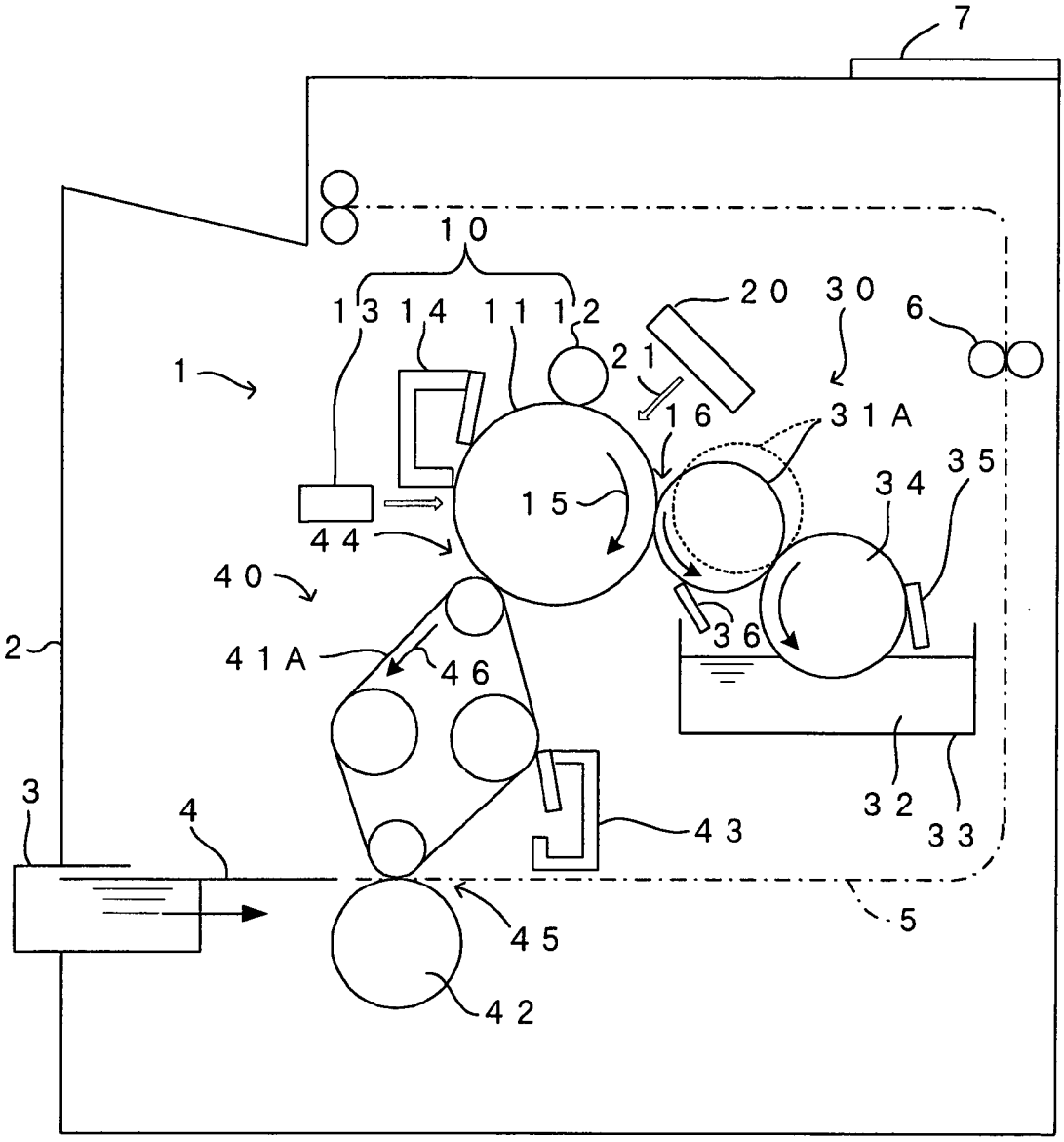
FIG. 40 is a drawing which shows a structure of a printer which is a ninth preferred embodiment of the present invention.
Figure 41:
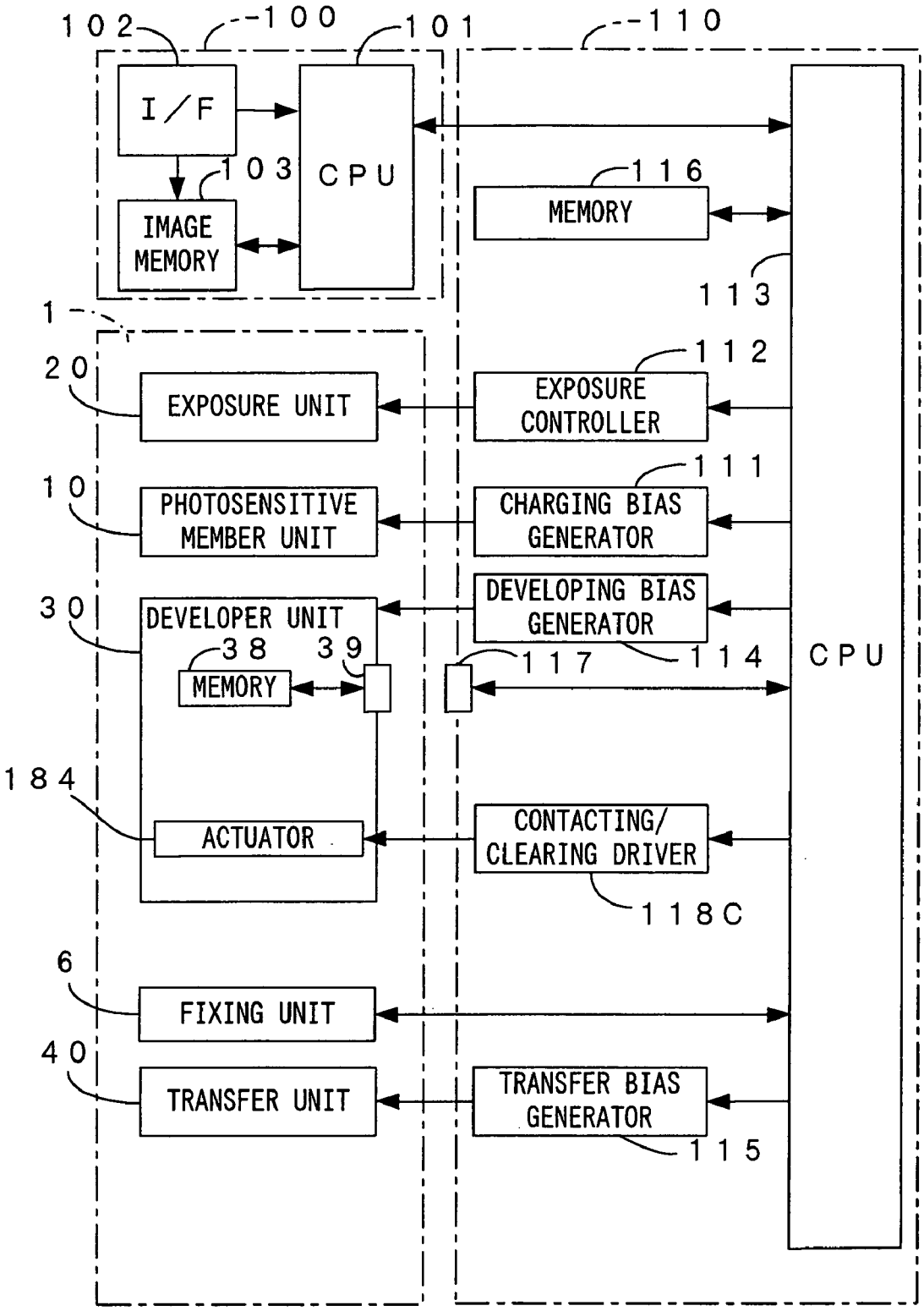
FIG. 41 is a block diagram which shows an electric structure of this printer.

FIG. 40 is a drawing which shows a structure of a printer which is a ninth preferred embodiment of the image forming apparatus according to the present invention, and FIG. 41 is a block diagram which shows an electric structure of this printer. In FIGS. 40 and 41, the same elements as those according to the seventh preferred embodiment are denoted at the same reference symbols. The printer according to the ninth preferred embodiment comprises a developer roller 31A instead of the developer roller 31 according to the seventh preferred embodiment (FIG. 29), and an intermediate transfer belt 41A instead of the intermediate transfer roller 41 (FIG. 29).

The developer roller 31A is supported in such a manner that the developer roller 31A can move in a direction closer to and away from the photosensitive member 11. For instance, when a contacting/clearing driver 118C (FIG. 41) drives an actuator 184 (FIG. 41) which is formed by a solenoid, a motor or the like for instance, the developer roller 31A reciprocally moves between the contacting position (denoted at the solid line in FIG. 40) and the clear-off position (denoted at the broken line in FIG. 40). The contacting position is such a position at which the photosensitive member 11 contacts the liquid developer which is carried on the developer roller 31A, while the clear-off position is such a position at which the photosensitive member 11 stays not in contact with the above-mentioned liquid developer. The intermediate transfer belt 41A runs around four rollers, and rotates approximately at the same circumferential speed as the photosensitive member 11 in a direction (a rotation/driving direction 46) which follows the photosensitive member 11.

Figure 42A:
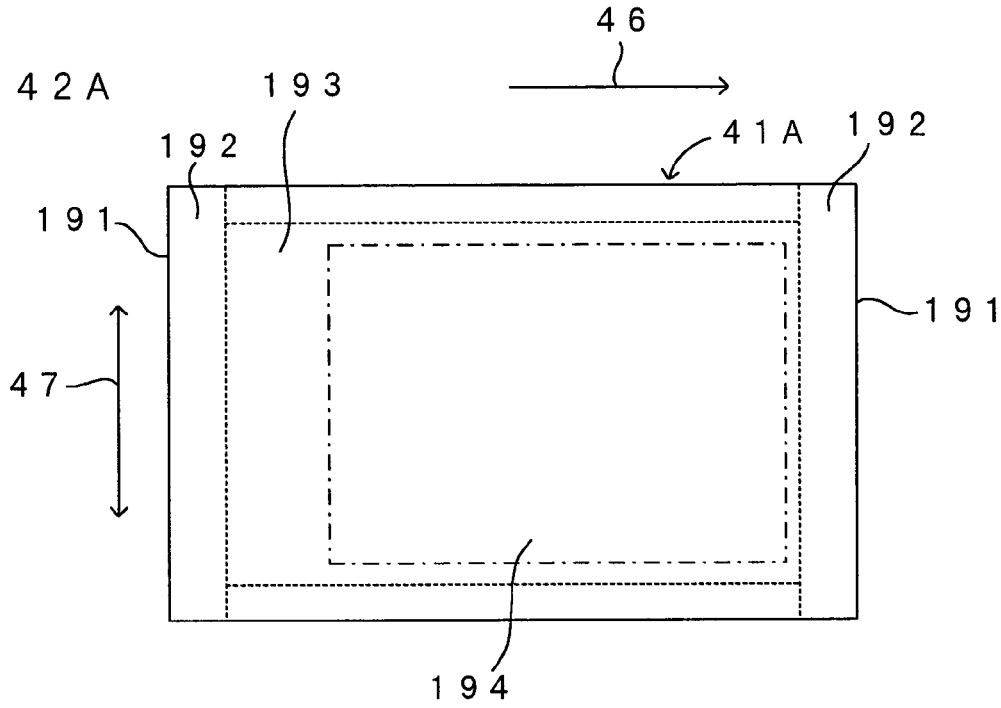
FIGS. 42A and 42B are development views of an intermediate transfer belt.
Figure 42B:
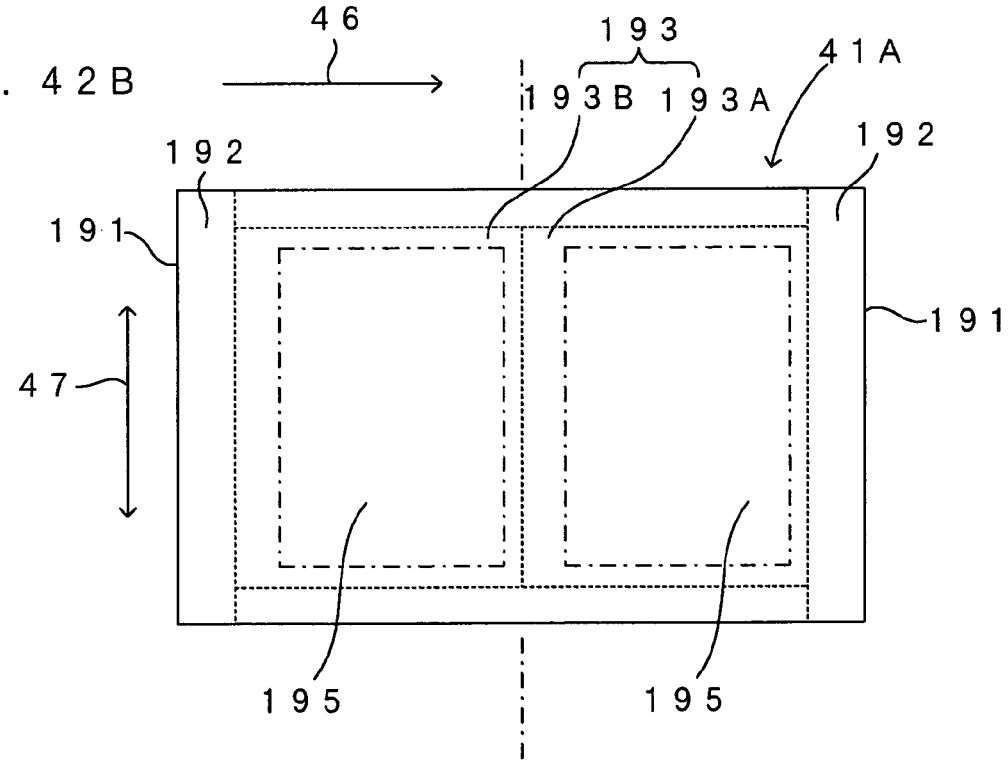

FIGS. 42A and 42B are development views of the intermediate transfer belt 41A. As shown in FIGS. 42A and 42B, the intermediate transfer belt 41A is an endless belt which is obtained by joining an approximately rectangular sheet at a splice 191. In FIGS. 42A and 42B, denoted at the arrow 47 is a rotation axis direction. The intermediate transfer belt 41A contains a transfer protection area 192 and a transfer area 193. The transfer protection area 192 is defined across one edge and the other edge along the rotation axis direction 47 and within a predetermined range which stretches on the both sides to the splice 191. The transfer area 193 is an area other than the transfer protection area 192, and expands in a rectangular area except for a one edge portion and other edge portion along the rotation axis direction 47. A toner image is primarily transferred onto the transfer area 193.

As shown in FIG. 42A, a toner image 194 whose size is that of an A3 paper as it is placed with the longer sides aligned along the rotation/driving direction 46 can be transferred onto the transfer area 193. Further, as shown in FIG. 42B, as the transfer area 193 is split into two sub areas 193A and 193B, as the intermediate transfer belt 41A rotates one round, it is possible to transfer two images having the size of an A4 paper with the shorter sides aligned along the rotation/driving direction 46 or a smaller size, e.g., the A4, A5 and B5 sizes. In the ninth preferred embodiment, image formation control for transferring two toner images during one rotation of the intermediate transfer belt 41A will be hereinafter referred to as "two-image transfer control." Shown in FIG. 42B are toner images 195 of the A4 size.

Figure 43:
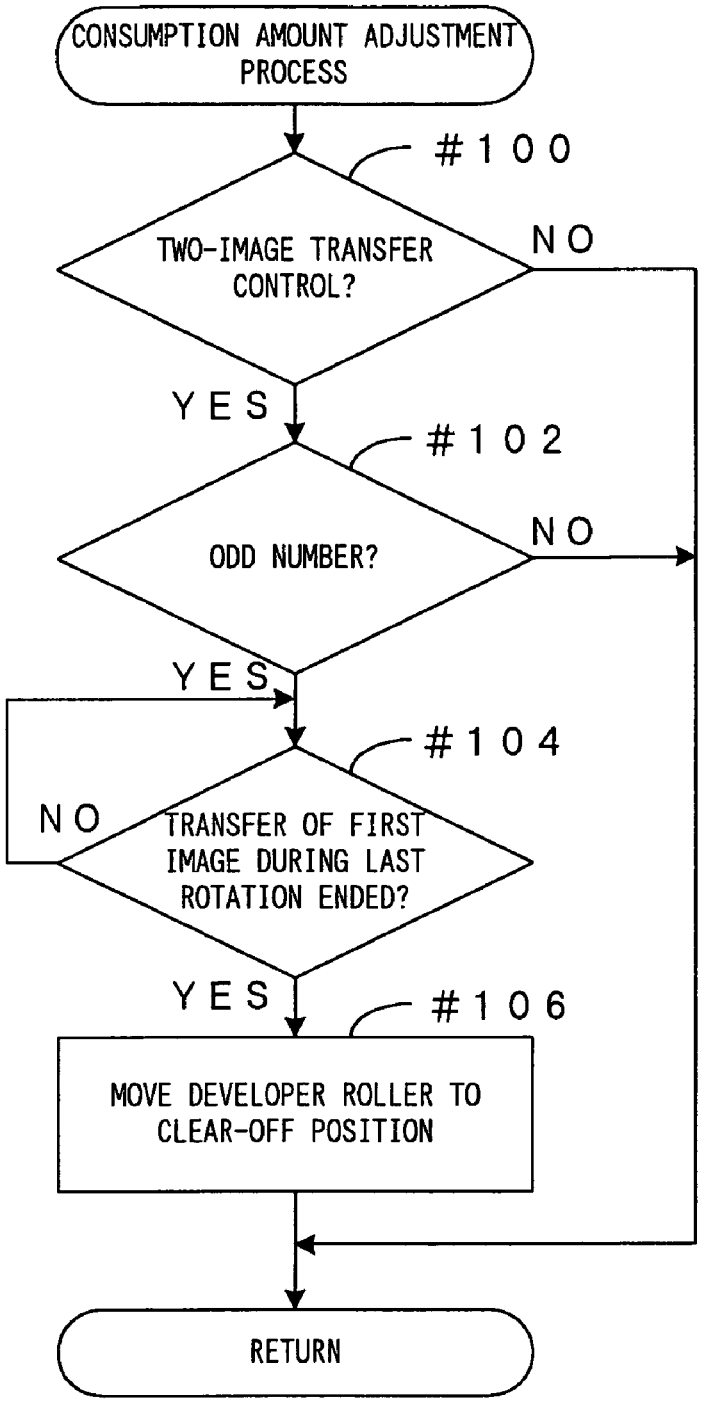
FIG. 43 is a flow chart which shows a consumption amount adjustment process routine according to the ninth preferred embodiment.

FIG. 43 is a flow chart which shows a consumption amount adjustment process routine according to the ninth preferred embodiment. A consumption amount adjustment process program for the carrier liquid is stored in advance in the memory 116 of the engine controller 110. As the CPU 113 controls the respective portions of the apparatus in accordance with the program, the following consumption amount adjustment process is executed.

First, whether a print instruction signal received from an external apparatus via the main controller 100 (the CPU 101) demands two-image transfer control is determined (#100). When the print instruction signal demands two-image transfer control (YES at #100), whether the demanded number of images is an odd number is determined (#102). When the print instruction signal does not demand two-image transfer control (NO at #100) or when the demanded number of images is not an odd number (NO at #102), this routine is terminated.

On the contrary, when the demanded number of images is an odd number (YES at #102), the apparatus waits until the end of transfer of the first image which is carried during the last rotation of the intermediate transfer belt 41A (NO at #104). When the transfer of the first image during the last rotation has come to an end (YES at #104), the developer roller 31A is moved to the clear-off position (#106), and this routine is terminated.

As described with reference to FIG. 22 (the sixth preferred embodiment) and FIG. 37 (the eighth preferred embodiment), since the carrier liquid 321 which is within the surface layer of the liquid developer 32 carried on the developer roller 31A moves to the photosensitive member 11 when the developer roller 31A is located at the contacting position, the carrier liquid 321 is consumed.

On the contrary, according to the ninth preferred embodiment, since the developer roller 31A is used which can move between the contacting position and the clear-off position and the position of the developer roller 31A is controlled in accordance with the state of toner image formation, the amount of the carrier liquid 321 which is consumed for formation of a toner image is adjusted. When the second image is not to be formed during two-image transfer control in particular, since the developer roller 31A is moved to the clear-off position, it is possible to avoid a wasteful consumption of the carrier liquid 321.

Although the foregoing has described that two images can be transferred while the intermediate transfer belt 41A rotates one round, this is not limiting. In the event that n (where n is an integer equal to or larger than 3) images can be transferred while the intermediate transfer belt rotates one round, at the time of transfer of (n−1) or fewer images during the last rotation, the developer roller 31A is moved to the clear-off position from the end of the transfer of the images until the end of the last rotation.

The consumption amount adjustment process according to the ninth preferred embodiment is not limited to that shown in FIG. 43. For example, when no print instruction signal has been received next after development in response to the previous print instruction signal received from an external apparatus via the main controller 100 ended, the photosensitive member 11 and the developer roller 31A may be stopped rotating after moving the developer roller 31A to the clear-off position. Meanwhile, in the event that the previous print instruction signal is received while the developer roller 31A remains at the clear-off position, the developer roller 31A may be moved to the contacting position after rotations of the photosensitive member 11 and the developer roller 31A have become steady. Execution of such a consumption amount adjustment process for the carrier liquid makes it possible to reduce a wasteful consumption of the carrier liquid 321 as much as possible.

<Modifications of Seventh Through Ninth Preferred Embodiments>

The present invention is not limited to the preferred embodiments above, but may be modified in various manners in addition to the preferred embodiments above, to the extent not deviating from the object of the invention. For instance, the following modifications (1) and (2) may be implemented.

(1) Although the seventh preferred embodiment described above does not require to apply any particular bias upon the squeegee rollers 151 through 153, such a bias which gives rise to electric force which separates toner from the squeegee rollers may be applied as in the case of the squeegee rollers according to the eighth preferred embodiment. This prevents toner from adhering to the squeegee rollers even when a stripped amount of the carrier liquid is large, thereby avoiding stripping off of toner by the squeegee rollers.

(2) Although the foregoing has described the preferred embodiments above in relation to a printer which prints on a transfer paper an image fed from an external apparatus such as a host computer, the present invention is not limited to this but is applicable to electrophotographic image forming apparatuses in general including copier machines, facsimile machines and the like. Further, the preferred embodiments above are an application of the present invention to an image forming apparatus which prints in monochrome, applications of the present invention are not limited to this. Rather, the present invention is applicable also to an image forming apparatus which prints in colors, in which case it is possible to adjust a consumption amount of the carrier liquid for each color in the event that the apparatus is of the so-called tandem type for instance which requires to dispose a photosensitive member unit, an exposure unit and a developer unit for each color and sequentially transfer on an intermediate transfer belt.

<Tenth Preferred Embodiment>

Figure 44:
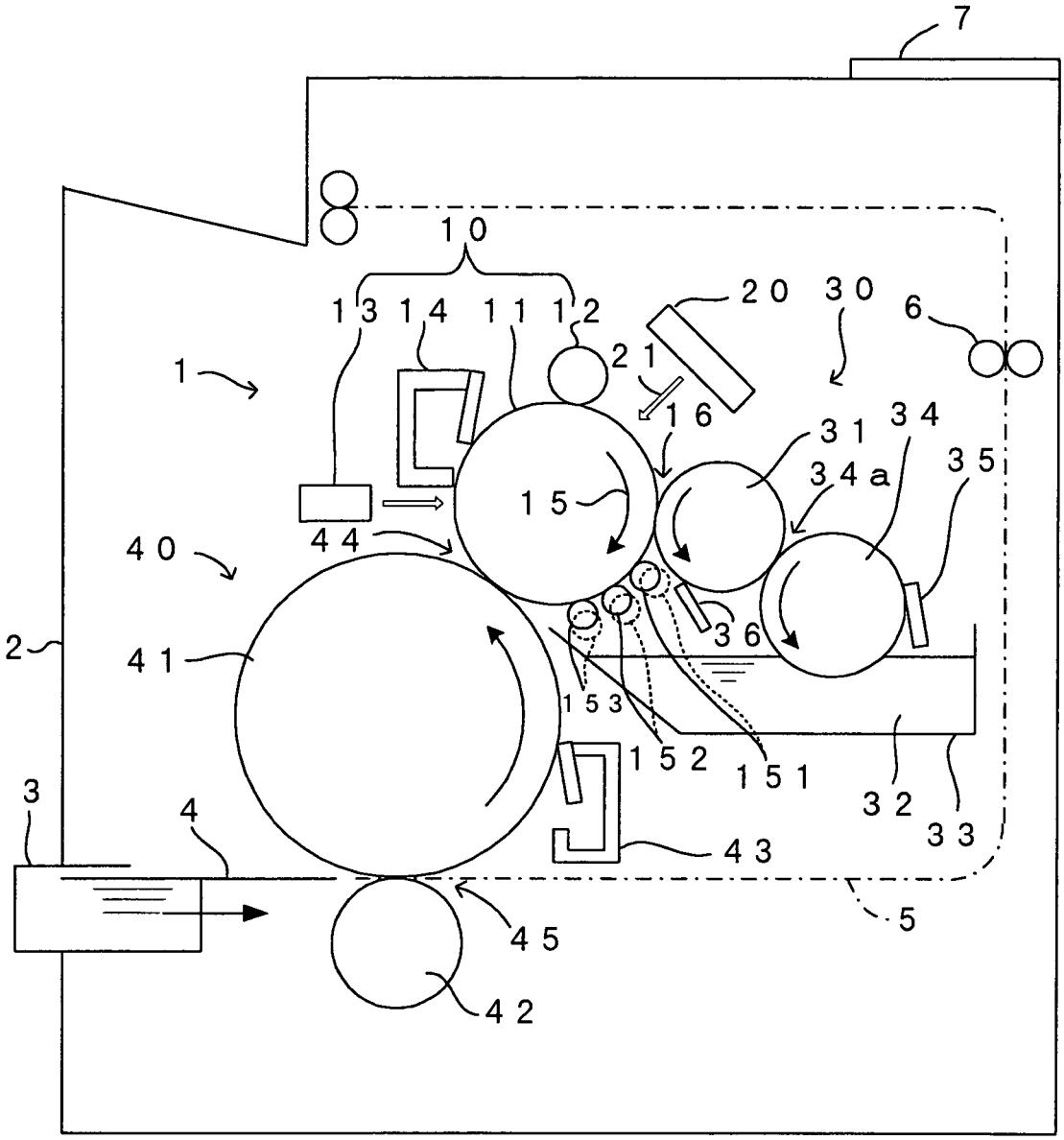
FIG. 44 is a drawing which shows an internal structure of a printer which is a tenth preferred embodiment of the present invention.

FIG. 44 is a drawing which shows an internal structure of a printer which is a tenth preferred embodiment of the image forming apparatus according to the present invention, FIG.

Figure 46:
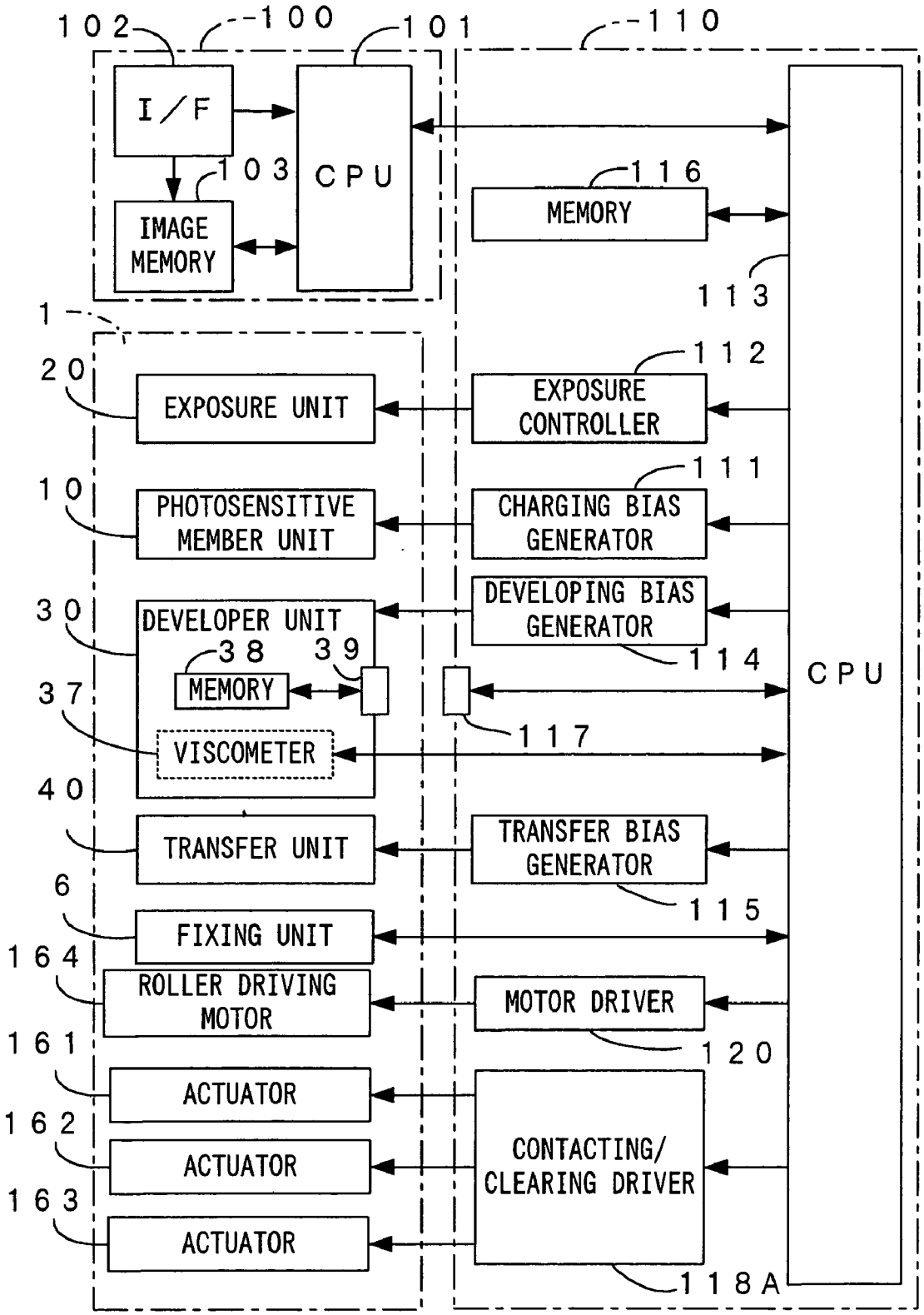
FIG. 46 is a block diagram which shows an electric structure of this printer.

45 is an expanded view of an essential section in FIG. 44, and FIG. 46 is a block diagram which shows an electric structure of this printer. The same elements as those according to the sixth preferred embodiment are denoted at the same reference symbols.

In the tenth preferred embodiment, too, the squeegee rollers 151, 152 and 153 are disposed around the photosensitive member 11 as in the sixth preferred embodiment. An arrangement and structures of the squeegee rollers 151, 152 and 153 are similar to those according to the sixth preferred embodiment which have been described with reference to FIGS. 19 and 20. Operations of stripping the photosensitive member 11 of the carrier liquid by the squeegee rollers 151 through 153 are similar to those according to the sixth preferred embodiment which have been described with reference to FIG. 22. A relationship between an image occupation ratio and a stripped amount of the carrier liquid is similar to that according to the sixth preferred embodiment which has been described with reference to FIGS. 23A through 26D.

Figure 45:
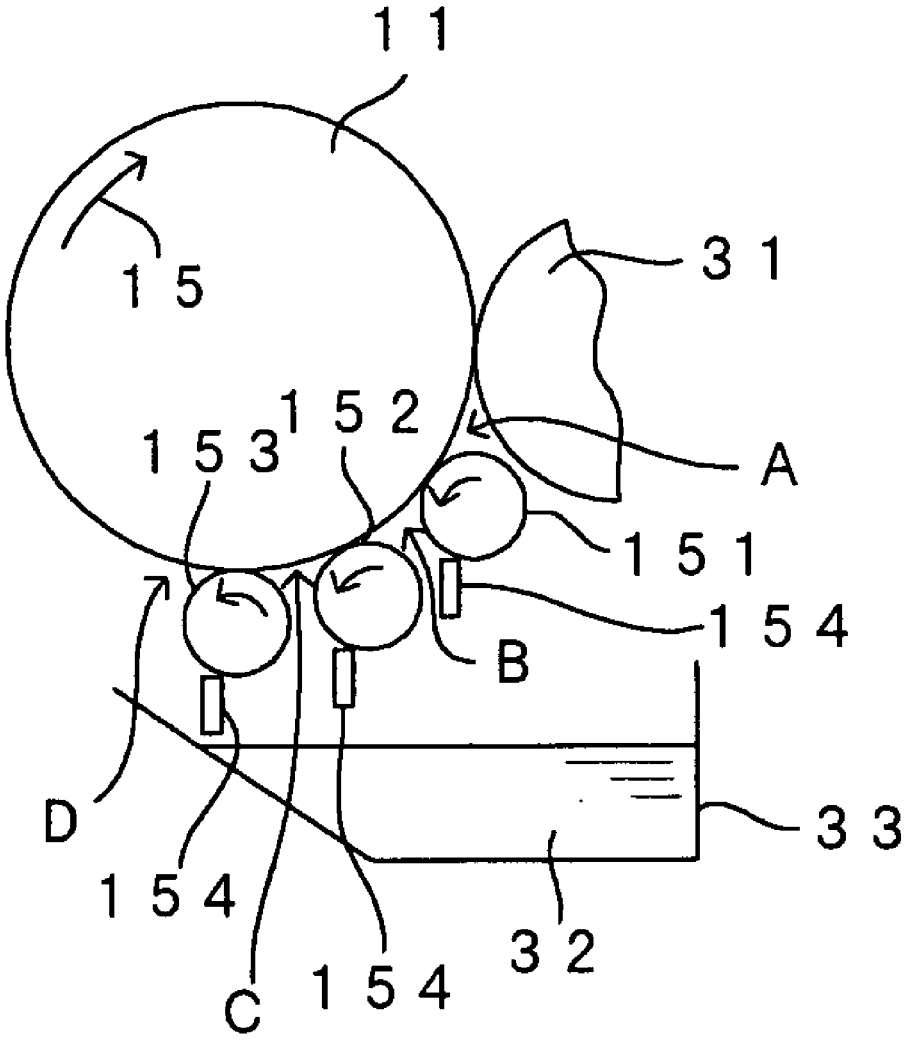
FIG. 45 is an expanded view of an essential section in FIG. 44.

In the tenth preferred embodiment, too, the cleaning blades 154 abut on the squeegee rollers 151, 152 and 153 as shown in FIG. 45, which is similar to that in the sixth preferred embodiment. Therefore, the respective cleaning blades 154 scrape off the carrier liquid which has been stripped off from the photosensitive member 11 by the squeegee rollers 151, 152 and 153, and remove the carrier liquid from the squeegee rollers 151, 152 and 153. The opening of the tank 33 stretches out toward below the positions at which the respective cleaning blades 154 abut on the squeegee rollers 151, 152 and 153. Hence, the carrier liquid removed off from the squeegee rollers 151 through 153 by the cleaning blades 154 returns by its own weight to the tank 33.

Although the removed carrier liquid returns by its own weight to the tank 33 according to the tenth preferred embodiment, this is not limiting. Alternatively, a pan which receives the removed carrier liquid and a collection pipe which links the pan to the tank 33, and a pump may be disposed so that the carrier liquid will be forced back to the tank 33 when the pump is driven.

As in the sixth preferred embodiment, toner contained in the liquid developer is charged positively for example, owing to a function of the electric charge control agent and the like. At the developing position 16 therefore, the liquid developer carried on the developer roller 31 is supplied from the developer roller 31 to the photosensitive member 11 and adheres to the photosensitive member 11, toner moves within the liquid developer toward the photosensitive member 11 from the developer roller 31 because of the developing bias Vb (e.g., Vb=DC+400 V) which is applied upon the developer roller 31 by the developing bias generator 114, and an electrostatic latent image is accordingly visualized. In addition, as in the sixth preferred embodiment, the cleaning blade 36 scrapes off the liquid developer which remains on the developer roller 31 without adhering to the photosensitive member 11, and the liquid developer returns by its own weight back to the tank 33. In the tenth preferred embodiment, the photosensitive member 11 thus corresponds to the "image carrier" of the present invention, the developer roller 31 thus corresponds to the "liquid developer carrier" of the present invention, the tank 33 thus corresponds to the "container" of the present invention, and the transfer bias generator 115 thus corresponds to the "transfer means" of the present invention.

Figure 47:
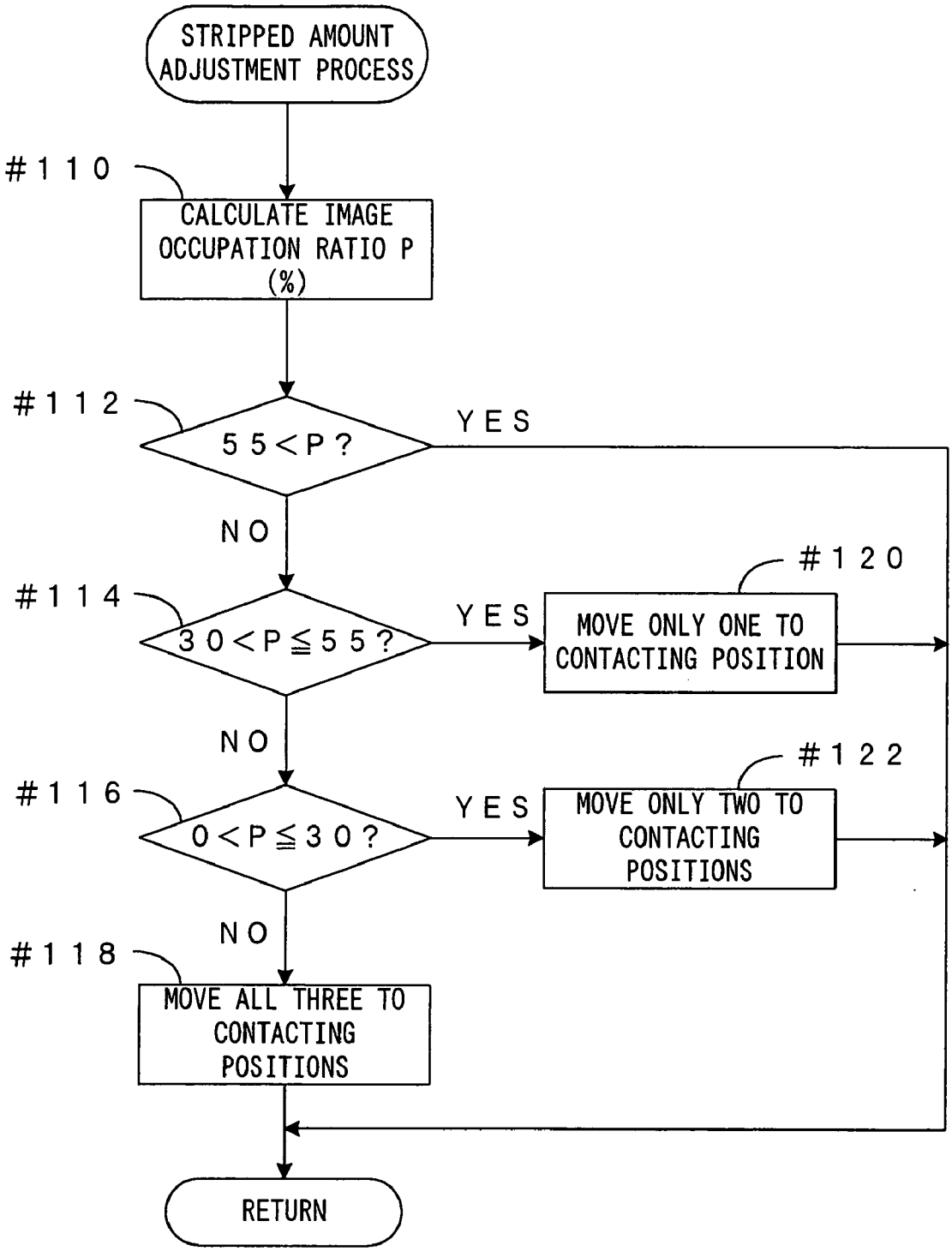
FIG. 47 is a flow chart which shows an example of a stripped amount adjustment process routine.

FIG. 47 is a flow chart which shows an example of a stripped amount adjustment process routine. A stripped amount adjustment process program is stored in advance in the memory 116 of the engine controller 110. As the CPU 113 controls the respective portions of the apparatus in accordance with the program, the following stripped amount adjustment process is executed.

First, an image occupation ratio P (%) which is a ratio of an image portion to an electrostatic latent image is calculated (#110), and the level of the calculated image occupation ratio is judged. That is, whether 55<P holds truth is determined (#112). When P≦55 holds truth (NO at #112), whether 30<P≦55 is determined (#114). When P≦30 holds truth (NO at #114), whether 0<P≦30 is determined (#116). Since P=0 holds truth when NO at #116, as described with reference to FIGS. 26A through 26D, the squeegee rollers 151 through 153 are all moved to the contacting positions (#118).

When 55<P holds truth (YES at #112), this means that the toner density on the photosensitive member 11 is high. Therefore, as described with reference to FIGS. 23A through 23D, this routine is terminated with the squeegee rollers 151 through 153 all kept at the clear-off positions. When 30<P≦55 holds truth (YES at #114), since this means that the toner density on the photosensitive member 11 is medium, the squeegee roller 151 for example is moved to the contacting position (#120) as described with reference to FIGS. 24A through 24D. Only one roller may be moved at this stage. Therefore, the squeegee roller 152 or 153 may be moved instead of the squeegee roller 151.

When 0<P≦30 holds truth (YES at #116), this means that the toner density on the photosensitive member 11 is low. Therefore, as described with reference to FIGS. 25A through 25D, the squeegee rollers 151 and 152 for example are moved to the contacting positions (#122). Since two rollers may be moved at this stage, the squeegee rollers 151 and 153 or the squeegee rollers 152 and 153 may be moved. The threshold values used to determine the level of the image occupation ratio at the steps #112, #114 and #116 are merely examples, and other values may be used instead.

Figure 48:
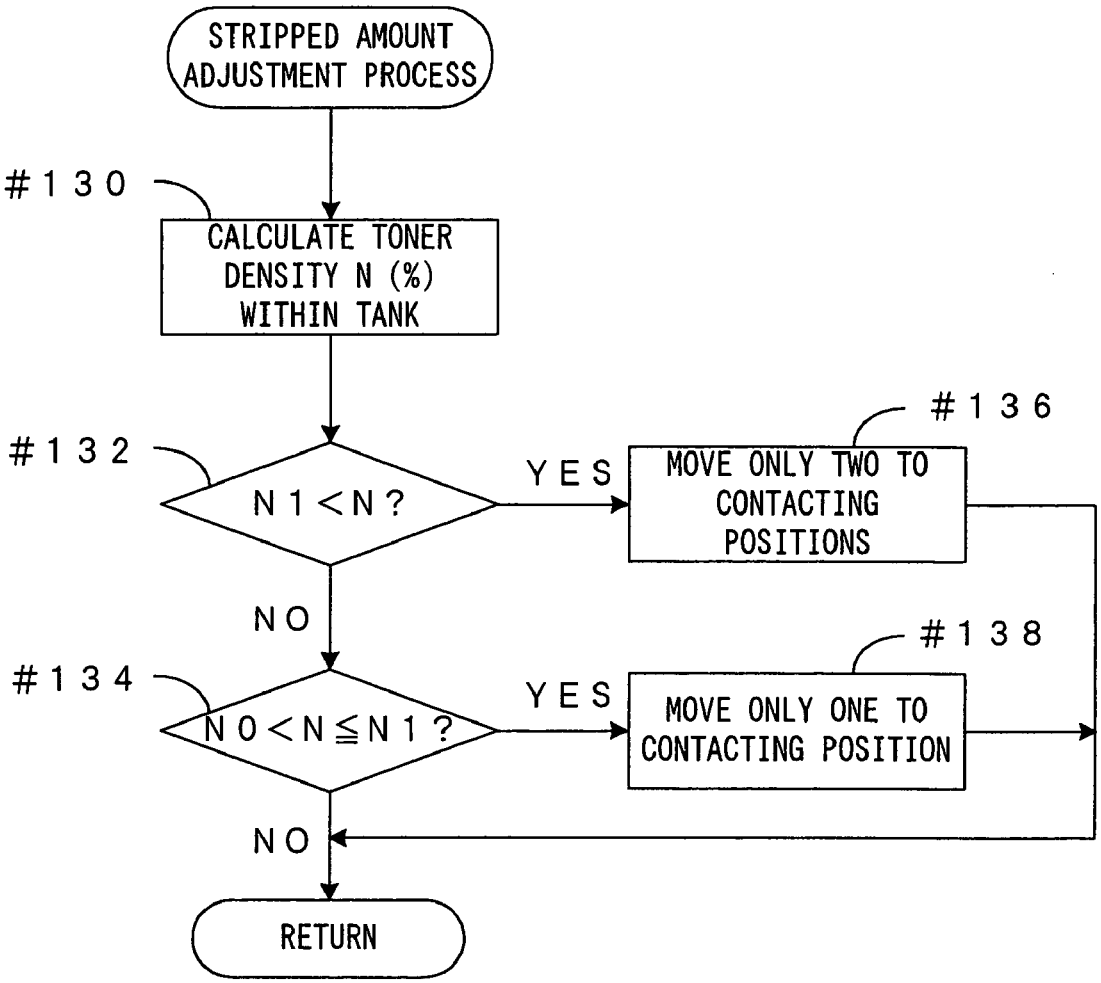
FIG. 48 is a flow chart which shows other example of the stripped amount adjustment process routine.

FIG. 48 is a flow chart which shows other example of the stripped amount adjustment process routine. During the illustrated operations, as denoted at the broken line in FIG. 46, the developer unit 30 comprises the viscometer 37. The viscometer 37 is disposed inside the tank 33, and the CPU 113 calculates a toner density based on the viscosity of the liquid developer 32 which is detected by the viscometer 37. Instead of the viscometer 37, a density sensor formed by a transmission-type optical sensor for example may be disposed inside the tank 33 and the sensor itself may detect the toner density in the liquid developer 32 which is within the tank 33. In this embodiment, the viscometer 37 corresponds to the "toner density detecting means" of the present invention.

First, the toner density N (%) in the liquid developer 32 which is within the tank 33 is calculated based on a detection signal obtained by the viscometer 37 (#130). A relationship between the viscosity of the liquid developer 32 which is detected by the viscometer 37 and the toner density in the liquid developer 32 is identified in the form of an arithmetic expression or table data in advance and contained in the program which is stored in the memory 116. The processing of calculating a toner density at #130 is executed based on the relationship described above.

Whether thus calculated toner density is N1<N is determined (#132). When N≦N1 holds truth (NO at #132), whether N0<N≦N1 is determined (#134). When N≦N0 holds truth (NO at #132), since this means that the toner density has dropped, this routine is terminated without stripping off the carrier liquid. N0 is an initial value of the toner density in the liquid developer 32 which is within the tank 33, and N1 is a value which is calculated through experiments or the like in advance and satisfies the relationship N0<N1.

On the contrary, when N1<N holds truth (YES at #132), since this means that the toner density has largely increased, the squeegee rollers 151 and 152 for example are moved to the contacting positions (#136) as described with reference to FIGS. 25A through 25D. Since two rollers may be moved at this stage, the squeegee rollers 151 and 153 or the squeegee rollers 152 and 153 may be moved to the contacting positions.

Further, when N0<N≦N1 holds truth (YES at #134), the toner density has just slightly increased. Therefore, the squeegee roller 151 for instance is moved to the contacting position (#138) as described with reference to FIGS. 24A through 24D. Since only one roller may be moved at this stage, the squeegee roller 152 or 153 may be moved to the contacting position instead of the squeegee roller 151.

Alternatively, values of the viscosity of the liquid developer 32 which correspond to comparison values of the toner density in the liquid developer 32 (N0 and N1 in FIG. 48) may be identified and stored in the memory 116 in advance based on the relationship between the viscosity of the liquid developer 32 which is detected by the viscometer 37 and the toner density in the liquid developer 32, and the detected viscosity may be compared with a corresponding value directly, to thereby make the judgments at the steps #132 and #134 in FIG. 48.

As described above, the tenth preferred embodiment uses the squeegee rollers 151 through 153 which can move between the contacting position which are on the liquid developer 32 which is on the photosensitive member 11 and the clear-off positions which are off the liquid developer 32 which is on the photosensitive member 11 and a combination of the squeegee rollers 151 through 153 which are moved to the contacting positions is controlled. Hence, it is possible to control a stripped amount of the carrier liquid 321 which is stripped off from the photosensitive member 11. This permits to adjust a stripping amount of the carrier liquid 321 which is stripped off from the photosensitive member 11. As a result, it is possible to avoid a wasteful consumption of the carrier liquid 321 and form an excellent toner image.

Further, the opening of the tank 33 stretches out toward below the positions at which the respective cleaning blades 154 abut on the squeegee rollers 151 through 153 and the carrier liquid 321 scraped off from the squeegee rollers 151 through 153 by the cleaning blades 154 returns by its own weight to the tank 33 according to the tenth preferred embodiment. Hence, it is not necessary to separately dispose a collection tank and install a pipe or the like which is for returning the carrier liquid 321 to the tank 33 from the collection tank. In addition, it is possible to simplify the structure of the apparatus and reduce the size of the apparatus. Further, as thus stripped carrier liquid 321 is returned back to the tank 33, it is possible to make an effective use of the carrier liquid 321 and minimize the amount of the carrier liquid 321 which is replenished.

Further, in the tenth preferred embodiment, the squeegee rollers 151 through 153 are disposed facing the developed image carrying area (which is the area on the photosensitive member 11 which is located between the developing position 16 and the primary transfer position 44, i.e., an area which carries a toner image). The photosensitive member 11 is therefore stripped of the carrier liquid 321 before primary transfer, an image occupation ratio is calculated, and a stripped amount of the carrier liquid is controlled so that the toner density in the liquid developer which remains on the photosensitive member 11 after stripping will become close to a predetermined value (which is the initial value of the toner density within the tank 33 in the seventh preferred embodiment). Hence, it is possible to ensure that a transfer condition for primary transfer, i.e., the toner density in the liquid developer always stays approximately the same, which in turn favorably realizes primary transfer.

Further, during the operations shown in FIG. 47, an image occupation ratio is calculated, a stripped amount of the carrier liquid 321 is controlled so that the toner density in the liquid developer which remains on the photosensitive member 11 after stripping will become close to the initial value of the toner density in the liquid developer 32 which is within the tank 33, the cleaning blades 154 scrape off all of the carrier liquid 321 which has been stripped from the photosensitive member 11 by the squeegee rollers 151 through 153, and the carrier liquid 321 is returned back to the tank 33. Hence, it is possible to suppress a toner density change in the liquid developer 32 within the tank 33 and maintain the toner density at the initial value. This permits to use the liquid developer 32 held in the tank 33 to the very end without wasting, and minimizes the amount of a carrier liquid, toner or the like replenished from outside. The operations shown in FIG. 47, not requiring to use toner density detecting means, such as the viscometer 37, of the tank 33, attain an advantage that it is possible to further simplify the structure of the apparatus as compared to the structure which is shown in FIG. 48.

Meanwhile, during the operations shown in FIG. 48, the toner density inside the tank 33 is calculated based on a detection value obtained by the viscometer 37, a stripped amount of the carrier liquid which has been stripped off from the photosensitive member 11 is controlled based on the detection value, and thus stripped carrier liquid is returned to the tank 33. Hence, it is possible to suppress a toner density change within the tank 33 and maintain the toner density at the initial value. This permits to use the liquid developer 32 held in the tank 33 to the very end without wasting, and minimizes the amount of a carrier liquid, toner or the like replenished from outside.

<Modification of Tenth Preferred Embodiment>

The present invention is not limited to the preferred embodiments described above, but may be modified in various manners in addition to the preferred embodiments described above, to the extent not deviating from the object of the invention. For instance, the following modifications (1) and (2) may be implemented.

(1) During the operations shown in FIG. 47 according to the tenth preferred embodiment described above, it is not possible to sufficiently strip off the carrier liquid in an area where an image occupation ratio is low, and the toner density within the tank 33 tends to increase. That is, as shown in FIG. 25A for instance, since the thickness t1 of the toner 322 is 2 μm and the thickness t2 of the carrier liquid 321 is 8 μm, when the squeegee roller 153 is moved to the contacting position in FIG. 25D, a toner image could be adversely affected. Hence, as described earlier with reference to FIGS. 25A through 25D, when an image occupation ratio is 20%, the toner density in the liquid developer 32 which remains on the photosensitive member 11 becomes close to about 14 vol % but fails to reach 20 vol % which is the initial value.

Noting this, at the step #112 for instance, only one squeegee roller may be moved to the contacting position also when 55<P holds truth. This allows to increase a stripping amount of the carrier liquid 321 and increase the amount of the carrier liquid which is returned back to the tank 33, to suppress an increase in toner density within the tank 33 and maintain the toner density at the initial value as much as possible.

(2) Although the foregoing has described the tenth preferred embodiment above in relation to a printer which prints on a transfer paper an image fed from an external apparatus such as a host computer, the present invention is not limited to this but is applicable to electrophotographic image forming apparatuses in general including copier machines, facsimile machines and the like. Further, the preferred embodiment above is an application of the present invention to an image forming apparatus which prints in monochrome, applications of the present invention are not limited to this. Rather, the present invention is applicable also to an image forming apparatus which prints in colors, in which case it is possible to adjust a stripping amount on the photosensitive member of the carrier liquid for each color in the event that the apparatus is of the so-called tandem type for instance which requires to dispose a photosensitive member unit, an exposure unit and a developer unit for each color and sequentially transfer on an intermediate transfer belt.

<Modifications of Sixth Through Tenth Preferred Embodiments>

The present invention is not limited to the preferred embodiments above, but may be modified in various manners in addition to the preferred embodiments above, to the extent not deviating from the object of the invention. For instance, the following modifications (1) through (8) may be implemented.

(1) Although the sixth through the tenth preferred embodiments described above comprise a dot counter which counts an on-dot count which represents the number of pixels to which toner adheres among pixels which form an electrostatic latent image, and use a ratio of an on-dot count to a dot count of the entire image as an image occupation ratio, a method of calculating an image occupation ratio is not limited to this. An image occupation ratio is a value which corresponds to a development amount, that is, a migration amount of toner which moves to the photosensitive member 11 from the developer roller 31. For instance therefore, a current which flows to the photosensitive member 11 from the developer roller 31 may be detected as a developer current, a migration amount of toner (development amount) may be calculated based on the developer current, and thus calculated amount may be used as an image occupation ratio.

(2) Although the sixth through the eighth and the tenth preferred embodiments described above use the developer roller 31 which has a roller shape as the liquid developer carrier, this is not limiting. The liquid developer carrier shaped like a belt may be used instead, for instance. In addition, although the squeegee rollers 151 through 153 and 171 through 173 which have a roller shape as the stripping member, this is not limiting. A stripping member shaped like a belt may be used instead, for example.

(3) Although the sixth, the seventh and the tenth preferred embodiments described above comprise three squeegee rollers 151 through 153, this is not limiting. Two, four or more squeegee rollers may be used instead. To be more specific, where a plurality of squeegee rollers are disposed, with a combination of the squeegee rollers which are moved to the contacting positions controlled, it is possible to control a stripped amount of the carrier liquid 321 which is stripped off from the photosensitive member 11. The eighth preferred embodiment is neither limited to use of the three squeegee rollers 171 through 173, but may be implemented using two, four or more squeegee rollers, that is, a plurality of squeegee rollers, in which case it is possible to control a stripped amount of the carrier liquid 321 which is stripped off from the developer roller 31 by controlling a combination of the squeegee rollers which are moved to the contacting positions.

FIGS. 49A through 49D are drawings for describing a stripped amount of the carrier liquid at each one of three contacting positions which are at different distances from the photosensitive member 11 and which are provided as contacting positions for the squeegee roller 151 in the sixth, the seventh and the tenth preferred embodiments described above. In FIGS. 49A through 49D, the photosensitive member 11 is shown as a flat plate for the convenience of illustration. Further, although FIGS. 49A through 49D show the squeegee roller 151 alone, FIGS. 49A through 49D similarly apply to the squeegee rollers 152 and 153.

Figure 49A:
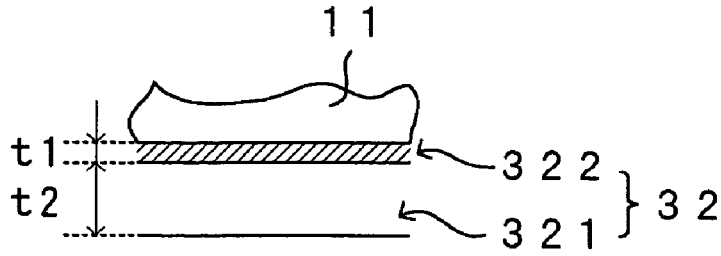
FIGS. 49A through 49D are drawings for describing a stripped amount of a carrier liquid according to a modification.

Thus, the actuators 161 through 163 (FIG. 21 for instance) are formed by motors or the like and the squeegee rollers 151 through 153 can be moved to a plurality of contacting positions which are at different distances from the photosensitive member 11 according to this modification. Assume now that the photosensitive member 11 seats a solid black image as shown in FIG. 49A. The toner 322 has the thickness ti and the carrier liquid 321 has the thickness t2 as in the sixth, the seventh and the tenth preferred embodiments described above. The radius of the squeegee roller 151 is R.

Figure 49B:
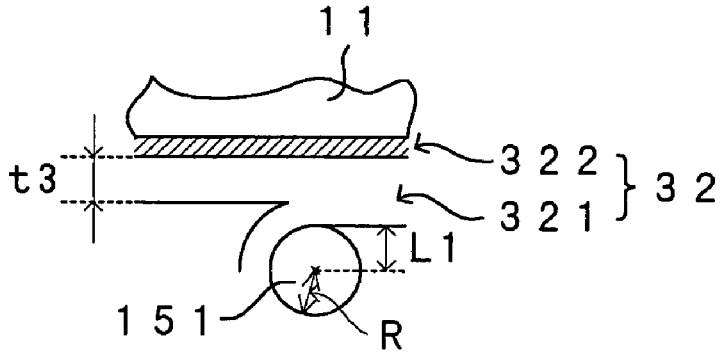

In FIG. 49B, the contacting position is such a position at which the surface of the squeegee roller 151 barely contacts the liquid developer 32 which is on the photosensitive member 11. That is, a distance L1 between the center of the squeegee roller 151 and the surface of the liquid developer 32 is set to satisfy L1≈R and L1≦R. This ensures that the carrier liquid 321 which remains on the photosensitive member 11 has thickness t3 and only a small amount of the carrier liquid 321 which is in the surface layer of the liquid developer 32 on the photosensitive member 11 is stripped away.

Figure 49C:
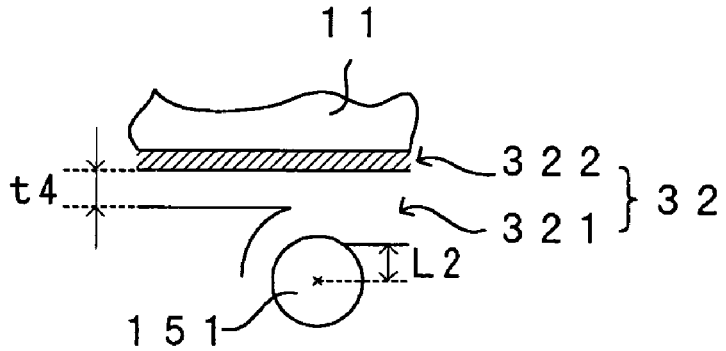

In FIG. 49C, the contacting position is such a position which is closer to the photosensitive member 11 than in FIG. 49B. In other words, a distance L2 between the center of the squeegee roller 151 and the surface of the liquid developer 32 is set to satisfy L2<L1. This ensures that the carrier liquid 321 which remains on the photosensitive member 11 has thickness t4 (<t3) and more carrier liquid 321 which is in the surface layer of the liquid developer 32 on the photosensitive member 11 is stripped away than in FIG. 49B.

Figure 49D:
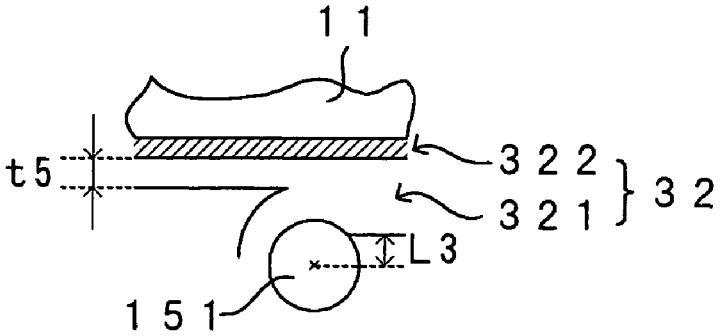

In FIG. 49D, the contacting position is such a position which is even closer to the photosensitive member 11 than in FIG. 49C. In short, a distance L3 between the center of the squeegee roller 151 and the surface of the liquid developer 32 is set to satisfy L3<L2. This ensures that the carrier liquid 321 which remains on the photosensitive member 11 has thickness t5 (<t4) and even more carrier liquid 321 which is in the surface layer of the liquid developer 32 on the photosensitive member 11 is stripped away than in FIG. 49C.

As described above, as for the contacting positions for the squeegee rollers 151 through 153, the squeegee rollers 151 through 153 can be moved to a plurality of contacting positions which are at different distances from the photosensitive member 11 according to the modification which is shown in FIGS. 49A through 49D. With the contacting positions for the squeegee rollers 151 through 153 changed therefore, a stripped amount of the carrier liquid 321 off from the photosensitive member 11 is controlled, thereby attaining a similar effect to those according to the sixth, the seventh and the tenth preferred embodiments described above.

In the eighth preferred embodiment described above, too, as the contacting positions for the squeegee rollers 171 through 173, three contacting positions which are at different distances from the developer roller 31 may be provided. According to this modification, it is thus possible to control a stripped amount of the carrier liquid 321 off from the developer roller 31 by changing the contacting positions for the squeegee rollers 171 through 173, and therefore, to achieve a similar effect to that according to the eighth preferred embodiment described above.

In these above-described modifications, to dispose a plurality of squeegee rollers is not limiting. Only one squeegee roller may be disposed instead. In this case as well, it is possible to control a stripped amount of the carrier liquid 321.

(5) In the sixth, the seventh and the tenth preferred embodiments described above, the rotation speeds of the squeegee rollers 151 through 153 may be changed using the roller driving motors 164 to thereby change the relative velocities of the contact surfaces of the squeegee rollers 151 through 153 relative to the liquid developer which is transported by the photosensitive member 11. Such a modification allows to increase or decrease a stripped amount of the carrier liquid 321 by increasing or decreasing the circumferential speeds of the squeegee rollers 151 through 153 relative to the circumferential speed of the photosensitive member 11, and hence, to attain a similar effect to those according to the sixth, the seventh and the tenth preferred embodiments described above.

In the eighth preferred embodiment described above, too, the rotation speeds of the squeegee rollers 171 through 173 may be changed and the relative velocities of the contact surfaces of the squeegee rollers 171 through 173 relative to the liquid developer which is transported by the developer roller 31 may be changed. Such a modification allows to increase or decrease a stripped amount of the carrier liquid 321 by increasing or decreasing the circumferential speeds of the squeegee rollers 171 through 173 relative to the circumferential speed of the developer roller 31. This achieves a similar effect to that according to the eighth preferred embodiment described above.

In these above-described modifications, to dispose a plurality of squeegee rollers is not limiting. Only one squeegee roller may be disposed instead. In this case as well, it is possible to control a stripped amount of the carrier liquid 321.

(6) Although the squeegee rollers 151 through 153 are all capable of moving between the contacting positions and the clear-off positions in the sixth, the seventh and the tenth preferred embodiments described above, this is not limiting. Instead, at least only one squeegee roller may be capable of thus moving. For instance, according to such a modification which requires that the squeegee roller 151 can thus move and the squeegee rollers 152 and 153 are fixed at the contacting positions, through control of the position of the squeegee roller 151, it is possible to control a combination of the squeegee rollers which are moved to the contacting positions and hence control a stripped amount of the carrier liquid.

In the eighth preferred embodiment described above, too, at least only one squeegee roller (e.g., the squeegee roller 171) may be capable of thus moving, in which case through control of the position of the squeegee roller 171, it is possible to control a combination of the squeegee rollers which are moved to the contacting positions and hence control a stripped amount of the carrier liquid.

(7) Although the sixth, the seventh and the tenth preferred embodiments described above demand that the intermediate transfer roller 41 is disposed and the secondary transfer roller 42 realizes secondary transfer onto the transfer paper 4 at the secondary transfer position 45 after a toner image on the photosensitive member 11 has been primarily transferred onto the intermediate transfer roller 41 at the primary transfer position 44, this is not limiting. For instance, the intermediate transfer roller 41 may be omitted and the secondary transfer roller 42 may be disposed at the primary transfer position 44, so as to transfer a toner image on the photosensitive member 11 directly onto the transfer paper 4 (transfer medium). In such a modification, the transfer bias generator 115 and the secondary transfer roller 42 correspond to the "transfer means" of the present invention.

(8) In the sixth, the seventh and the tenth preferred embodiments described above, as shown in FIG. 25A for instance, since the thickness t1 of the toner 322 is 2 $\mu$m and the thickness t2 of the carrier liquid 321 is 8 $\mu$m, as the squeegee roller 153 is moved to the contacting position in FIG. 25D, a toner image could be adversely affected. However, in the event that an adverse influence over a toner image is unlikely even when the squeegee roller 153 is moved to the contacting position, e.g., the thickness to of the toner 322 is 1 $\mu$m, the squeegee roller 153 may be moved to the contacting position in FIG. 25D for example.

In addition, when an adverse influence over a toner image is unlikely even when the squeegee roller 153 is moved to the contacting position, a step of moving all of the three squeegee rollers 151 through 153 to the contacting positions may be added with one more comparison step, whereas maximum of two squeegee rollers may be moved to the contacting positions during the operations according to the sixth, the seventh and the tenth preferred embodiments described above (i.e., the operations shown in FIGS. 27 and 28 in the sixth preferred embodiment, the operations shown in FIG. 32 in the seventh preferred embodiment, and the operations shown in FIGS. 47 and 48 in the tenth preferred embodiment).

For instance, during the operations shown in FIGS. 27, 32 and 47, the level of an image occupation ratio to be judged may be divided. That is, three squeegee rollers may be moved to the contacting positions when $0<P\leqq 20$ holds truth, two squeegee rollers may be moved to the contacting positions when $20<P\leqq 35$ holds truth, but one squeegee roller may be moved to the contacting position when $35<P\leqq 55$ holds truth.

Meanwhile, during the operations shown in FIGS. 28 and 48 for instance, a value N2 which satisfies N1<N2, too, may be compared with a toner density N, and three squeegee rollers may be moved to the contacting positions when N2<N holds truth, two squeegee rollers may be moved to the contacting positions when $N1<N\leqq N2$ holds truth, but one squeegee roller may be moved to the contacting position when $N0<N\leqq N1$ holds truth.

<Eleventh Preferred Embodiment>

Figure 50:
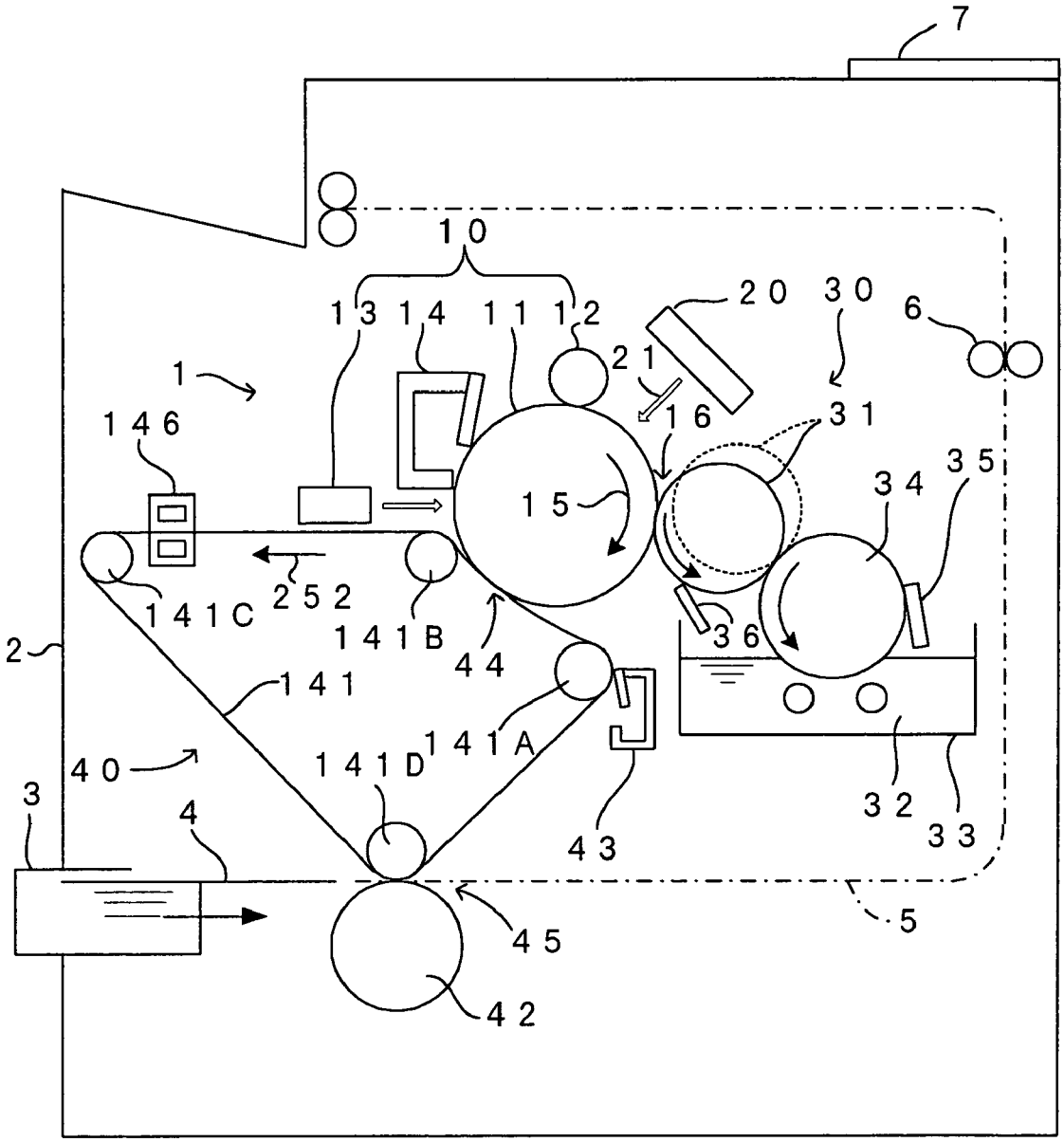
FIG. 50 is a drawing which shows an internal structure of a printer which is an eleventh preferred embodiment of the present invention.
Figure 51:
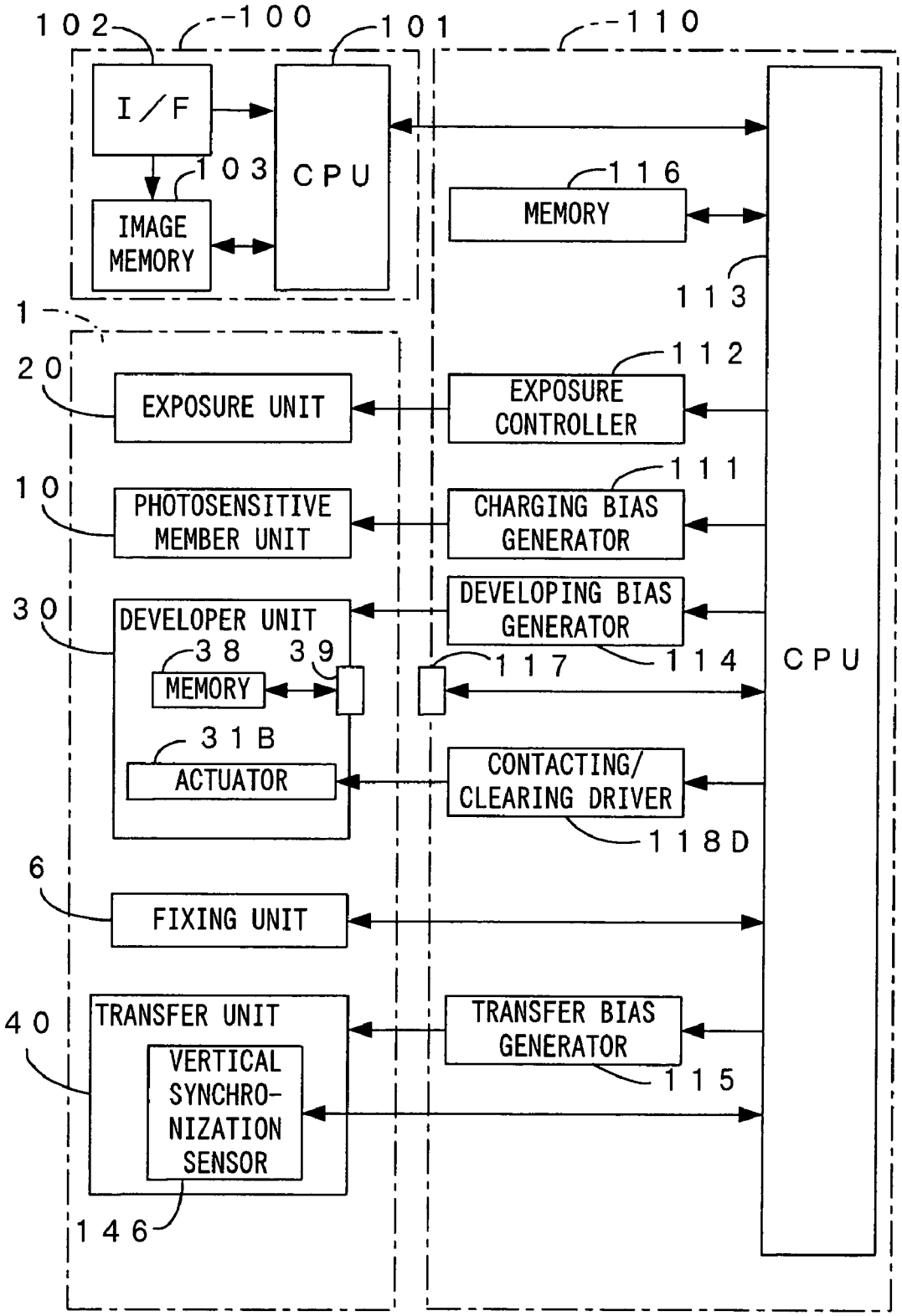
FIG. 51 is a block diagram which shows an electric structure of this printer.
Figure 52A:
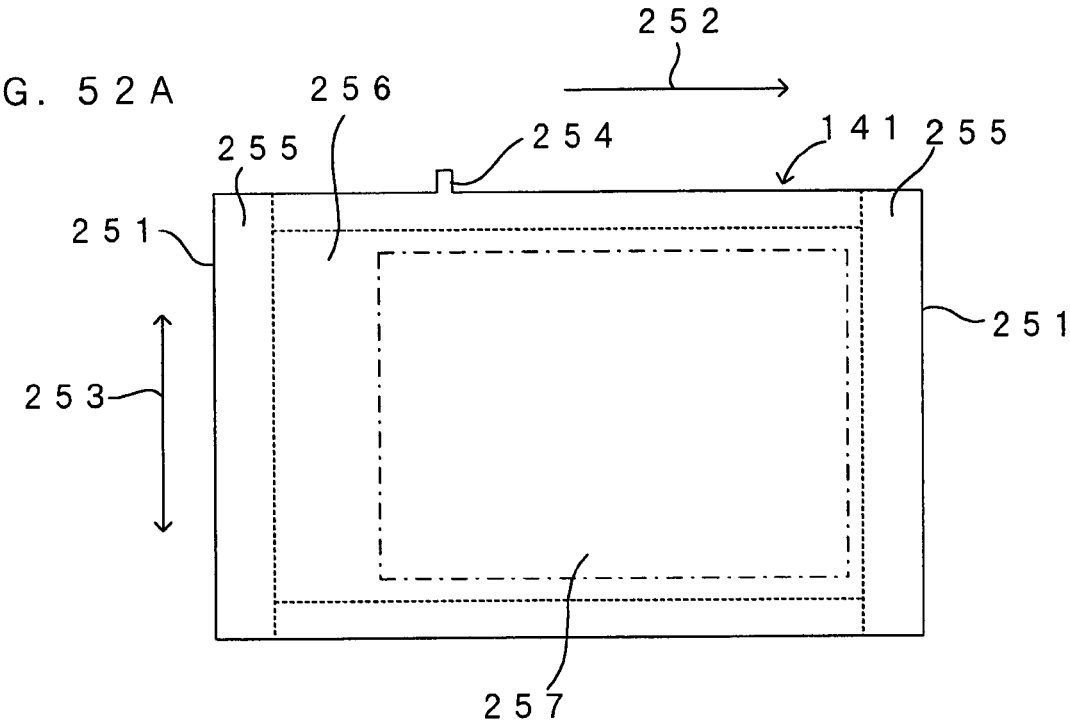
FIGS. 52A and 52B are development views of an intermediate transfer belt.
Figure 52B:
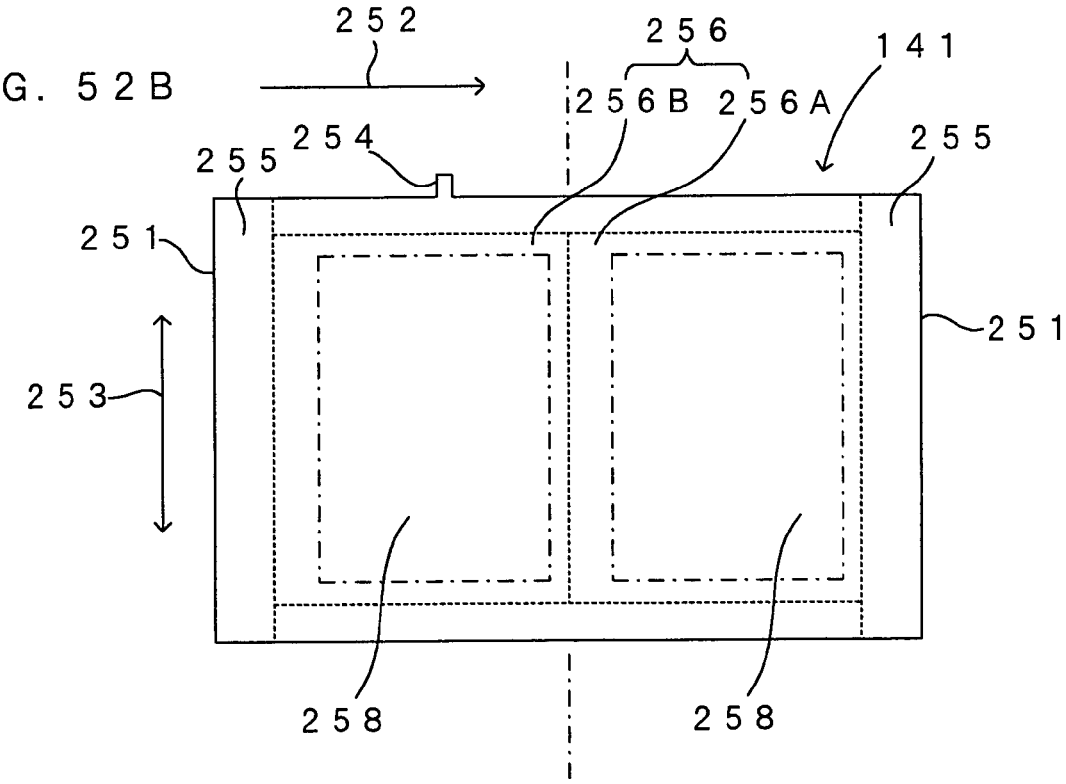

FIG. 50 is a drawing which shows an internal structure of a printer which is an eleventh preferred embodiment of the image forming apparatus according to the present invention, FIG. 51 is a block diagram which shows an electric structure of this printer, and FIGS. 52A and 52B are development views of an intermediate transfer belt. The same elements as those according to the first preferred embodiment are denoted at the same reference symbols.

The transfer unit 40 according to the eleventh preferred embodiment comprises an intermediate transfer belt 141 instead of the intermediate transfer roller 41 of the first preferred embodiment. Disposed around the photosensitive member 11 are the charger 12, the developer roller 31, the intermediate transfer belt 141, the static eliminator 13 and the cleaner 14 along the rotation direction 15 of the photosensitive member 11.

Further, the developer roller 31 according to the eleventh preferred embodiment is supported in such a manner that the developer roller 31 can move in a direction closer to and away from the photosensitive member 11. For instance, when a contacting/clearing driver 118D (FIG. 51) drives an actuator 31B (FIG. 51) which is formed by a solenoid, a motor or the like for instance, the developer roller 31 reciprocally moves between the contacting position (denoted at the solid line in FIG. 50) and the clear-off position (denoted at the broken line in FIG. 50). The contacting position is such a position at which the photosensitive member 11 contacts the liquid developer which is carried on the developer roller 31 and it is therefore possible to supply toner to the photosensitive member 11. The clear-off position is such a position at which the photosensitive member 11 stays not in contact with the above-mentioned liquid developer. Position control of the developer roller 31 will be described in detail later.

As in the first preferred embodiment, toner contained in the liquid developer is charged positively for example, owing to a function of the electric charge control agent and the like. At the developing position 16 therefore, the liquid developer carried on the developer roller 31 is supplied from the developer roller 31 to the photosensitive member 11 and adheres to the photosensitive member 11, toner moves within the liquid developer toward the photosensitive member 11 from the developer roller 31 because of the developing bias Vb (e.g., Vb=DC+400 V) which is applied upon the developer roller 31 by the developing bias generator 114, and an electrostatic latent image is accordingly visualized. In addition, the cleaning blade 36 scrapes off the liquid developer which remains on the developer roller 31 without adhering to the photosensitive member 11, and the liquid developer returns by its own weight back to the tank 33.

A toner image thus formed on the photosensitive member 11 is transported to the primary transfer position 44 which is faced against the intermediate transfer belt 141, as the photosensitive member 11 rotates. The intermediate transfer belt 141 runs across tension rollers 141A and 141B, a drive roller 141C and a follower roller 141D. A photosensitive member driving motor (not shown) drives the drive roller 141C into rotations together with the photosensitive member 11. The intermediate transfer belt 141 rotates approximately at the same circumferential speed as the photosensitive member 11 in a direction (which is denoted at the arrow 252 in FIG. 50) which follows the photosensitive member 11. When a primary transfer bias (which may be DC−400 V for instance) is applied from the transfer bias generator 115, a toner image on the photosensitive member 11 is primarily transferred onto the intermediate transfer belt 141. The static eliminator 13 formed by an LED or the like removes an electric charge remaining on the photosensitive member 11 after primary transfer, and the cleaner 14 removes the liquid developer which remains.

As shown in FIGS. 52A and 52B, the intermediate transfer belt 141 is an endless belt which is obtained by joining an approximately rectangular sheet at a splice 251. In FIGS. 52A and 52B, denoted at the arrow 252 is a rotation/driving direction and denoted at the arrow 253 is a rotation axis direction. The intermediate transfer belt 141 comprises a projection 254 which is disposed to the one edge side along the rotation axis direction 253 (the upper side in FIGS. 52A and 52B), and a transfer protection area 255 and a transfer area 256. The transfer protection area 255 is defined across one edge and the other edge along the rotation axis direction 253 and within a predetermined range which stretches on the both sides to the splice 251. The transfer area 256 is an area other than the transfer protection area 255, and expands in a rectangular area except for a one edge portion and other edge portion along the rotation axis direction 253. A toner image is primarily transferred onto the transfer area 256.

As shown in FIG. 52A, a toner image 257 whose size is that of an A3 paper as it is placed with the longer sides aligned along the rotation/driving direction 252 can be transferred onto the transfer area 256. Further, as shown in FIG. 52B, as the transfer area 256 is split into two sub areas 256A and 256B, as the intermediate transfer belt 141 rotates one round, it is possible to transfer two images having the size of an A4 paper with the shorter sides aligned along the rotation/driving direction 252 or a smaller size (e.g., the A4 and B5 sizes). Image formation control for transferring two toner images during one rotation of the intermediate transfer belt 141 will be hereinafter referred to as "two-image transfer control." Shown in FIG. 52B are toner images 258 of the A4 size.

A vertical synchronization sensor 146 is formed by a photo-interrupter which comprises a light emitter (such as an LED) and a light receiver (such as a photo diode) which are disposed facing each other for instance. The vertical synchronization sensor 146 is disposed on the one edge side of the rotating intermediate transfer belt 141 along the rotation axis direction 253. The vertical synchronization sensor 146 detects a passage of the projection 254 and outputs a detection signal. The detection signal outputted from the vertical synchronization sensor 146 is used as a vertical synchronizing signal Vsync which serves as the reference for image formation control performed by the engine controller 110.

The secondary transfer roller 42 is disposed facing an appropriate portion of the intermediate transfer belt 141 (right below the follower roller 141C in FIG. 50), and as the intermediate transfer belt 141 rotates, a primarily transferred image which has been primarily transferred onto the intermediate transfer belt 141 is transported to the secondary transfer position 45 which is faced against the secondary transfer roller 42. On the other hand, the transfer paper 4 housed in the paper cassette 3 is transported to the secondary transfer position 45 by a transportation driver (not shown), in synchronization to the transportation of the primarily transferred toner image. The secondary transfer roller 42 rotates approximately at the same circumferential speed as the intermediate transfer belt 141 in a direction which follows the intermediate transfer belt 141 (the clockwise direction in FIG. 50). As the transfer bias generator 115 applies a secondary transfer bias (which may be −100 $\mu$A for example under constant current control) upon the secondary transfer roller 42, the toner image on the intermediate transfer belt 141 is secondarily transferred onto the transfer paper 4. The cleaner 43 removes the liquid developer which remains on the intermediate transfer belt 141 after the secondary transfer.

In this embodiment, the photosensitive member 11 thus corresponds a "latent image carrier" of the present invention, the developer roller 31 thus corresponds to the "liquid developer carrier" of the present invention, the developing bias generator 114 thus corresponds to "image forming means" of the present invention, and the transfer bias generator 115 thus corresponds to the "transfer means" of the present invention.

Figure 53:
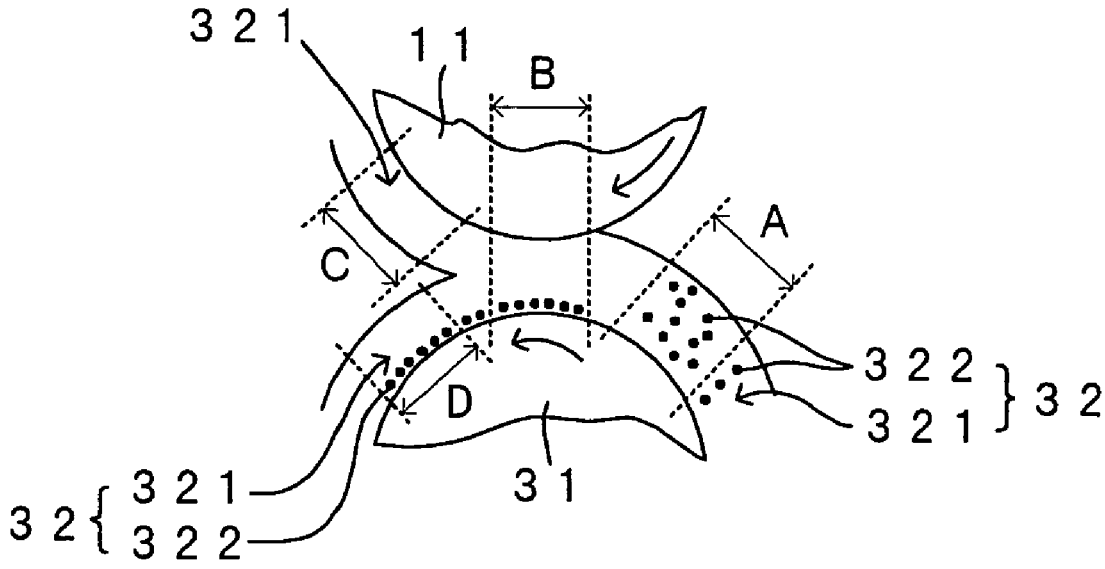
FIG. 53 is a drawing for describing movement of a carrier liquid between two rollers.

FIG. 53 is a drawing for describing movement of the carrier liquid between two rollers (which are the photosensitive member 11 and the developer roller 31 in the illustrated example). A layer of the liquid developer within an area A is in a state that the coating roller 34 has supplied the liquid developer 32 to the developer roller 31. In other words, in the liquid developer 32 within the area A, toner 322 is dispersed within the carrier liquid 321. A layer of the liquid developer within an area B is in a state that the liquid developer 32 on the developer roller 31 is in contact with the photosensitive member 11 and is nipped between the two rollers 31 and 11. In the area B, the layer of the liquid developer nipped between the two rollers 31 and 11 gets separated as the rollers 31 and 11 rotate, thereby creating a liquid developer layer within an area C on the photosensitive member 11 side and a liquid developer layer within an area D on the roller 31 side.

When the area B is applied with a bias voltage which makes positively charged toner move from the photosensitive member 11 toward the developer roller 31, a toner density in a portion contacting the developer roller 31 becomes the highest but the toner density decreases gradually with a distance away from the developer roller 31. In a portion contacting the photosensitive member 11, a layer of the carrier liquid 321 which does not contain toner is created. It is considered that since a layer of the carrier liquid 321 which does not contain toner has the lowest viscosity, the liquid developer 32 is separated within this layer of the carrier liquid 321. The carrier liquid 321 therefore moves to the photosensitive member 11, thereby creating the area C which seats only the carrier liquid 321 and the area D wherein the developer roller 31 carries the liquid developer 32 containing the toner 322.

As described above, while application of the bias voltage prevents the toner 322 from moving toward the photosensitive member 11 in the event that the developer roller 31 is located at the contacting position, it is not possible to prevent the carrier liquid 321 which is in the surface layer of the liquid developer 32 carried on the developer roller 31 from moving to the photosensitive member 11 and the carrier liquid 321 is accordingly consumed. Noting this, according to the eleventh preferred embodiment, the developer roller 31 retracts to the clear-off position when the liquid developer 32 is not needed, thereby making it possible to avoid a wasteful consumption of the carrier liquid 321.

Figure 54:
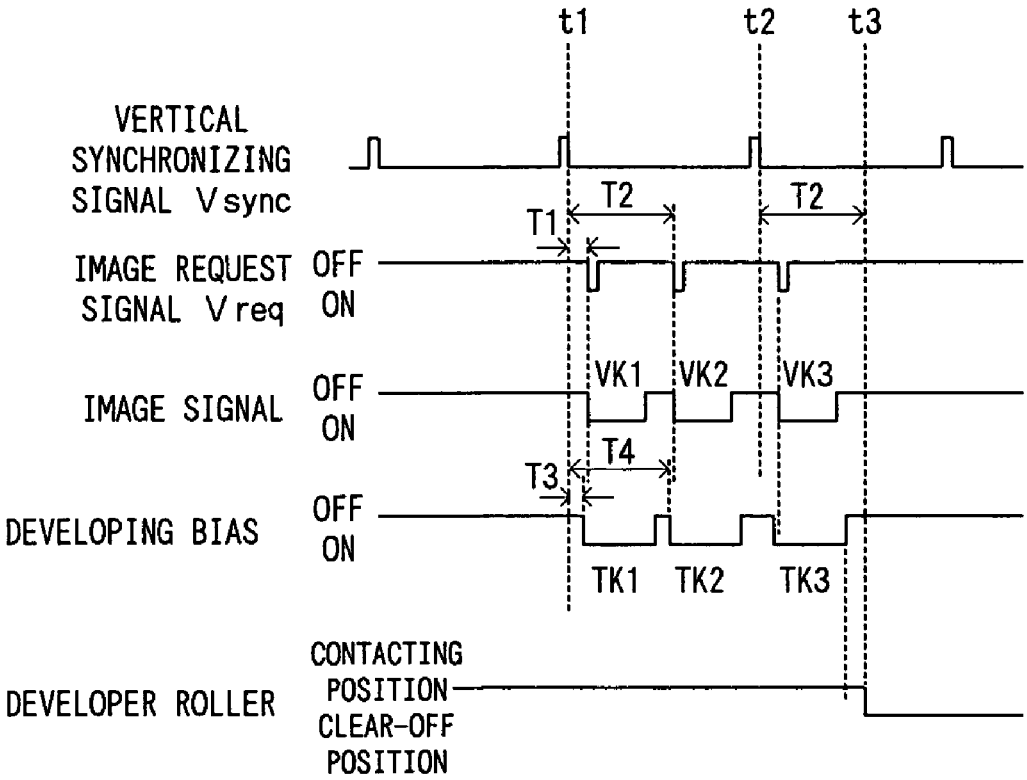
FIG. 54 is a timing chart which shows an example of an operation sequence.

FIG. 54 is a timing chart which shows an example of an operation sequence regarding the respective portions of the engine part 1. The illustrated example assumes that a received print instruction signal demands to form three images under two-image transfer control. When the main controller 100 is provided with a print instruction signal containing an image signal from an external apparatus such as a host computer, the engine controller 110 starts controlling the respective portions of the engine part 1 in accordance with a control signal received from the main controller 100.

That is, the intermediate transfer belt 141 rotates approximately at a predetermined circumferential speed, whereby the vertical synchronizing signal Vsync is outputted periodically. An image request signal Vreq regarding the first image is outputted after a predetermined period of time T1 from the falling edge t1 of the vertical synchronizing signal Vsync. In synchronization to falling of the image request signal Vreq, an image signal VK1 representing the first image is outputted and formation of an electrostatic latent image is initiated. After a predetermined period of time T2 (>T1) from the falling edge t1 of the vertical synchronizing signal Vsync, the image request signal Vreq regarding the second image is outputted. In synchronization to falling of the image request signal Vreq, an image signal VK2 representing the second image is outputted and formation of an electrostatic latent image is started.

The developing bias is turned on after predetermined periods of time T3 and T4 from the time t1, and turned off after a predetermined period of time which is determined in advance in accordance with the size of the transfer paper. In consequence, a toner image TK1 is primarily transferred onto the sub area 256A which is located on the downstream side within the transfer area 256 of the intermediate transfer belt 141 along the rotation/driving direction 252 and a toner image TK2 is primarily transferred onto the sub area 256B which is located on the upstream side within the transfer area 256 of the intermediate transfer belt 141 along the rotation/driving direction 252.

The transfer paper 4 is fed from the paper cassette 3 toward the secondary transfer position 45 in synchronization to the primary transfer, and application of a secondary transfer bias upon the secondary transfer roller 42 is activated after a predetermined period of time from the falling edge to of the vertical synchronizing signal Vsync. As a result, the toner image TK1 which has been primarily transferred onto the sub area 256A, which is located on the downstream side within the transfer area 256 of the intermediate transfer belt 141 along the rotation/driving direction 252, is secondarily transferred onto the first transfer paper 4. Further, the next transfer paper 4 is transported from the paper cassette 3, timed with the next toner image TK2. Application of the secondary transfer bias is activated after a predetermined period of time from the time t1. In consequence, the toner image TK2 which has been primarily transferred onto the sub area 256B, which is located on the upstream side within the transfer area 256 of the intermediate transfer belt 141 along the rotation/driving direction 252, is secondarily transferred onto the second transfer paper 4. Two images are thus formed.

In synchronization to the next falling edge t2 of the vertical synchronizing signal Vsync, the first image (which is the third image as counted from the beginning) is formed in a similar manner. That is, the image request signal Vreq is outputted after the predetermined period of time T1 from the time t2, and an image signal VK3 is outputted in synchronization to falling of the image request signal Vreq. The developing bias is turned on after a predetermined period of time T3 from the time t2, the ON-state is continued for a period determined in accordance with the transfer paper size, the first toner image TK3 is formed, and the developing bias is then turned off.

Formation of the three images in response to the print instruction signal has thus completed, and therefore, the image request signal Vreq regarding the second image will not be outputted after the predetermined period of time T2 from the falling edge t2 of the vertical synchronizing signal Vsync. Noting this, at the time t3 after the turning off of the developing bias for formation of the toner image TK3 (e.g., after the predetermined period of time T2 from the falling edge t2 of the vertical synchronizing signal Vsync), the actuator 31B is driven and the developer roller 31 retracts to the clear-off position from the contacting position.

Figure 55:
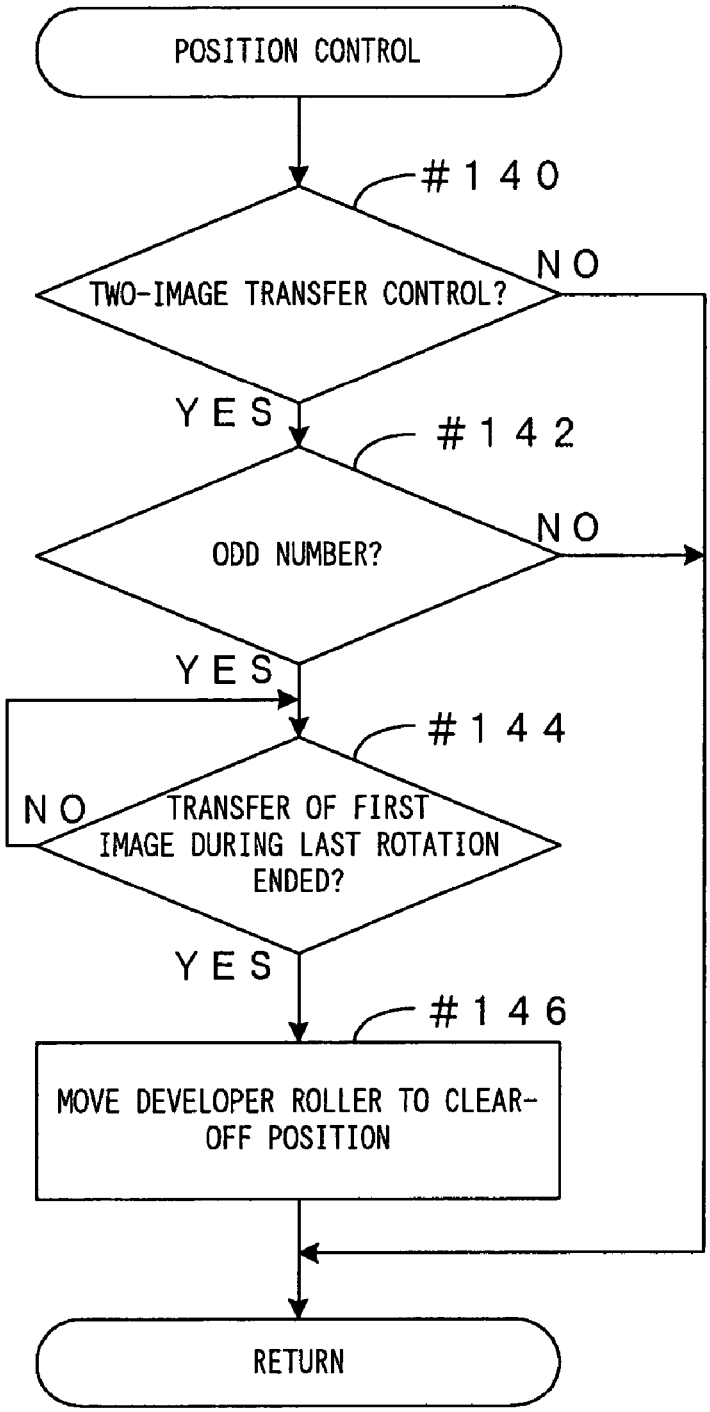
FIG. 55 is a flow chart which shows an example of a position control routine.

FIG. 55 is a flow chart which shows an example of a position control routine for the developer roller. A position control program is stored in advance in the memory 116 of the engine controller 110. As the CPU 113 controls the respective portions of the apparatus in accordance with the program, the following position control process is executed.

First, whether a print instruction signal received from an external apparatus via the main controller 100 (the CPU 101) demands two-image transfer control is determined (#140). When the print instruction signal demands two-image transfer control (YES at #140), whether the demanded number of images is an odd number is determined (#142). When the print instruction signal does not demand two-image transfer control (NO at #140) or when the demanded number of images is not an odd number (NO at #142), this routine is terminated. On the contrary, when the demanded number of images is an odd number (YES at #142), the apparatus waits until the end of transfer of the first image carried during the last rotation of the intermediate transfer belt 141 (NO at #144). When the transfer of the first image during the last rotation has come to an end (YES at #144), the actuator 31B is driven, the developer roller 31 is moved to the clear-off position (#146), and this routine is terminated.

Execution of the position control routine which is shown in FIG. 55 realizes a sequence of operations that the developer roller 31 moves as shown in FIG. 54. After the developer roller 31 has retracted to the clear-off position, the developer roller 31 may be kept on standby at the clear-off position until receipt of the next print instruction signal.

As described above, according to the eleventh preferred embodiment, the developer roller 31 is capable of moving between the contacting position and the clear-off position, and the position of the developer roller 31 is controlled depending on the state of toner image formation. In other words, as for the state of toner image formation, when the second image is not to be formed under two-image transfer control, the developer roller 31 retracts to the clear-off position during a period which corresponds to the second image (namely, a non-transfer area onto which no toner image will be transferred). This permits to avoid a wasteful consumption of the carrier liquid 321.

<Twelfth Preferred Embodiment>

Figure 56:
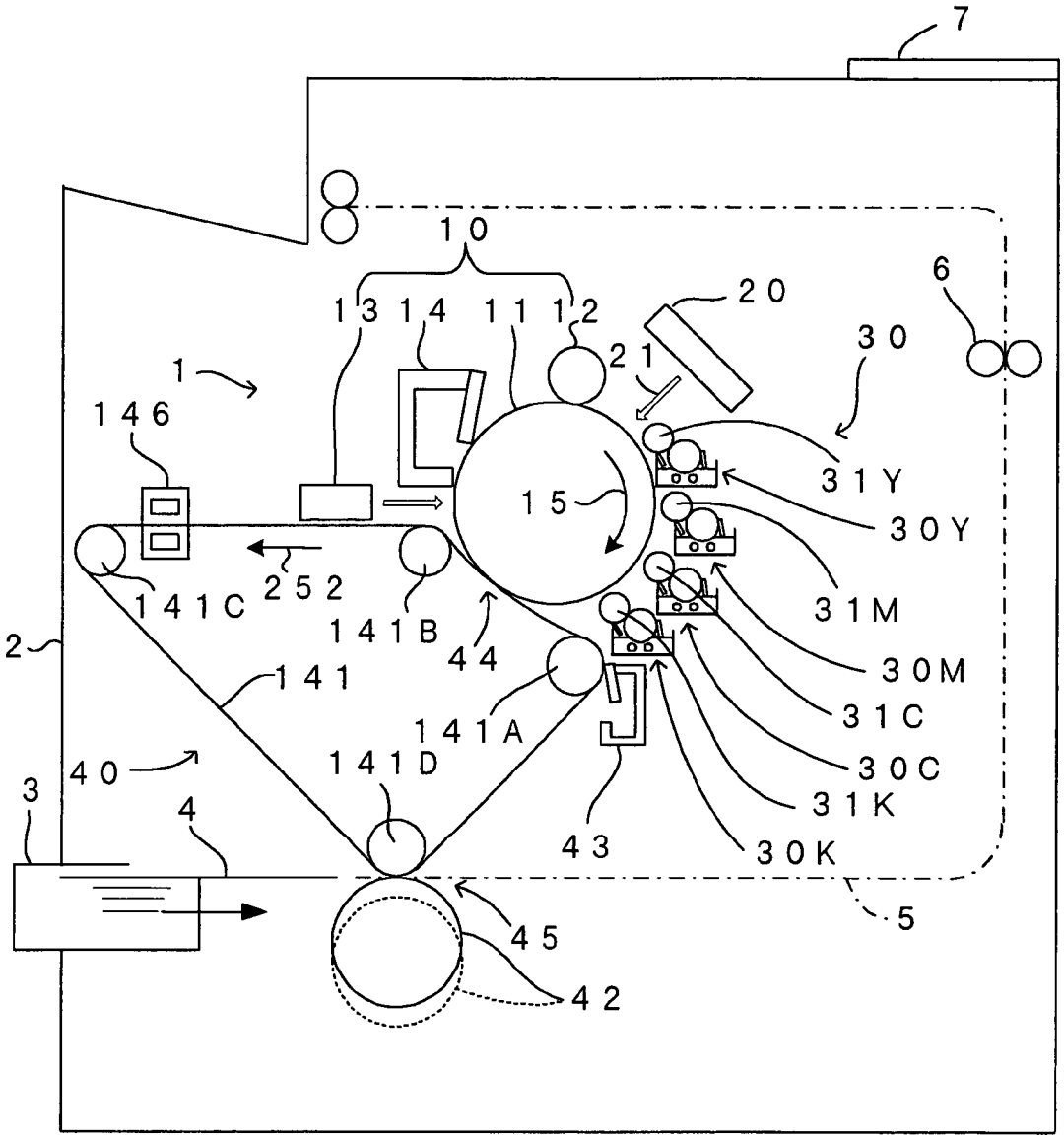
FIG. 56 is a drawing which shows an internal structure of a printer which is a twelfth preferred embodiment of the present invention.

FIG. 56 is a drawing which shows an internal structure of a printer which is a twelfth preferred embodiment of the image forming apparatus according to the present invention. A large difference of the twelfth preferred embodiment from the eleventh preferred embodiment is that the twelfth preferred embodiment uses a developer unit for each one of black (K), cyan (C), magenta (M) and yellow (Y) colors for the purpose of forming a color image. Other structures are basically similar to those according to the eleventh preferred embodiment. Hence, the same elements are denoted at the same reference symbols and will not be described.

According to the twelfth preferred embodiment, there are developer units 30K, 30C, 30M and 30Y respectively for the respective toner colors. The developer units 30K, 30C, 30M and 30Y are capable of moving between contacting positions and clear-off positions independently of each other each by the actuator 31B (FIG. 51). The contacting positions are development-permitting positions at which the liquid developer on developer rollers 31K, 31C, 31M and 31Y of the developer units 30K, 30C, 30M and 30Y contact the photosensitive member 11. The clear-off positions are positions at which such liquid developer remains not in contact with the photosensitive member 11.

As for the yellow color for example, an electrostatic latent image which corresponds to the yellow color is formed on the photosensitive member 11 in accordance with job data received from the main controller 100. The developer unit 30Y is selectively moved to the contacting position, supplies the liquid developer to the photosensitive member 11, develops the electrostatic latent image, and accordingly forms a toner image. Following this, the toner image is primarily transferred onto the surface of the intermediate transfer belt 141 at the primary transfer position 44, whereby a primarily transferred toner image is obtained. This is exactly the same as for the other toner colors.

In the image forming apparatus having such a structure, toner images in the respective colors of black (K), cyan (C), magenta (M) and yellow (Y) are formed, and these toner images are superimposed one atop the other on the surface of the intermediate transfer belt 141, so that a primarily transferred full-color toner image is formed. At the stage that the toner images in the four colors have been superimposed one atop the other, the secondary transfer roller 42 moves from a clear-off position (denoted at the broken line in FIG. 56) to a transfer-permitting position (denoted at the solid line in FIG. 56). The primarily transferred toner image is then transported to the secondary transfer position 45. Meanwhile, in synchronization to rotations of the intermediate transfer belt 141, the transfer paper 4 housed in the paper cassette 3 is transported to the secondary transfer position 45, and the primarily transferred toner image is secondarily transferred onto the transfer paper 4 in a similar manner to that according to the eleventh preferred embodiment. In the twelfth preferred embodiment, the developer units 30K, 30C, 30M and 30Y thus correspond to "developing means" of the present invention, and the developer rollers 31K, 31C, 31M and 31Y thus correspond to the "liquid developer carrier" of the present invention.

Figure 57:
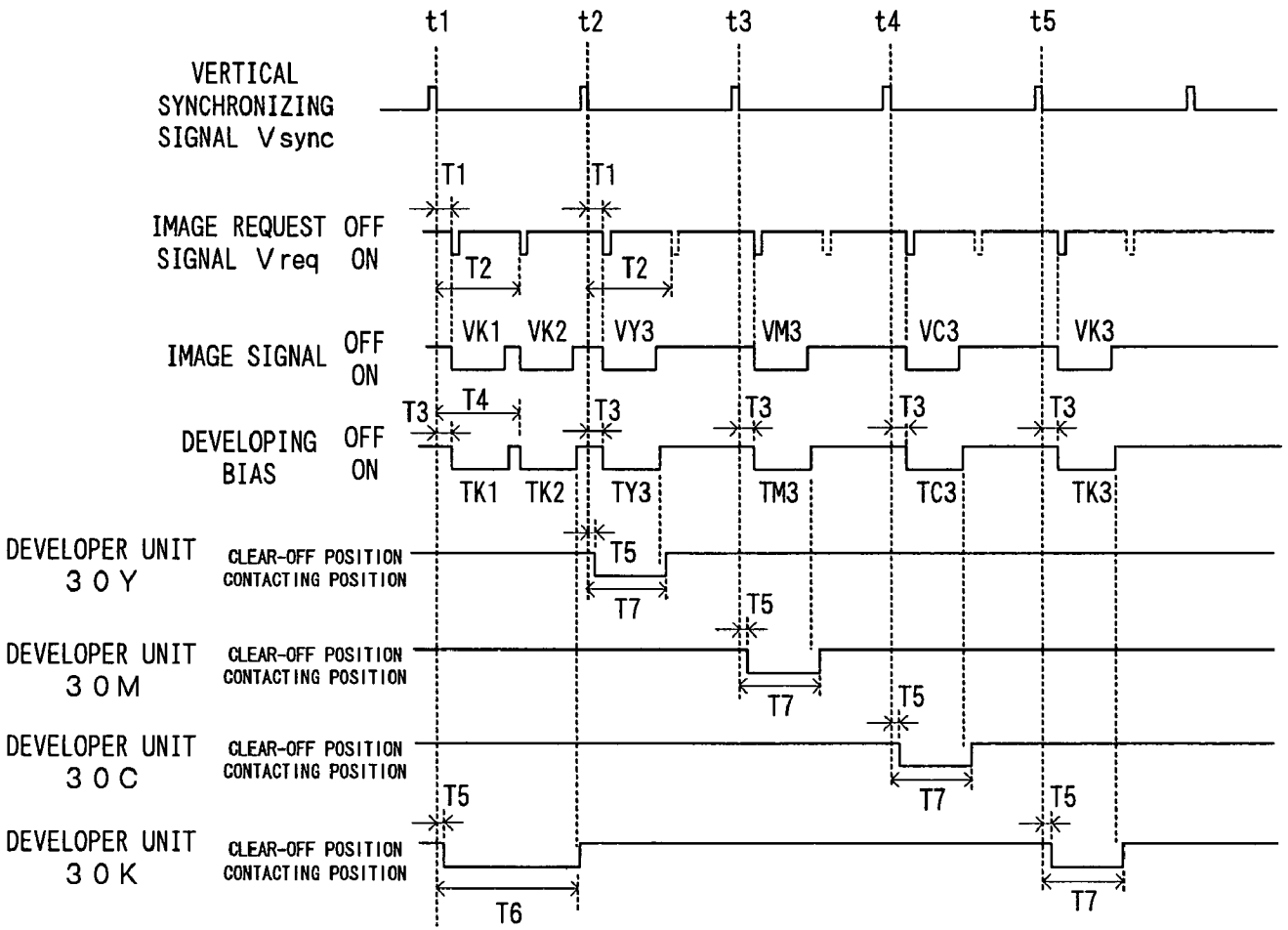
FIG. 57 is a timing chart which shows an operation sequence according to the twelfth preferred embodiment.

FIG. 57 is a timing chart which shows an operation sequence according to the twelfth preferred embodiment. The illustrated example assumes that a received print instruction signal demands to form three images under two-image transfer control, which is similar to the eleventh preferred embodiment. The respective portions of the engine part 1 have already started operating by the time t1 in FIG. 57. First toner images in the respective colors of yellow (Y), magenta (M) and cyan (C) corresponding to the first image have been superimposed one atop the other and second toner images in the respective colors of yellow (Y), magenta (M) and cyan (C) corresponding to the second image have been superimposed one atop the other on the intermediate transfer belt 141.

The image request signal Vreq regarding the first image is outputted after the predetermined period of time T1 from the falling edge t1 of the vertical synchronizing signal Vsync. In synchronization to falling of the image request signal Vreq, the image signal VK1 representing the first black (K) image is outputted and formation of an electrostatic latent image is started. After the predetermined period of time T2 (>T1) from the falling edge t1 of the vertical synchronizing signal Vsync, the image request signal Vreq regarding the second black (K) image is outputted, and in synchronization to falling of this image request signal Vreq, the image signal VK2 representing the second image is outputted and formation of an electrostatic latent image is started. The developing bias for the first image is turned on after the predetermined period of time T3 from the time t1, and turned off after a predetermined period of time which is determined in advance in accordance with the size of the transfer paper. Further, the developing bias for the second image is turned on after a predetermined period of time T4 from the time t1, and turned off after a predetermined period of time. As a result, the toner images TK1 and TK2 are further superimposed, whereby a primarily transferred full-color toner image is formed.

The transfer paper 4 is fed from the paper cassette 3 toward the secondary transfer position 45 in synchronization to the primary transfer of the toner image TK1, and application of a secondary transfer bias upon the secondary transfer roller 42 is activated after a predetermined period of time from the falling edge t1 of the vertical synchronizing signal Vsync. As a result, the color toner image which has been primarily transferred onto the sub area 256A, which is located on the downstream side within the transfer area 256 of the intermediate transfer belt 141 along the rotation/driving direction 252, is secondarily transferred onto the first transfer paper 4. Further, the next transfer paper 4 is transported from the paper cassette 3, timed with the next toner image TK2. Application of the secondary transfer bias is activated after a predetermined period of time from the time t1. In consequence, the color toner image which has been primarily transferred onto the sub area 256B, which is located on the upstream side within the transfer area 256 of the intermediate transfer belt 141 along the rotation/driving direction 252, is secondarily transferred onto the second transfer paper 4.

At this stage, the developer unit 30K moves to the contacting position from the clear-off position after a predetermined period of time T5 from the time t1, and retracts back to the clear-off position after a predetermined period of time T6 which corresponds to the timing after the end of the application of the developing bias.

In synchronization to the next falling edge t2 of the vertical synchronizing signal Vsync, the first toner image TY3 (which is the third image as counted from the beginning) is formed in a similar manner to that described above. To be more specific, the image request signal Vreq is outputted after the predetermined period of time T1 from the time t2, and an image signal VY3 is outputted in synchronization to falling of this image request signal Vreq. The developing bias is turned on after the predetermined period of time T3 from the time t2, the ON-state is continued for a period determined in accordance with the transfer paper size, the first toner image TY3 is formed, and the developing bias is then turned off. Formation of the three images in response to the print instruction signal has thus completed, and therefore, the image request signal Vreq for the second image will not be outputted after the predetermined period of time T2 from the falling edge t2 of the vertical synchronizing signal Vsync.

At this stage, the developer unit 30Y moves to the contacting position from the clear-off position after the predetermined period of time T5 from the time t1, develops the first image but does not develop the second image. The developer unit 30Y therefore retracts back to the clear-off position after a predetermined period of time T7 (<T6) which corresponds to the timing after the end of the application of the developing bias.

First toner images TM3, TC3, and TK3 are then formed in a similar fashion. That is, after the predetermined period of time T1 from the time t3, t4 and t5, the image request signals Vreq are respectively outputted. In synchronization to falling of the image request signals Vreq, image signals VM3, VC3 and VK3 are outputted. The developing bias is turned on after the predetermined period of time T3 from the time t3, t4 and t5, the ON-state is continued for a period determined in accordance with the transfer paper size, the first toner images TM3, TC3 and TK3 are formed, and the developing bias is then turned off.

At this stage, the developer units 30M, 30C and 30K move to the contacting positions from the clear-off positions after the predetermined period of time T5 from the time t3, t4 and t5, develop the first images but do not develop the second images. The developer units 30M, 30C and 30K therefore retract back to the clear-off positions after the predetermined period of time T7 which corresponds to the timing after the end of the application of the developing bias.

As described above, according to the twelfth preferred embodiment, the developer units 30K, 30C, 30M and 30Y are capable of moving between contacting positions and clear-off positions, and the positions of the developer units 30K, 30C, 30M and 30Y are controlled depending on the state of toner image formation. In other words, as for the state of toner image formation, when a second image is not to be formed under two-image transfer control, the developer units 30K, 30C, 30M and 30Y retract to the clear-off positions during a period which corresponds to the second image. This permits to avoid a wasteful consumption of the carrier liquid 321, as in the eleventh preferred embodiment.

<Modifications of Eleventh and Twelfth Preferred Embodiments>

The present invention is not limited to the preferred embodiments described above, but may be modified in various manners in addition to the preferred embodiments described above, to the extent not deviating from the object of the invention. For instance, although the eleventh and the twelfth preferred embodiments allow to transfer two images during one rotation of the intermediate transfer belt 141, this is not limiting. In the event that n (where n is an integer equal to or larger than 3) images can be transferred while the intermediate transfer belt rotates one round, at the time of transfer of less than n images during the last rotation, the developer roller 31 is moved to the clear-off position only during a period of time which corresponds to a non-image transfer area and lasts from the end of the transfer of the images until the end of the last rotation.

Further, although the developer roller 31 alone can move in the eleventh preferred embodiment described above, this is not limiting. An alternative is to make the entire developer unit 30 movable and to accordingly allow the developer roller 31 to move between the contacting position and the clear-off position. In such an embodiment, the developer unit 30 corresponds to the "developing means" of the present invention.

In addition, although the entire developer units 30K, 30C, 30M and 30Y can each move in the twelfth preferred embodiment described above, this is not limiting. Instead, the developer rollers 31K, 31C, 31M and 31Y alone may be made movable between the contacting positions and the clear-off positions.

Still further, the foregoing has described the eleventh and the twelfth preferred embodiments in relation to a printer which prints on a transfer paper an image fed from an external apparatus such as a host computer, the present invention is not limited to this but is applicable to electrophotographic image forming apparatuses in general including copier machines, facsimile machines and the like.

Although the invention has been described with reference to specific embodiments, this description is not meant to be construed in a limiting sense. Various modifications of the disclosed embodiments, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. A liquid development apparatus in which an electrostatic latent image formed on an image carrier is developed by means of a liquid developer including charged toner dispersed in a carrier liquid, comprising:

a liquid developer carrier which transports said liquid developer toward a predetermined developing position while carrying said liquid developer on its surface; and density adjusting means which performs adjustment of a toner density in said liquid developer on said liquid developer carrier, wherein said density adjusting means comprises at least one stripping member which is disposed facing an area on said liquid developer carrier extending from a carrying start position, at which carrying of said liquid developer starts, to said developing position, contacts said liquid developer carried on said liquid developer carrier, and strips off a portion of said liquid developer, and an amount of toner contained in said portion of said liquid developer stripped off by said stripping member is controlled, whereby said adjustment is performed.

2. The liquid development apparatus of claim 1, wherein said density adjusting means further comprises voltage applying means which applies a bias voltage between said stripping member and said liquid developer carrier, and the bias voltage applied by said voltage applying means is controlled, whereby the amount of toner contained in said portion of said liquid developer is controlled.

3. The liquid development apparatus of claim 1, wherein said density adjusting means comprises a plurality of said stripping members which are arranged next to each other along a liquid developer transporting direction for transportation by said liquid developer carrier in such a manner that said plurality of said stripping members are faced against said liquid developer carrier, and the amount of toner contained in said portion of said liquid developer stripped off by each one of said plurality of said stripping members is controlled.

4. The liquid development apparatus of claim 3, wherein said density adjusting means further comprises a plurality of voltage applying means which apply bias voltages between said plurality of said stripping members and said liquid developer carrier, and the bias voltages applied by said plurality of voltage applying means are controlled, whereby the amount of toner contained in said portion of said liquid developer is controlled.

5. The liquid development apparatus of claim 1, wherein said stripping member is disposed to move between an adjacent position at which said stripping member contacts with said liquid developer carried on said liquid developer carrier, and a clear-off position at which said stripping member is off said liquid developer.

6. The liquid development apparatus of claim 1, further comprising a container which holds said liquid developer, wherein said portion of said liquid developer stripped off by said stripping member is returned back to said container.

7. A liquid development apparatus in which an electrostatic latent image formed on an image carrier is developed by means of a liquid developer including charged toner dispersed in a carrier liquid, comprising:

a liquid developer carrier which transports said liquid developer toward a predetermined developing position while carrying said liquid developer on its surface;

density adjusting means which performs adjustment of a toner density in said liquid developer on said liquid developer carrier;

a container which holds said liquid developer;

liquid developer supplying means which supplies said liquid developer held in said container to said liquid developer carrier, wherein said density adjusting means controls an amount of toner contained in said liquid developer which is supplied to said liquid developer carrier from said container by said liquid developer supplying means, whereby said adjustment is performed, wherein said liquid developer supplying means comprises a liquid developer coating member which carries said liquid developer held in said container on its surface, brings thus carried liquid developer into contact with said liquid developer carrier and makes a portion of said liquid developer move toward said liquid developer carrier to thereby make said liquid developer carrier carry said liquid developer, and said density adjusting means controls the amount of toner contained in said portion of said liquid developer which moves toward said liquid developer carrier from said liquid developer coating member.

8. The liquid development apparatus of claim 7, wherein said density adjusting means comprises coating voltage applying means which applies a bias voltage between said liquid developer coating member and said liquid developer carrier, and the bias voltage applied by said coating voltage applying means is controlled, whereby the amount of toner contained in said portion of said liquid developer is controlled.

9. The liquid development apparatus of claim 7, wherein said liquid developer supplying means further comprises a scoop-up member which scoops up said liquid developer held in said container, said liquid developer coating member contacts said liquid developer which is scooped up by said scoop-up member and carries on its surface a portion of said liquid developer thus scooped up, and said density adjusting means controls the amount of toner contained in said portion of said liquid developer which moves from said scoop-up member toward said liquid developer coating member.

10. The liquid development apparatus of claim 9, wherein said density adjusting means comprises scoop-up voltage applying means which applies a bias voltage between said scoop-up member and said liquid developer coating member, and the bias voltage applied by said scoop-up voltage applying means is controlled, whereby the amount of toner contained in said portion of said liquid developer is controlled.

11. The liquid development apparatus of claim 7, wherein said liquid developer supplying means further comprises a plurality of scoop-up members which scoop up said liquid developer held in said container, said liquid developer coating member contacts said liquid developer scooped up by said plurality of scoop-up members and carries on its surface a portion of said liquid developer thus scooped up, and said density adjusting means controls the amount of toner contained in said liquid developer which moves from at least one of said plurality of scoop-up members toward said liquid developer coating member.

12. The liquid development apparatus of claim 11, wherein said density adjusting means comprises scoop-up voltage applying means which applies a bias voltage between at least one of said plurality of scoop-up members and said liquid developer coating member, and the bias voltage applied by said scoop-up voltage applying means is controlled, whereby the amount of toner contained in said liquid developer is controlled.

13. A liquid development apparatus in which an electrostatic latent image formed on an image carrier is developed by means of a liquid developer including charged toner dispersed in a carrier liquid, comprising:

a liquid developer carrier which transports said liquid developer toward a predetermined developing position while carrying said liquid developer on its surface;

density adjusting means which performs adjustment of a toner density in said liquid developer on said liquid developer carrier;

a container which holds said liquid developer; and a plurality of liquid developer supplying means which supply said liquid developer held in said container to said liquid developer carrier, wherein said density adjusting means controls an amount of toner contained in said liquid developer supplied from said container to said liquid developer carrier by each one of said plurality of liquid developer supplying means, whereby said adjustment is performed.

14. The liquid development apparatus of claim 13, wherein each one of said plurality of liquid developer supplying means comprises a liquid developer coating member which carries said liquid developer held in said container on its surface, brings thus carried liquid developer into contact with said liquid developer carrier and makes a portion of said liquid developer move toward said liquid developer carrier to thereby make said liquid developer carrier carry said liquid developer, and said density adjusting means controls the amount of toner contained in said liquid developer which moves from each one of said plurality of liquid developer coating members toward said liquid developer carrier.

15. The liquid development apparatus of claim 14, wherein said density adjusting means comprises coating voltage applying means which applies a bias voltage between each one of said plurality of liquid developer coating members and said liquid developer carrier, and each bias voltage applied by said coating voltage applying means is controlled, whereby the amount of toner contained in said liquid developer which moves from each one of said plurality of liquid developer coating members toward said liquid developer carrier is controlled.

16. The liquid development apparatus of claim 13, wherein each one of said plurality of liquid developer supplying means comprises:

a scoop-up member which scoops up said liquid developer held in said container; and a liquid developer coating member which contacts said liquid developer scooped up by said scoop-up member and accordingly carries a portion of said liquid developer on its surface, brings thus carried liquid developer into contact with said liquid developer carrier and accordingly makes said liquid developer carrier carry a portion of thus carried liquid developer, and wherein said density adjusting means controls the amount of toner contained in said liquid developer which moves from each one of said scoop-up members toward each corresponding one of said liquid developer coating members, and controls the amount of toner contained in said liquid developer which moves from each one of said liquid developer coating members toward said liquid developer carrier.

17. The liquid development apparatus of claim 16, wherein said density adjusting means comprises:

scoop-up voltage applying means which applies a bias voltage between each one of said scoop-up members and each corresponding one of said liquid developer coating members; and coating voltage applying means which applies a bias voltage between each one of said liquid developer coating members and said liquid developer carrier, wherein each bias voltage applied by said scoop-up voltage applying means is controlled, whereby the amount of toner contained in said liquid developer which moves from each one of said scoop-up members toward each corresponding one of said liquid developer coating members is controlled, and wherein each bias voltage applied by said coating voltage applying means is controlled, whereby the amount of toner contained in said liquid developer which moves from each one of said liquid developer coating members toward said liquid developer carrier is controlled.

18. The liquid development apparatus of claim 13, wherein of said liquid developer transported by said liquid developer supplying means to outside said container from within said container, said liquid developer failing to be carried on said liquid developer carrier is returned back to said container.

19. A liquid development apparatus in which an electrostatic latent image formed on an image carrier is developed by means of a liquid developer including charged toner dispersed in a carrier liquid, comprising:

a liquid developer carrier which transports said liquid developer toward a predetermined developing position while carrying said liquid developer on its surface;

density adjusting means which performs adjustment of a toner density in said liquid developer on said liquid developer carrier;

a container which holds said liquid developer, wherein said density adjusting means comprises at least one stripping member which is disposed facing against an area on said liquid developer carrier located on a downstream side to said developing position along liquid developer transporting direction for transportation by said liquid developer carrier, and which contacts said liquid developer remaining on said liquid developer carrier after the end of development and accordingly strips off a portion of said liquid developer, an amount of toner contained in said portion of said liquid developer stripped off by said stripping member is controlled, whereby said adjustment is performed, and said portion of said liquid developer stripped off by said stripping member is returned back to said container.

20. A liquid development apparatus in which an electrostatic latent image formed on an image carrier is developed by means of a liquid developer including charged toner dispersed in a carrier liquid, comprising:

a liquid developer carrier which transports said liquid developer toward a predetermined developing position while carrying said liquid developer on its surface;

density adjusting means which performs adjustment of a toner density in said liquid developer on said liquid developer carrier;

a container which holds said liquid developer; and a cleaning member which removes said liquid developer remaining on said liquid developer carrier at a cleaning position on said liquid developer carrier located on a downstream side to said developing position along a liquid developer transporting direction for transportation by said liquid developer carrier, wherein said density adjusting means comprises at least one stripping member which is disposed facing against an area on said liquid developer carrier extending from said developing position to said cleaning position, and which contacts said liquid developer remaining on said liquid developer carrier after the end of development and accordingly strips off a portion of said liquid developer, an amount of toner contained in said portion of said liquid developer stripped off by said stripping member is controlled, whereby said adjustment is performed, said cleaning member removes said liquid developer remaining on said liquid developer carrier after said stripping member has stripped off said portion of said liquid developer, and said liquid developer removed by said cleaning member is returned back to said container.

21. An image forming apparatus, comprising:

exposure means which forms an electrostatic latent image on a surface of an image carrier;

developing means which develops said electrostatic latent image by means of a liquid developer including charged toner dispersed in a carrier liquid and accordingly forms a toner image;

transfer means which transfers said toner image thus formed onto a transfer medium, wherein said developing means comprises a liquid developer carrier which transports said liquid developer toward a predetermined developing position while carrying said liquid developer on its surface, and density adjusting means which performs adjustment of a toner density in said liquid developer on said liquid developer carrier; and optical density detecting means which detects an optical density of a toner image which is obtained as said developing means develops said electrostatic latent image, wherein said density adjusting means performs said adjustment based on said optical density thus detected.

22. An image forming apparatus, comprising:

an image carrier structured to carry an electrostatic latent image on its surface;

a container which holds a liquid developer including charged toner dispersed in a carrier liquid;

a liquid developer carrier which transports said liquid developer toward a predetermined developing position while carrying said liquid developer on its surface, brings said liquid developer into contact with said image carrier at said developing position, and accordingly supplies said liquid developer to said image carrier;

image forming means which makes toner contained in said liquid developer supplied to said image carrier from said liquid developer carrier adhere to said image carrier, visualizes said electrostatic latent image and accordingly forms a toner image; and collecting means which collects said carrier liquid contained in said liquid developer supplied from said liquid developer carrier at said developing position and adhering to said image carrier, and returns said carrier liquid back into said container, wherein a returning amount of said carrier liquid returned by said collecting means back into said container is adjustable.

23. The image forming apparatus of claim 22, wherein said collecting means is structured to adjust a collection amount of said carrier liquid, and returns all of collected said carrier liquid of the adjusted collection amount back into said container.

24. The image forming apparatus of claim 23, wherein said collecting means comprises a stripping member which is structured to be disposed at a contacting position at which said stripping member contacts said liquid developer on said image carrier, and strips off said carrier liquid which is in a surface layer of said liquid developer when disposed at said contacting position, and a stripped amount of said carrier liquid stripped off by said stripping member is controlled, thereby adjusting said collection amount.

25. The image forming apparatus of claim 24, wherein said collecting means comprises, as said stripping member, a plurality of stripping members which are arranged next to each other along a liquid developer transporting direction for transportation by said image carrier in such a manner that said plurality of stripping members are faced against said image carrier, at least one of said plurality of stripping members is structured to move between said contacting position and a clear-off position which is off said liquid developer on said image carrier, and a combination of said plurality of stripping members contacting said liquid developer on said image carrier is controlled through position control of said stripping member structured to move, thereby controlling said stripped amount.

26. The image forming apparatus of claim 24, wherein said collecting means comprises, as said stripping member, a stripping member which is structured to be disposed at a plurality of contacting positions which are at different distances from said image carrier from each other and at which said stripping member contacts said liquid developer on said image carrier, and said contacting position of said stripping member is changed, thereby controlling said stripped amount.

27. The image forming apparatus of claim 24, wherein a relative velocity of a contact surface of said stripping member relative to said liquid developer which is transported by said image carrier is changed, thereby controlling said stripped amount.

28. The image forming apparatus of claim 24, wherein said collecting means further comprises a cleaning member which removes said carrier liquid which has been stripped off by said stripping member from said stripping member, and said carrier liquid removed by said cleaning member is returned back to said container.

29. The image forming apparatus of claim 28, wherein said cleaning member abuts on said stripping member and scrapes off said carrier liquid from said stripping member, and an opening of said container stretches out toward below an abutting position at which said cleaning member abuts on said stripping member so that said carrier liquid removed by said cleaning member will return by its own weight back into said container.

30. The image forming apparatus of claim 23, further comprising calculating means which calculates an image occupation ratio which is a ratio of an image portion to said electrostatic latent image, wherein said collection amount is adjusted in accordance with said image occupation ratio.

31. The image forming apparatus of claim 23, wherein said collection amount is adjusted so that a toner density in said liquid developer which remains on said image carrier after said collecting means has collected said carrier liquid will become closer to an initial value of the toner density in said liquid developer held in said container.

32. The image forming apparatus of claim 22, further comprising toner density detecting means which detects a toner density in said liquid developer held in said container, wherein said returning amount is adjusted so that the toner density detected by said toner density detecting means will become closer to an initial value of the toner density in said liquid developer held in said container.

33. The image forming apparatus of claim 22, further comprising transfer means which transfers the toner image on said image carrier onto a transfer medium, wherein said collecting means collects said carrier liquid off from said image carrier before transfer of the toner image onto said transfer medium.

34. An image forming method in which an electrostatic latent image formed on an image carrier is developed by means of a liquid developer including charged toner dispersed in a carrier liquid, comprising:

a liquid developer supplying step of transporting said liquid developer toward a predetermined developing position while carrying said liquid developer on a surface of a liquid developer carrier, bringing said liquid developer into contact with said image carrier at said developing position, and accordingly supplying said liquid developer to said image carrier;

an image forming step of making toner contained in said liquid developer supplied to said image carrier from said liquid developer carrier adhere to said image carrier, visualizing said electrostatic latent image and accordingly forming a toner image; and a collecting step of collecting said carrier liquid contained in said liquid developer supplied from said liquid developer carrier at said developing position and adhering to said image carrier, and returning said carrier liquid back into said container, wherein said returning amount of said carrier liquid returned back to said container at said collecting step is adjusted.

35. An image forming apparatus, comprising:

an image carrier structured to carry an electrostatic latent image on its surface;

a liquid developer carrier which transports a liquid developer including charged toner dispersed in a carrier liquid toward a predetermined developing position while carrying said liquid developer on its surface, brings said liquid developer into contact with said image carrier at said developing position, and accordingly supplies said liquid developer to said image carrier; and image forming means which makes toner contained in said liquid developer supplied to said image carrier from said liquid developer carrier adhere to said image carrier, visualizes said electrostatic latent image and accordingly forms a toner image, wherein a consumption amount of said carrier liquid which is consumed for formation of the toner image is adjusted.

36. The image forming apparatus of claim 35, wherein said liquid developer carrier is structured to move between a development-permitting position, at which said liquid developer on said liquid developer carrier is brought into contact with said image carrier at said developing position, and a clear-off position at which said liquid developer on said liquid developer carrier does not contact said image carrier, and said consumption amount is adjusted through position control of said liquid developer carrier.

37. The image forming apparatus of claim 35, further comprising collecting means which collects a portion of said carrier liquid contained in said liquid developer which is transported toward said developing position while carried on said liquid developer carrier, wherein a collection amount of said carrier liquid collected by said collecting means is controlled, thereby adjusting said consumption amount.

38. The liquid development apparatus of claim 37, wherein said collecting means comprises a stripping member which is structured to be disposed at a contacting position at which said stripping member contacts said liquid developer on said liquid developer carrier in an area extending from a carrying start position, at which carrying of said liquid developer starts, to said developing position, and which strips off said carrier liquid which is in a surface layer of said liquid developer when disposed at said contacting position, and a stripped amount of said carrier liquid stripped off by said stripping member is controlled, thereby controlling said collection amount.

39. The image forming apparatus of claim 38, wherein said collecting means comprises, as said stripping member, a plurality of stripping members which are arranged next to each other along a liquid developer transporting direction for transportation by said liquid developer carrier in such a manner that said plurality of stripping members are faced against said liquid developer carrier, at least one of said plurality of stripping members is structured to move between said contacting position and a clear-off position which is off said liquid developer on said liquid developer carrier, and a combination of said plurality of stripping members contacting said liquid developer on said liquid developer carrier is controlled through position control of said stripping member structured to move, thereby controlling said stripped amount.

40. The image forming apparatus of claim 39, further comprising:

a container which holds said liquid developer; and a cleaning member which removes said carrier liquid which has been stripped off by said stripping member from said stripping member, wherein said carrier liquid removed by said cleaning member is returned back to said container.

41. The image forming apparatus of claim 40, wherein said cleaning member abuts on said stripping member and scrapes off said carrier liquid from said stripping member, and an opening of said container stretches out toward below an abutting position at which said cleaning member abuts on said stripping member so that said carrier liquid removed by said cleaning member will return by its own weight back into said container.

42. The image forming apparatus of claim 38, wherein said collecting means comprises, as said stripping member, a stripping member which is structured to be disposed at a plurality of contacting positions which are at different distances from said liquid developer carrier from each other and at which said stripping member contacts said liquid developer on said liquid developer carrier, and said contacting position of said stripping member is changed, thereby controlling said stripped amount.

43. The image forming apparatus of claim 38, wherein a relative velocity of a contact surface of said stripping member relative to said liquid developer which is transported by said liquid developer carrier is changed, thereby controlling said stripped amount.

44. The image forming apparatus of claim 38, further comprising voltage applying means which applies a bias voltage, which makes toner contained in said liquid developer move toward said liquid developer carrier, between said stripping member and said liquid developer carrier.

45. The image forming apparatus of claim 35, further comprising:

transfer means which transfers the toner image on said image carrier onto a transfer medium at a predetermined transfer position; and collecting means which collects a portion of said carrier liquid contained in said liquid developer which is transported toward said transfer position from said developing position while carried on said image carrier, wherein a collection amount of said carrier liquid collected by said collecting means is controlled, thereby adjusting said consumption amount.

46. The image forming apparatus of claim 45, wherein said collecting means comprises a stripping member which is structured to be disposed at a contacting position at which said stripping member contacts said liquid developer on said image carrier, and strips off said carrier liquid which is in a surface layer of said liquid developer when disposed at said contacting position, and a stripped amount of said carrier liquid stripped off by said stripping member is controlled, thereby controlling said collection amount.

47. The image forming apparatus of claim 46, wherein said collecting means comprises, as said stripping member, a plurality of stripping members which are arranged next to each other along a liquid developer transporting direction for transportation by said image carrier in such a manner that said plurality of stripping members are faced against said image carrier, at least one of said plurality of stripping members is structured to move between said contacting position and a clear-off position which is off said liquid developer on said image carrier, and a combination of said plurality of stripping members contacting said liquid developer on said image carrier is controlled through position control of said stripping member structured to move, thereby controlling said stripped amount.

48. The image forming apparatus of claim 46, wherein said collecting means comprises, as said stripping member, a stripping member which is structured to be disposed at a plurality of contacting positions which are at different distances from said image carrier from each other and at which said stripping member contacts said liquid developer on said image carrier, and said contacting position of said stripping member is changed, thereby controlling said stripped amount.

49. The image forming apparatus of claim 46, wherein a relative velocity of a contact surface of said stripping member relative to said liquid developer which is transported by said image carrier is changed, thereby controlling said stripped amount.

50. The image forming apparatus of claim 46, further comprising:

a container which holds said liquid developer; and a cleaning member which removes said carrier liquid which has been stripped off by said stripping member from said stripping member, wherein said carrier liquid removed by said cleaning member is returned back to said container.

51. The image forming apparatus of claim 50, wherein said cleaning member abuts on said stripping member and scrapes off said carrier liquid from said stripping member, and an opening of said container stretches out toward below an abutting position at which said cleaning member abuts on said stripping member so that said carrier liquid removed by said cleaning member will return by its own weight back into said container.

52. The image forming apparatus of claim 45, wherein said collection amount is controlled so that a toner density in said liquid developer which remains on said image carrier after said collecting means has collected said carrier liquid will become closer to a predetermined value.

53. The image forming apparatus of claim 35, further comprising portion to said electrostatic latent image, wherein said consumption amount is adjusted in accordance with said image occupation ratio.

54. An image forming method in which an electrostatic latent image formed on an image carrier is developed by means of a liquid developer including charged toner dispersed in a carrier liquid, comprising:

a step of transporting said liquid developer toward a predetermined developing position, making toner contained in said liquid developer adhere to said image carrier at said developing position, visualizing said electrostatic latent image and accordingly forming a toner image; and a step of adjusting a consumption amount of said carrier liquid which is consumed for formation of the toner image.

55. An image forming apparatus, comprising:

an image carrier structured to carry an electrostatic latent image on its surface;

a liquid developer carrier which transports a liquid developer including charged toner dispersed in a carrier liquid toward a predetermined developing position while carrying said liquid developer on its surface, brings said liquid developer into contact with said image carrier at said developing position, and accordingly supplies said liquid developer to said image carrier;

image forming means which makes toner contained in said liquid developer supplied to said image carrier from said liquid developer carrier adhere to said image carrier, visualizes said electrostatic latent image and accordingly forms a toner image;

transfer means which transfers the toner image on said image carrier onto a transfer medium at a predetermined transfer position; and stripping means which strips off said carrier liquid from said liquid developer on said image carrier in a developed image carrying area which extends from said developing position to said transfer position, wherein a stripping amount of said carrier liquid which is stripped off by said stripping means is adjustable.

56. The image forming apparatus of claim 55, wherein said stripping means comprises a stripping member which is structured to be disposed at a contacting position at which said stripping member contacts said liquid developer on said image carrier, and strips off said carrier liquid which is in a surface layer of said liquid developer when disposed at said contacting position, and a stripped amount of said carrier liquid stripped off by said stripping member is controlled, thereby adjusting said stripping amount.

57. The image forming apparatus of claim 56, wherein said stripping means comprises, as said stripping member, a plurality of stripping members which are arranged next to each other along a liquid developer transporting direction for transportation by said image carrier in such a manner that said plurality of stripping members are faced against said image carrier, at least one of said plurality of stripping members is structured to move between said contacting position and a clear-off position which is off said liquid developer on said image carrier, and a combination of said plurality of stripping members contacting said liquid developer on said image carrier is controlled through position control of said stripping member structured to move, thereby controlling said stripped amount.

58. The image forming apparatus of claim 56, wherein said stripping means comprises, as said stripping member, a stripping member which is structured to be disposed at a plurality of contacting positions which are at different distances from said image carrier from each other and at which said stripping member contacts said liquid developer on said image carrier, and said contacting position of said stripping member is changed, thereby controlling said stripped amount.

59. The image forming apparatus of claim 56, wherein a relative velocity of a contact surface of said stripping member relative to said liquid developer which is transported by said image carrier is changed, thereby controlling said stripped amount.

60. The image forming apparatus of claim 56, further comprising:

a container which holds said liquid developer; and a cleaning member which removes said carrier liquid which has been stripped off by said stripping member from said stripping member, wherein said carrier liquid removed by said cleaning member is returned back to said container.

61. The image forming apparatus of claim 60, wherein said cleaning member abuts on said stripping member and scrapes off said carrier liquid from said stripping member, and an opening of said container stretches out toward below an abutting position at which said cleaning member abuts on said stripping member so that said carrier liquid removed by said cleaning member will return by its own weight back into said container.

62. The image forming apparatus of claim 55, wherein said stripping amount is adjusted so that a toner density in said liquid developer which remains on said image carrier after said stripping means has stripped off said carrier liquid will become closer to a predetermined value.

63. The image forming apparatus of claim 55, further comprising a container which holds said liquid developer, wherein said carrier liquid stripped off by said stripping means is returned back to said container, and said stripping amount is adjusted so that a toner density in said liquid developer which remains on said image carrier after said stripping means has stripped off said carrier liquid will become closer to an initial value of the toner density in said liquid developer held in said container.

64. The image forming apparatus of claim 55, further comprising calculating means which calculates an image occupation ratio which is a ratio of an image portion to said electrostatic latent image, wherein said stripping amount is adjusted in accordance with said image occupation ratio.

65. The image forming apparatus of claim 55, further comprising:

a container which holds said liquid developer; and toner density detecting means which detects a toner density in said liquid developer held in said container, wherein said carrier liquid stripped off by said stripping means is returned back to said container, and said stripping amount is adjusted so that the toner density detected by said toner density detecting means will become closer to an initial value of the toner density in said liquid developer held in said container.

66. An image forming method, comprising:

an image forming step of transporting a liquid developer including charged toner dispersed in a carrier liquid toward a predetermined developing position, making toner contained in said liquid developer adhere to an image carrier at said developing position, visualizing an electrostatic latent image formed on said image carrier, and accordingly forming a toner image;

a transfer step of transferring the toner image on said image carrier onto a transfer medium at a predetermined transfer position; and a stripping step of stripping off said carrier liquid from said liquid developer on said image carrier in a developed image carrying area which extends from said developing position to said transfer position, wherein a stripping amount of said carrier liquid at said stripping step is adjusted.

67. An image forming apparatus in which developing means is positioned to a predetermined development-permitting position relative to a latent image carrier which moves in a predetermined travel direction while carrying an electrostatic latent image on its surface, a liquid developer including charged toner dispersed in a carrier liquid is accordingly supplied from said developing means to said latent image carrier, said electrostatic latent image is visualized and a toner image is formed, said apparatus comprising:

an image carrier structured to carry N toner images (where N is an integer equal to or larger than 2) in a direction which corresponds to said travel direction; and transfer means which transfers the toner image on said latent image carrier onto said image carrier, wherein said developing means is structured to move between said development-permitting position and a clear-off position which is off said latent image carrier and at which therefore said liquid developer does not contact said latent image carrier, and when said image carrier is to carry (N−1) or fewer toner images, said developing means is positioned to said clear-off position so as to be responsive to a non-carrying area which does not carry a toner image.

68. The image forming apparatus of claim 67, wherein a plurality of liquid developers which contain mutually different toner colors are supplied as said liquid developer to said latent image carrier, to thereby form color toner images.

69. An image forming apparatus, comprising:

a latent image carrier structured to carry an electrostatic latent image on its surface;

a liquid developer carrier which transports a liquid developer including charged toner dispersed in a carrier liquid toward a predetermined developing position while carrying said liquid developer on its surface, brings said liquid developer into contact with said latent image carrier at said developing position, and accordingly supplies said liquid developer to said latent image carrier;

image forming means which makes toner contained in said liquid developer supplied to said latent image carrier from said liquid developer carrier adhere to said latent image carrier, visualizes said electrostatic latent image and accordingly forms a toner image;

an image carrier structured to carry on its surface the toner image formed on said latent image carrier; and transfer means which transfers the toner image on said latent image carrier onto the surface of said image carrier at a predetermined transfer position, wherein said liquid developer carrier is structured to move between a development-permitting position, at which said liquid developer on said liquid developer carrier is brought into contact with said latent image carrier at said developing position, and a clear-off position at which said liquid developer on said liquid developer carrier does not contact said latent image carrier, said image carrier is formed by a rotation member whose surface moves passed said transfer position when said rotating member rotates, and the circumference of said image carrier is capable of carrying N toner images (where N is an integer equal to or larger than 2) in the rotation direction, and at the time of transfer of (N−1) or fewer toner images by said transfer means onto the circumference of said image carrier, during a period which corresponds to a non-transfer area on said image carrier, said liquid developer carrier retracts to said clear-off position from said development-permitting position.

70. An image forming method in which developing means is positioned to a predetermined development-permitting position relative to a latent image carrier which moves in a predetermined travel direction while carrying an electrostatic latent image on its surface, a liquid developer including charged toner dispersed in a carrier liquid is accordingly supplied from said developing means to said latent image carrier, said electrostatic latent image is visualized, a toner image is formed, and said toner image is transferred onto an image carrier, wherein said image carrier is structured to carry maximum N toner images (where N is an integer equal to or larger than 2) in a direction which corresponds to said travel direction, and when said image carrier is to carry (N−1) or fewer toner images, said developing means is moved off from said latent image carrier so as to be responsive to a non-carrying area which does not carry a toner image, thereby ensuring that said liquid developer does not contact said latent image carrier.

* * * * *